US009824538B2

(12) United States Patent
Kitamura et al.

(10) Patent No.: US 9,824,538 B2
(45) Date of Patent: Nov. 21, 2017

(54) GAMING MACHINE EXECUTING GAME CAPABLE OF AWARDING SPECIAL BONUS AND METHOD OF CONTROLLING GAMING MACHINE

(71) Applicants: Universal Entertainment Corporation, Tokyo (JP); Aruze Gaming America, Inc., Las Vegas, NV (US)

(72) Inventors: Kenta Kitamura, Tokyo (JP); Takeshi Narita, Koto-ku (JP); Bungo Matsumura, Tokyo (JP); Shinichi Kawashima, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 59 days.

(21) Appl. No.: 14/820,671

(22) Filed: Aug. 7, 2015

(65) Prior Publication Data

US 2016/0042592 A1 Feb. 11, 2016

(30) Foreign Application Priority Data

Aug. 7, 2014 (JP) ..... 2014-161823

(51) Int. Cl.
*G07F 17/00* (2006.01)
*G07F 17/32* (2006.01)

(52) U.S. Cl.
CPC ..... *G07F 17/3258* (2013.01)

(58) Field of Classification Search
CPC .. G07F 17/3265; G07F 17/32; G07F 17/3244; A63F 9/24
See application file for complete search history.

(56) References Cited

U.S. PATENT DOCUMENTS

| | | | | |
|---|---|---|---|---|
| 4,097,048 A | 6/1978 | Poulsen et al. | | |
| 4,508,345 A | 4/1985 | Okada | | |
| 5,395,111 A * | 3/1995 | Inoue | G07F 17/3213 | 273/143 R |
| 5,980,384 A * | 11/1999 | Barrie | G07F 17/3265 | 273/138.1 |
| 6,290,600 B1 * | 9/2001 | Glasson | G07F 17/3265 | 273/143 R |
| 6,517,432 B1 * | 2/2003 | Jaffe | G07F 17/32 | 463/16 |
| 7,115,033 B1 * | 10/2006 | Timperley | G07F 17/3211 | 273/138.1 |

(Continued)

*Primary Examiner* — Reginald Renwick
(74) *Attorney, Agent, or Firm* — Lex IP Meister, PLLC

(57) ABSTRACT

A slot machine 1 executes the following processes of: (D1) receiving an input of betting of a game medium, (D2) reading, from a RAM 73, coin reels corresponding to the number of game media having been received in the process (D1) and setting the coin reels to be rearrangeable on the lower image display panel 141, (D3) as a game, randomly determining symbols and a coin 161 which are to be rearranged on the lower image display panel 141, (D4) executing an effect of scrolling the video reels 3 and the coin reels and visually changing the coin 161 during the scroll, and (D5) rearranging the symbols and the coin 161 determined in the process (D3) on the lower image display panel 141 and awarding a benefit or a special bonus based on a combination of the rearranged symbols and coin 161.

3 Claims, 54 Drawing Sheets

(56) References Cited

U.S. PATENT DOCUMENTS

| | | | | |
|---|---|---|---|---|
| 7,329,180 | B2 * | 2/2008 | Strom | G07F 17/32 463/12 |
| 7,448,948 | B2 * | 11/2008 | Hughs-Baird | G07F 17/32 273/138.1 |
| 7,789,744 | B2 * | 9/2010 | Fiden | G07F 17/32 463/17 |
| 7,942,733 | B2 | 5/2011 | Sakuma | |
| 8,608,544 | B2 * | 12/2013 | Aoki | G07F 17/34 463/20 |
| 8,662,986 | B2 * | 3/2014 | Rodgers | G07F 17/3262 463/20 |
| 9,016,799 | B2 * | 4/2015 | Bjornson | B03B 9/02 299/18 |
| 9,076,307 | B2 * | 7/2015 | Masen | G07F 17/3211 |
| 9,098,847 | B2 * | 8/2015 | Basallo | G07F 17/3267 |
| 9,305,436 | B2 * | 4/2016 | Mizue | G07F 17/34 |
| 2004/0048646 | A1 * | 3/2004 | Visocnik | G07F 17/32 463/16 |
| 2006/0128465 | A1 * | 6/2006 | Schultz | G07F 17/3211 463/30 |
| 2007/0077986 | A1 * | 4/2007 | Loose | G07F 17/3202 463/20 |
| 2008/0051187 | A1 * | 2/2008 | Iwamoto | G07F 17/32 463/20 |
| 2008/0287178 | A1 * | 11/2008 | Berman | G07F 17/3211 463/20 |
| 2008/0287179 | A1 * | 11/2008 | Berman | G07F 17/34 463/20 |
| 2008/0305851 | A1 * | 12/2008 | Kato | G07F 17/34 463/21 |

* cited by examiner

FIG.7A

| CODE NUMBERS | REEL1 | REEL2 | REEL3 | REEL4 | REEL5 |
|---|---|---|---|---|---|
| 0 | MELON | APPLE | ORANGE | APPLE | WATERMELON |
| 1 | MELON | APPLE | ORANGE | APPLE | WATERMELON |
| 2 | MELON | APPLE | ORANGE | APPLE | WATERMELON |
| 3 | APPLE | WATERMELON | CHERRY | WATERMELON | PLUM |
| 4 | CHERRY | WILD | WILD | WILD | CHERRY |
| 5 | CHERRY | WILD | WILD | WILD | CHERRY |
| 6 | CHERRY | WILD | WILD | WILD | CHERRY |
| 7 | WATERMELON | CHERRY | ORANGE | CHERRY | MELON |
| 8 | APPLE | WATERMELON | WATERMELON | WATERMELON | ORANGE |
| 9 | APPLE | WATERMELON | WATERMELON | WATERMELON | ORANGE |
| 10 | APPLE | WATERMELON | WATERMELON | WATERMELON | ORANGE |
| 11 | CHERRY | PLUM | PLUM | PLUM | APPLE |
| 12 | WATERMELON | ORANGE | CHERRY | ORANGE | CHERRY |
| 13 | WATERMELON | ORANGE | CHERRY | ORANGE | CHERRY |
| 14 | WATERMELON | ORANGE | CHERRY | ORANGE | CHERRY |
| 15 | ORANGE | WATERMELON | WATERMELON | WATERMELON | PLUM |
| 16 | CHERRY | PLUM | PLUM | PLUM | APPLE |
| 17 | CHERRY | PLUM | PLUM | PLUM | APPLE |
| 18 | CHERRY | PLUM | PLUM | PLUM | APPLE |
| 19 | MELON | APPLE | APPLE | APPLE | WATERMELON |
| 20 | APPLE | MELON | WATERMELON | MELON | CHERRY |
| 21 | APPLE | MELON | WATERMELON | MELON | CHERRY |
| 22 | APPLE | MELON | WATERMELON | MELON | CHERRY |
| 23 | PLUM | WATERMELON | CHERRY | CHERRY | PLUM |
| 24 | ORANGE | CHERRY | APPLE | PLUM | MELON |
| 25 | ORANGE | CHERRY | APPLE | PLUM | MELON |
| 26 | ORANGE | CHERRY | APPLE | PLUM | MELON |
| 27 | CHERRY | PLUM | WATERMELON | WATERMELON | CHERRY |
| 28 | PLUM | ORANGE | CHERRY | CHERRY | WATERMELON |
| 29 | PLUM | ORANGE | CHERRY | CHERRY | WATERMELON |
| 30 | PLUM | ORANGE | CHERRY | CHERRY | WATERMELON |

FIG.7B

| | | | | | |
|---|---|---|---|---|---|
| 31 | APPLE | MELON | PLUM | PLUM | CHERRY |
| 32 | CHERRY | PLUM | ORANGE | ORANGE | ORANGE |
| 33 | CHERRY | PLUM | ORANGE | ORANGE | PLUM |
| 34 | CHERRY | PLUM | ORANGE | ORANGE | PLUM |
| 35 | WATERMELON | WATERMELON | MELON | MELON | PLUM |
| 36 | APPLE | ORANGE | PLUM | PLUM | CHERRY |
| 37 | APPLE | ORANGE | PLUM | PLUM | |
| 38 | APPLE | ORANGE | PLUM | PLUM | |
| 39 | CHERRY | PLUM | WATERMELON | WATERMELON | |
| 40 | WATERMELON | CHERRY | CHERRY | ORANGE | |
| 41 | WATERMELON | CHERRY | CHERRY | ORANGE | |
| 42 | WATERMELON | CHERRY | CHERRY | ORANGE | |
| 43 | APPLE | WATERMELON | ORANGE | PLUM | |
| 44 | | PLUM | APPLE | CHERRY | |
| 45 | | PLUM | APPLE | CHERRY | |
| 46 | | PLUM | APPLE | CHERRY | |
| 47 | | CHERRY | PLUM | APPLE | |
| 48 | | ORANGE | MELON | ORANGE | |
| 49 | | ORANGE | MELON | ORANGE | |
| 50 | | ORANGE | MELON | ORANGE | |
| 51 | | WATERMELON | APPLE | WATERMELON | |
| 52 | | | WATERMELON | | |
| 53 | | | WATERMELON | | |
| 54 | | | WATERMELON | | |
| 55 | | | CHERRY | | |
| 56 | | | | | |

FIG.8

| | BET 1 | BET 2 | BET 3 | BET 4 | BET 5 | BET 10 | BET 15 | BET 20 |
|---|---|---|---|---|---|---|---|---|
| CODE NUMBERS | REEL5 | REEL5 | REEL5 | REEL5 | REEL5 | REEL5 | REEL5 | REEL5 |
| 0 | BLANK | BLANK | BLANK | BLANK | BLANK | BLANK | COIN | COIN |
| 1 | BLANK | BLANK | BLANK | BLANK | BLANK | COIN | COIN | COIN |
| 2 | BLANK | BLANK | BLANK | COIN | COIN | COIN | COIN | COIN |
| 3 | BLANK | BLANK | BLANK | BLANK | BLANK | BLANK | COIN | COIN |
| 4 | BLANK | BLANK | COIN | BLANK | BLANK | COIN | COIN | COIN |
| 5 | BLANK | BLANK | BLANK | COIN | COIN | COIN | COIN | COIN |
| 6 | BLANK | BLANK | BLANK | BLANK | BLANK | BLANK | COIN | COIN |
| 7 | BLANK | COIN | BLANK | BLANK | BLANK | COIN | COIN | COIN |
| 8 | BLANK | BLANK | BLANK | BLANK | COIN | COIN | COIN | COIN |
| 9 | BLANK | BLANK | COIN | COIN | BLANK | BLANK | COIN | COIN |
| 10 | BLANK | BLANK | BLANK | BLANK | BLANK | COIN | COIN | COIN |
| 11 | BLANK | BLANK | BLANK | BLANK | COIN | COIN | COIN | COIN |
| 12 | BLANK | BLANK | BLANK | BLANK | BLANK | BLANK | COIN | COIN |
| 13 | BLANK | BLANK | BLANK | COIN | BLANK | COIN | COIN | COIN |
| 14 | COIN | COIN | COIN | BLANK | COIN | COIN | COIN | COIN |
| 15 | BLANK | BLANK | BLANK | BLANK | BLANK | BLANK | COIN | COIN |
| 16 | BLANK | BLANK | BLANK | BLANK | BLANK | COIN | COIN | COIN |
| 17 | BLANK | BLANK | BLANK | COIN | COIN | COIN | COIN | COIN |
| 18 | BLANK | BLANK | BLANK | BLANK | BLANK | BLANK | COIN | COIN |
| 19 | BLANK | BLANK | COIN | BLANK | BLANK | COIN | COIN | COIN |
| 20 | BLANK | BLANK | BLANK | BLANK | COIN | COIN | COIN | COIN |
| 21 | BLANK | BLANK | BLANK | COIN | BLANK | BLANK | COIN | COIN |
| 22 | BLANK | COIN | BLANK | BLANK | BLANK | COIN | COIN | COIN |
| 23 | BLANK | BLANK | BLANK | BLANK | COIN | COIN | COIN | COIN |
| 24 | BLANK | BLANK | COIN | BLANK | BLANK | BLANK | COIN | COIN |
| 25 | BLANK | BLANK | BLANK | COIN | BLANK | COIN | COIN | COIN |
| 26 | BLANK | BLANK | BLANK | BLANK | COIN | COIN | COIN | COIN |
| 27 | BLANK | BLANK | BLANK | BLANK | BLANK | BLANK | COIN | COIN |
| 28 | BLANK | BLANK | BLANK | BLANK | BLANK | COIN | COIN | COIN |
| 29 | COIN | COIN | COIN | COIN | COIN | COIN | COIN | COIN |
| 30 | | | | | | | | |
| 31 | | | | | | | | |

FIG.10

SYMBOL COMBINATION TABLE

| NUMBER OF SYMBOLS / TYPES OF SYMBOLS | 1 | 2 | 3 | 4 | 5 |
|---|---|---|---|---|---|
| WILD | 0 | 0 | 0 | 0 | 0 |
| MELON | 0 | 0 | 25 | 100 | 500 |
| APPLE | 0 | 0 | 20 | 60 | 300 |
| ORANGE | 0 | 0 | 15 | 40 | 200 |
| PLUM | 0 | 0 | 10 | 30 | 150 |
| WATERMELON | 0 | 0 | 5 | 20 | 100 |
| CHERRY | 0 | 0 | 5 | 20 | 100 |

FIG.11

| TYPES OF PROGRESSIVE JACKPOT PAYOUTS | ESTABLISHMENT CONDITIONS (PROGRESSIVE JACKPOT TRIGGER) |
|---|---|
| GRAND JACKPOT | FIVE MELON SYMBOLS ARE ESTABLISHED ON PAYLINE AND COIN SYMBOL IS PROVIDED ON MELON SYMBOL IN REEL 5. |
| MAJOR JACKPOT | FIVE APPLE SYMBOLS ARE ESTABLISHED ON PAYLINE AND COIN SYMBOL IS PROVIDED ON APPLE SYMBOL IN REEL 5. |
| MINOR JACKPOT | FIVE ORANGE SYMBOLS ARE ESTABLISHED ON PAYLINE AND COIN SYMBOL IS PROVIDED ON ORANGE SYMBOL IN REEL 5. |
| MINI JACKPOT | FIVE PLUM SYMBOLS ARE ESTABLISHED ON PAYLINE AND COIN SYMBOL IS PROVIDED ON PLUM SYMBOL IN REEL 5. |

※ WHEN FIVE WATERMELON SYMBOLS ARE PROVIDED ON PAYLINE AND COIN SYMBOL IS PROVIDED ON WATERMELON SYMBOL ON PAYLINE IN REEL 5, PAYOUT OF "250" IS AWARDED AS BONUS WIN.

※ WHEN FIVE CHERRY SYMBOLS ARE PROVIDED ON PAYLINE AND COIN SYMBOL IS PROVIDED ON CHERRY SYMBOL ON PAYLINE IN REEL 5, PAYOUT OF "250" IS AWARDED AS BONUS WIN.

FIG.12

| LEVEL | % |
|---|---|
| GRAND(MELON) | 0.40% |
| MAJOR(APPLE) | 0.40% |
| MINOR(ORANGE) | 0.50% |
| MINI(PLUM) | 0.50% |

FIG.13

FIXED JACKPOT VALUE - FEATURE RANDOM DETERMINATION PROBABILITY SETTING TABLE

| LEVEL \ TABLE | FIXED JACKPOT VALUES | | | | | | | |
|---|---|---|---|---|---|---|---|---|
| | TABLE1 | TABLE2 | TABLE3 | TABLE4 | TABLE5 | TABLE6 | TABLE7 | TABLE8 |
| GRAND(MELON) | 50000 | 50000 | 50000 | 100000 | 100000 | 100000 | 125000 | 125000 |
| MAJOR(APPLE) | 5000 | 5000 | 12500 | 5000 | 5000 | 12500 | 5000 | 12500 |
| MINOR(ORANGE) | 1500 | 2000 | 2000 | 1500 | 1500 | 2000 | 2000 | 2000 |
| MINI(PLUM) | 500 | 500 | 500 | 500 | 500 | 500 | 500 | 500 |
| BONUS WIN (WATERMELON OR CHERRY) | 250 | | | | | | | |

| DOES BIG FRUIT CHANCE OCCUR? \ TABLE | FEATURE RANDOM DETERMINATION PROBABILITIES(WEIGHT) | | | | | | | |
|---|---|---|---|---|---|---|---|---|
| | TABLE1 | TABLE2 | TABLE3 | TABLE4 | TABLE5 | TABLE6 | TABLE7 | TABLE8 |
| NO | 9647 | 9654 | 9715 | 9684 | 9724 | 9786 | 9720 | 9824 |
| YES | 343 | 332 | 264 | 282 | 272 | 204 | 241 | 174 |
| TOTAL | 9990 | 9986 | 9979 | 9966 | 9996 | 9990 | 9961 | 9998 |

FIG.14

| NO | SYMBOLS |
|---|---|
| 1 | PLUM |
| 2 | WATERMELON |
| 3 | ORANGE |
| 4 | APPLE |
| 5 | MELON |
| 6 | CHERRY |

FIG.46

| | GAMBLE ON | GAMBLE ON |
|---|---|---|
| CASH OUT | TAKE WIN | TAKE WIN |
| GAMBLE | GAMBLE START | — |
| MAX BET | INVALID | GAMBLE START |
| SPIN | TO NORMAL GAME | TO NORMAL GAME |

| NO | SCREEN | CONTROL PANEL | OPERATION |
|---|---|---|---|
| 1 | EXIT | HELP | SHIFT TO NORMAL SCREEN |
| 2 | PREV. | BET ×1 | SHIFT TO PREVIOUS PAGE |
| 3 | NEXT | BET ×2 | SHIFT TO NEXT PAGE |

FIG.53

| TYPES OF BUTTONS | DURING IDLE | DURING GAME | DURING ERROR | DURING AUDIT | TAKE WIN OR GAMBLE |
|---|---|---|---|---|---|
| HELP | TURNED ON | TURNED OFF | TURNED OFF | TURNED OFF | TURNED ON |
| LANGUAGE SWITCHING | TURNED ON | TURNED OFF | TURNED OFF | TURNED OFF | TURNED OFF |
| VOLUME | TURNED ON | TURNED ON | TURNED OFF | TURNED OFF | TURNED ON |
| NUMBER OF LINES | TURNED ON (WHEN SELECTABLE) | TURNED OFF | TURNED OFF | TURNED OFF | TURNED OFF |
| BET AMOUNT | TURNED ON | TURNED OFF | TURNED OFF | TURNED OFF | TURNED OFF |
| PAY TABLE | TURNED ON | TURNED OFF | TURNED OFF | TURNED OFF | TURNED ON |

GAMING MACHINE EXECUTING GAME CAPABLE OF AWARDING SPECIAL BONUS AND METHOD OF CONTROLLING GAMING MACHINE

CROSS-REFERENCE TO RELATED APPLICATION

This application claims the benefit of Japanese Patent Application No. 2014-161823, filed on Aug. 7, 2014, which application is incorporated herein by reference in its entirety.

FIELD OF THE INVENTION

The present invention relates to a gaming machine which executes a game capable of awarding a special bonus.

BACKGROUND OF THE INVENTION

A known slot machine which is a gaming machine is arranged such that symbols are rearranged on a symbol display device each time a player operates a button on a control panel.

When a winning combination is established by the symbols rearranged on the symbol display device, the gaming machine awards a benefit such as payout to the player.

As one of such gaming machines, U.S. Pat. No. 4,097,048 recites a slot machine. In this slot machine, diversity is given to symbol patterns, game scenarios, effects such as effect sound, and image display, in consideration of diversified preferences of players.

U.S. Pat. No. 4,508,345 discloses a slot machine which is configured to execute a bonus game. U.S. Pat. No. 7,942,733 discloses a slot machine which is configured to award a free game to a player when a predetermined condition is established.

BRIEF SUMMARY OF THE INVENTION

As such, the entertainment characteristics of the gaming machine are enhanced by adding various elements to normal games. What kinds of element is added to the games is the key to the enhancement of the entertainment characteristics of the gaming machine.

An object of the present invention is to provide a gaming machine with enhanced entertainment characteristics.

The present invention relates to a gaming machine executing a game capable of awarding a special bonus, including: a display device configured to display a game result by rearranging a video reel group on which symbols are laid out; a storage which is configured to store the video reel group on which the symbols are laid out and a trigger symbol reel group displayed to overlap the video reel group, in the trigger symbol reel group the number of trigger symbols required to award the special bonus increases as the number of game media having been bet increases; and a controller, the controller being configured to execute the processes of: (D1) receiving an input of betting of a game medium, (D2) reading, from the storage, the trigger symbol reel group corresponding to the number of game media having been received in the process (D1) and setting the trigger symbol reel group to be rearrangeable on the display device, (D3) as the game, randomly determining the symbols and the trigger symbol which are to be rearranged on the display device, (D4) executing an effect of scrolling the video reel group and the trigger symbol reel group and visually changing the trigger symbol during the scroll, and (D5) rearranging the symbols and the trigger symbol determined in the process (D3) on the display device and awarding a benefit or the special bonus based on a combination of the rearranged symbols and trigger symbol.

According to the arrangement above, the gaming machine executes, in the game, an effect of visually changing the trigger symbol while the trigger symbol reel group is scroll-displayed to overlap the video reel group. On these coil reels, the trigger symbols which are required to award the special bonus are laid out, and the number of the trigger symbols corresponds to the number of game media having been bet. Because the number of the trigger symbols increases as the number of game media having been bet increases in this way, it is possible to emphasize the number (largeness) of the trigger symbols for a player by the number of times of visual change of the trigger symbol during the scroll of the video reel group and the trigger symbol reel group. In this way, it is possible to emphasize for a player that, the larger the number of game media having been bet is, the larger the number of the trigger symbols to be provided is and the more likely the special bonus is awarded.

In addition to the above, the gaming machine of the present invention is arranged such that, in the process (D3), effect sound is generated when the trigger symbol is displayed on the display device during the scroll.

According to the arrangement above, the effect sound is generated when the trigger symbol is displayed on the display device during the scroll. Because the number of the trigger symbols increases as the number of game media having been bet increases as above, it is possible to emphasize the number (largeness) of the trigger symbols for a player by the effect sound during the scroll of the video reel group and the trigger symbol reel group.

In addition to the above, the present invention relates to a method of controlling a gaming machine executing a game capable of awarding a special bonus, the gaming machine including: a display device configured to display a game result by rearranging a video reel group on which symbols are laid out; a storage which is configured to store the video reel group on which the symbols are laid out and a trigger symbol reel group displayed to overlap the video reel group, in the trigger symbol reel group the number of trigger symbols required to award the special bonus increases as the number of game media having been bet increases; and a controller, the method including the steps, performed under the control of the controller, of: (E1) receiving an input of betting of a game medium, (E2) reading, from the storage, the trigger symbol reel group corresponding to the number of game media having been received in the step (E1) and setting the trigger symbol reel group to be rearrangeable on the display device, (E3) as the game, randomly determining the symbols and the trigger symbol which are to be rearranged on the display device, (E4) executing an effect of scrolling the video reel group and the trigger symbol reel group and visually changing the trigger symbol during the scroll, and (E5) rearranging the symbols and the trigger symbol determined in the step (E3) on the display device and awarding a benefit or the special bonus based on a combination of the rearranged symbols and trigger symbol.

According to the method above, the gaming machine executes, in the game, an effect of visually changing the trigger symbol while the trigger symbol reel group is scroll-displayed to overlap the video reel group. On these coil reels, the trigger symbols which are required to award the special bonus are laid out, and the number of the trigger symbols corresponds to the number of game media having been bet. Because the number of the trigger symbols increases as the number of game media having been bet increases in this way, it is possible to emphasize the number (largeness) of the trigger symbols for a player by the number of times of visual change of the trigger symbol during the scroll of the video reel group and the trigger symbol reel group. In this way, it is possible to emphasize for a player that, the larger the number of game media having been bet is, the larger the number of the trigger symbols to be provided is and the more likely the special bonus is awarded.

A gaming machine with enhanced entertainment characteristics is provided.

BRIEF DESCRIPTION OF THE DRAWINGS

FIG. 7A shows the layout of symbols depicted on the circumferential surfaces of normal game video reel strips of the slot machine of the embodiment of the present invention.

FIG. 7B shows the layout of symbols depicted on the circumferential surfaces of normal game video reel strips of the slot machine of the embodiment of the present invention.

FIG. 8 illustrates the layout of coin reels in the slot machine of the embodiment of the present invention.

FIG. 10 shows a symbol combination table of slot machine of the embodiment of the present invention.

FIG. 11 illustrates a condition with which a progressive jackpot is established in the slot machine of the embodiment of the present invention.

FIG. 12 illustrates the rates of increment to the progressive jackpot payout in the slot machine of the embodiment of the present invention.

FIG. 13 illustrates a fixed jackpot value—feature random determination probability setting table of the slot machine of the embodiment of the present invention.

FIG. 14 illustrates the layout of symbols depicted on the circumferential surface of a video reel strip for the feature game in the slot machine of the embodiment of the present invention.

FIG. 46 illustrates RESIDUAL GAMBLE in the slot machine of the embodiment of the present invention.

FIG. 53 illustrates the layout of screen touch buttons in the slot machine of the embodiment of the present invention.

DETAILED DESCRIPTION OF THE PREFERRED EMBODIMENT

Outline of Present Invention

Figure 1:
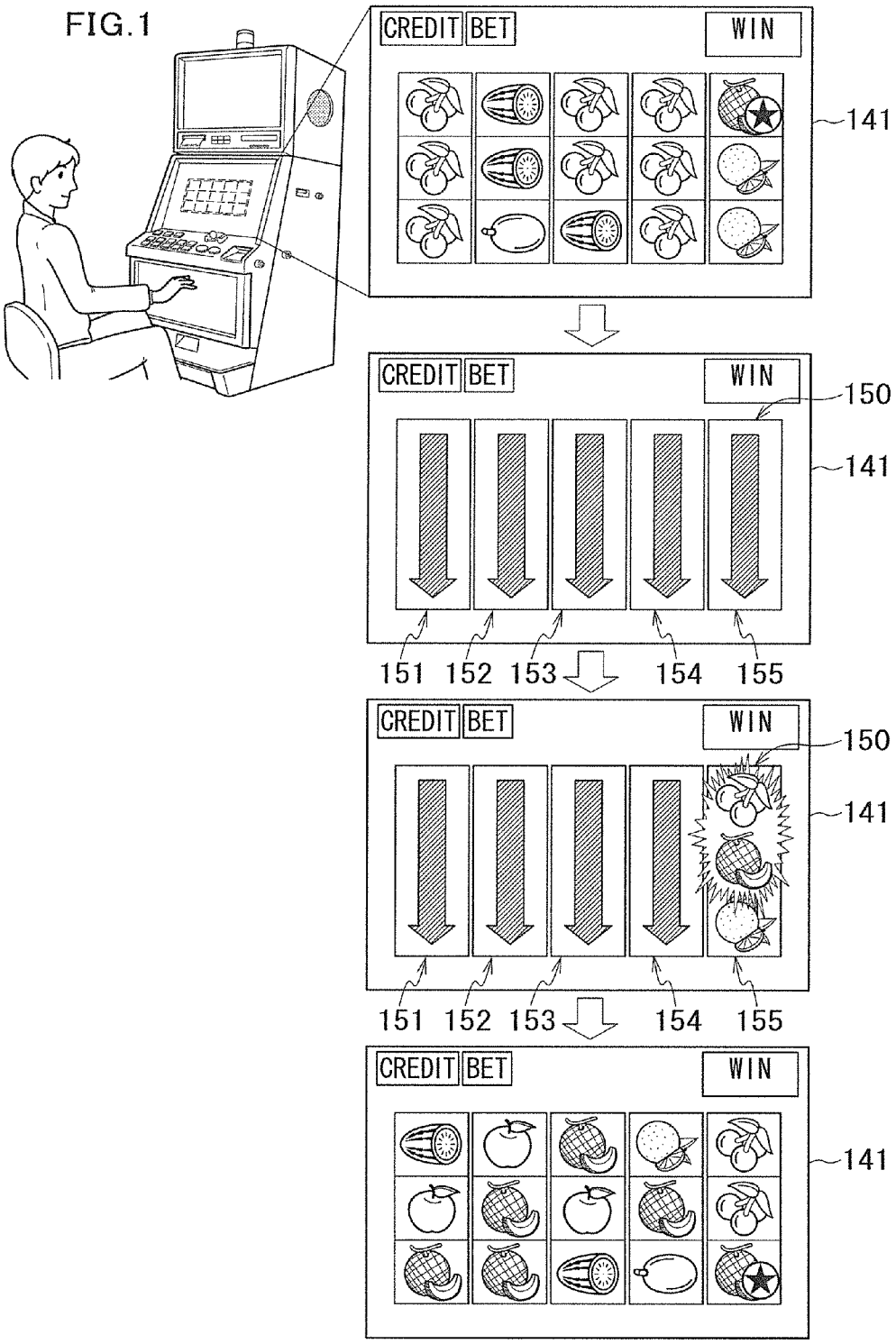
FIG. 1 shows a screen displayed when setting of a slot machine of an embodiment of the present invention is performed.

The following will describe an embodiment of the present invention with reference to figures. FIG. 1 illustrates the outline of a slot machine of the embodiment of the present invention. The slot machine 1 of the embodiment of the present invention is configured to execute a game capable of awarding a special bonus (a large payout, a progressive payout, or the like).

The slot machine 1 of the present embodiment includes: a lower image display panel 141 which is configured to display a game result by rearranging video reels 3 on which symbols are laid out;

the video reels 3 on which the symbols are laid out; and coin reels which are displayed to overlap the video reels 3 and are arranged so that the number of coins 161 required to award the special bonus increases as the number of game media having been bet increases.

This slot machine 1 executes the processes of: (D1) receiving an input of betting of a game medium, (D2) reading, from a RAM 73, coin reels (trigger symbol reel group) corresponding to the number of game media having been received in the process (D1) and setting the coin reels to be rearrangeable on the lower image display panel 141, (D3) as a game, randomly determining symbols and a coin 161 which are to be rearranged on the lower image display panel 141, (D4) executing an effect of scrolling the video reels 3 and the coin reels and visually changing the coin 161 during the scroll, and (D5) rearranging the symbols and the coin 161 determined in the process (D3) on the lower image display panel 141 and awarding a benefit or a special bonus based on a combination of the rearranged symbols and coin 161.

The slot machine 1 executes, in a game, an effect of visually changing the coin 161 while the coin reels are scroll-displayed to overlap the video reels 3. On these coil reels, the coins 161 which are required to award the special bonus are laid out, and the number of the coins 161 corresponds to the number of game media having been bet. Because the number of the coins 161 increases as the number of game media having been bet increases in this way, it is possible to emphasize the number (largeness) of the coins 161 for a player by the number of times of visual change of the coin 161 during the scroll of the video reels 3 and the coin reels. In this way, it is possible to emphasize for a player that, the larger the number of game media having been bet is, the larger the number of the coins 161 to be provided is and the more likely the special bonus is awarded.

Definitions or the Like

The slot machine is a type of a gaming machine. While the present embodiment deals with the slot machine as an example of the gaming machine, the slot machine may be another type of machine on condition that a normal game can be individually run by the machine and a feature game developing from the normal game can be run by the machine.

A normal game of the present embodiment is run by the slot machine. The normal game is a slot game of rearranging symbols.

The symbols encompass "WILD", "MELON", "APPLE", "ORANGE", "PLUM", "WATERMELON", and "CHERRY".

A coin, a bill, or electrically valuable information corresponding to these is used as a game medium (game value). It is to be noted that the game medium in the disclosure is not limited to these, and for example a game medium such as a medal, a token, electric money or the like can be adopted. Further, a later-described ticket with a barcode is also used.

The feature game of the present embodiment may be any type of game on condition that the gaming state thereof is different from that of the normal game. The feature game is a game which is executable with a smaller amount of game values bet than in the normal game. The expression "executable with a smaller amount of game value bet" includes a case where an amount of game values bet is zero. Therefore, the feature game may be a game which is run without betting a game value and the game value is paid out for an amount corresponding to rearranged symbols. In other words, the feature game may a game that starts without the consumption of the game value. On the other hand, the normal game is run on condition that a game value is bet, and is a game of paying out a game value for an amount corresponding to rearranged symbols. In other words, the normal game is a game that starts with the consumption of the game value.

The term "rearrangement" indicates that the symbols are rearranged after the arrangement of the symbols is dismissed. The term "arrangement" indicates a state in which the symbols are visually recognizable by an external player.

In the present embodiment, a jackpot indicates a special benefit different from a normal benefit, in a broad sense. A fixed jackpot indicates an arrangement with which a fixed payout is awarded as a jackpot, and a fixed jackpot value indicates a value of a fixed payout which is awarded as a jackpot. A progressive jackpot is an arrangement with which a part of game media put in the gaming machine is pooled, and the pooled credit is paid out to a gaming machine which satisfies a predetermined condition. The progressive jackpot also encompasses an arrangement with which a part of game media put in the gaming machine is pooled and added to the fixed jackpot value, and the pooled credit is paid out to a gaming machine which satisfies a predetermined condition. While the present embodiment presupposes the progressive jackpot (progressive jackpot payout) with which a part of game media put in the gaming machine is pooled and added to the fixed jackpot value and the pooled credit is paid out to a gaming machine which satisfies a predetermined condition, the present invention may be used in a gaming machine which employs the fixed jackpot.

Explanation of Function Flow Diagram

Figure 2:
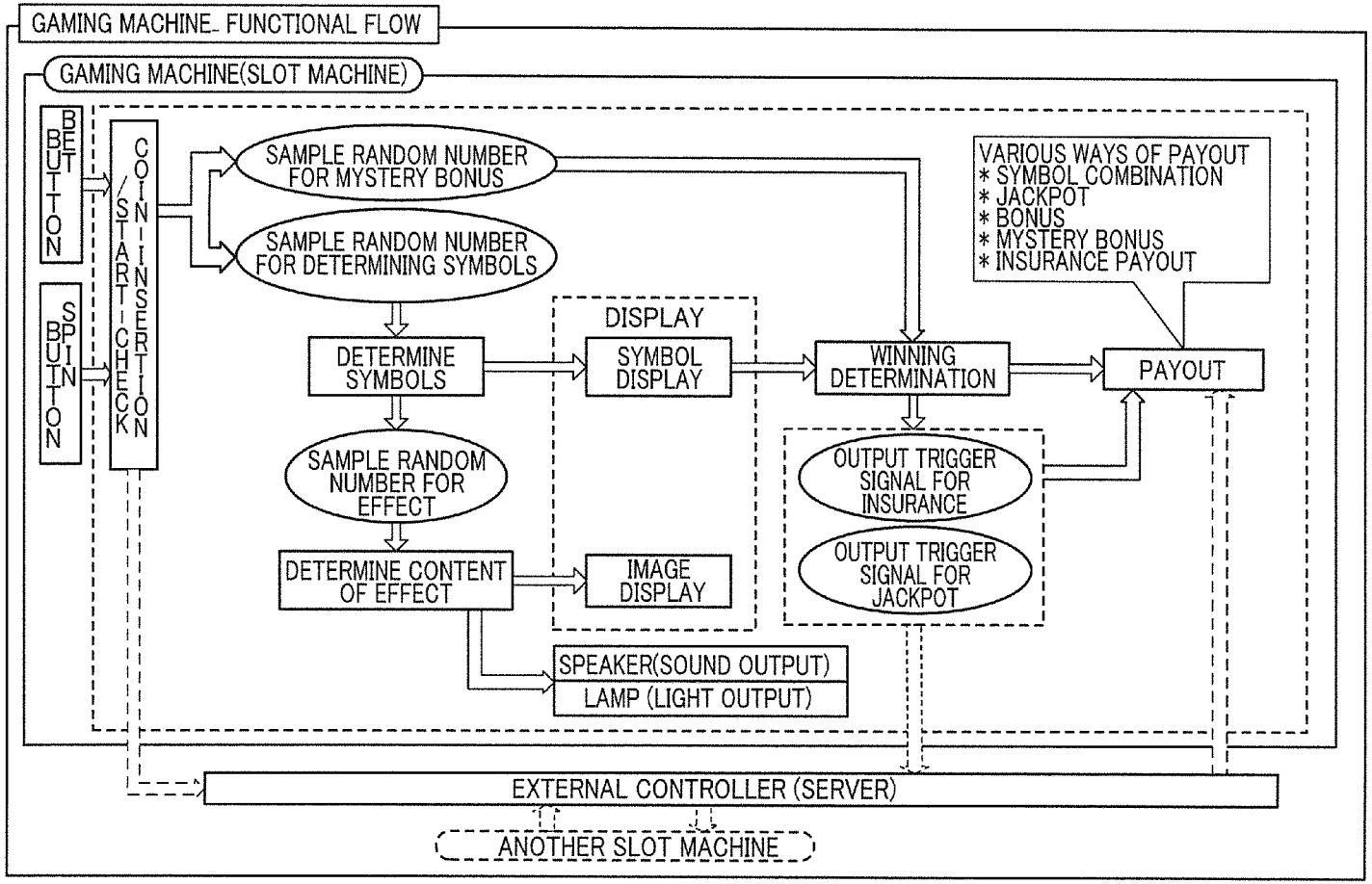
FIG. 2 shows a functional flow of the slot machine of the embodiment of the present invention.

The following will describe basic functions of the slot machine of the present invention with reference to FIG. 2. FIG. 2 shows a functional flow of the slot machine of the embodiment of the present invention.

Coin-Insertion/Start-Check Process

First, the slot machine checks whether or not a BET button has been pressed by a player, and subsequently checks whether or not a spin button has been pressed by the player.

Symbol Determination

Next, when a spin button has been pressed by the player, the slot machine extracts a random number for symbol determination, and determines symbols to be displayed for the player at the time of stopping the scroll of the symbol column, for respective video reels displayed on a display.

<Symbol Display>

Then the slot machine starts the scroll of the symbol column of each video reel, and stops the scroll so that the determined symbols 501 are displayed for the player.

<Win Determination>

Subsequently, as the rotation of the symbol column of each video reel is stopped, the slot machine determines whether the combination of the symbols displayed for the player is a combination related to win.

<Payout>

When the combination of the symbols displayed for the player is a combination related to win, the slot machine offers, to the player, benefit according to the combination. For example, when a combination of symbols related to a payout of coins has been displayed, the slot machine pays out coins of the number corresponding to the combination of symbols to the player.

When a combination of symbols associated with a feature game trigger is displayed, the slot machine starts the feature game. In the embodiment of the present invention, as the feature game, a game (free game) is carried out without the consumption of coins.

When a combination of symbols achieving a progressive jackpot trigger is displayed, the slot machine pays out coins to the player as the progressive jackpot payout. In the progressive jackpot, each time a game is executed, the slot machine calculates an amount (accumulative amount) accumulated to the jackpot payout, and sends the calculated amount to an external controller. The external controller adds the accumulative amount sent from each slot machine to the progressive jackpot payout.

In addition to the above, the slot machine may have other benefits such as mystery bonus and insurance, in addition to the benefit above. In the mystery bonus, a predetermined number of coins are paid out when a win is achieved in dedicated random determination. In this case, when the spin button is pressed, the slot machine samples a random number for the mystery bonus and randomly determines whether a mystery bonus trigger is established.

The insurance is a function for saving the player when the free game is not executed for a long period of time. In the embodiment of the present invention, the player is able to determined whether to activate the insurance at will. When the insurance is activated, a predetermined insurance activation amount must be paid. When the insurance is activated, the slot machine starts to count the number of times of execution of the game. When the counted number of times reaches a predetermined number while a large amount of payout on account of the free game or the like is not carried out, the slot machine pays out coins, the number of which corresponds to the amount set for the insurance.

<Determination of Effect>

The slot machine produces an effect by displaying an image on a display, outputting light from a lamp, and outputting sound from a speaker. The slot machine samples an effect-use random number and determines the content of an effect based on randomly determined symbols or the like.

Overall Structure of Game System

Figure 3:
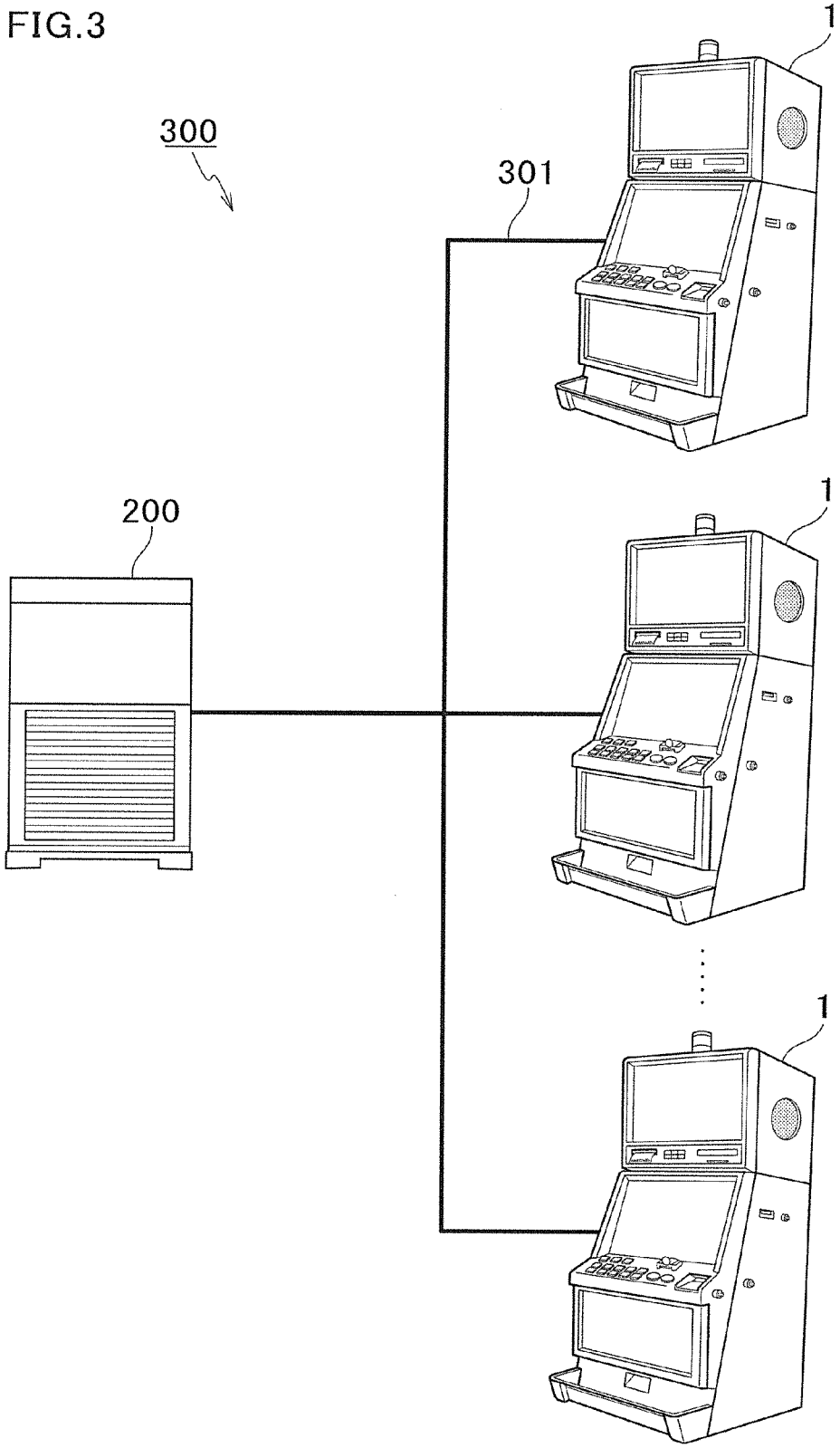
FIG. 3 shows a game system including the slot machine of the embodiment of the present invention.

The basic functions of the slot machine have been described as above. Now, referring to FIG. 3, a game system including the slot machine will be described. FIG. 3 shows a game system including the slot machine of the embodiment of the present invention.

A game system 300 includes a plurality of slot machines 1 and an external controller 200 connected with the slot machines 1 via a communication line 301.

The external controller 200 controls the plurality of slot machines 1. In the embodiment of the present invention, the external controller 200 is a hall server installed in a gaming facility having the slot machines 1. Each of the slot machines 1 has a unique identification number, and the external controller 200 identifies which one of the slot machines 1 transmitted data, by referring to the identification number. Further, when transmitting data from the external controller 200 to any of the slot machines 1, the identification number is used for designating the transmission destination.

It is to be noted that the game system 300 may be constructed within a single gaming facility where various games can be performed, such as a casino, or may be constructed among a plurality of gaming facilities. Further, when the game system 300 is constructed in a single gaming facility, the gaming system may be constructed in each floor or section of the gaming facility. The communication line 301 may be a wired or wireless line, and can adopt a dedicated line, an exchange line or the like.

Overall Structure of Slot Machine

Figure 4:
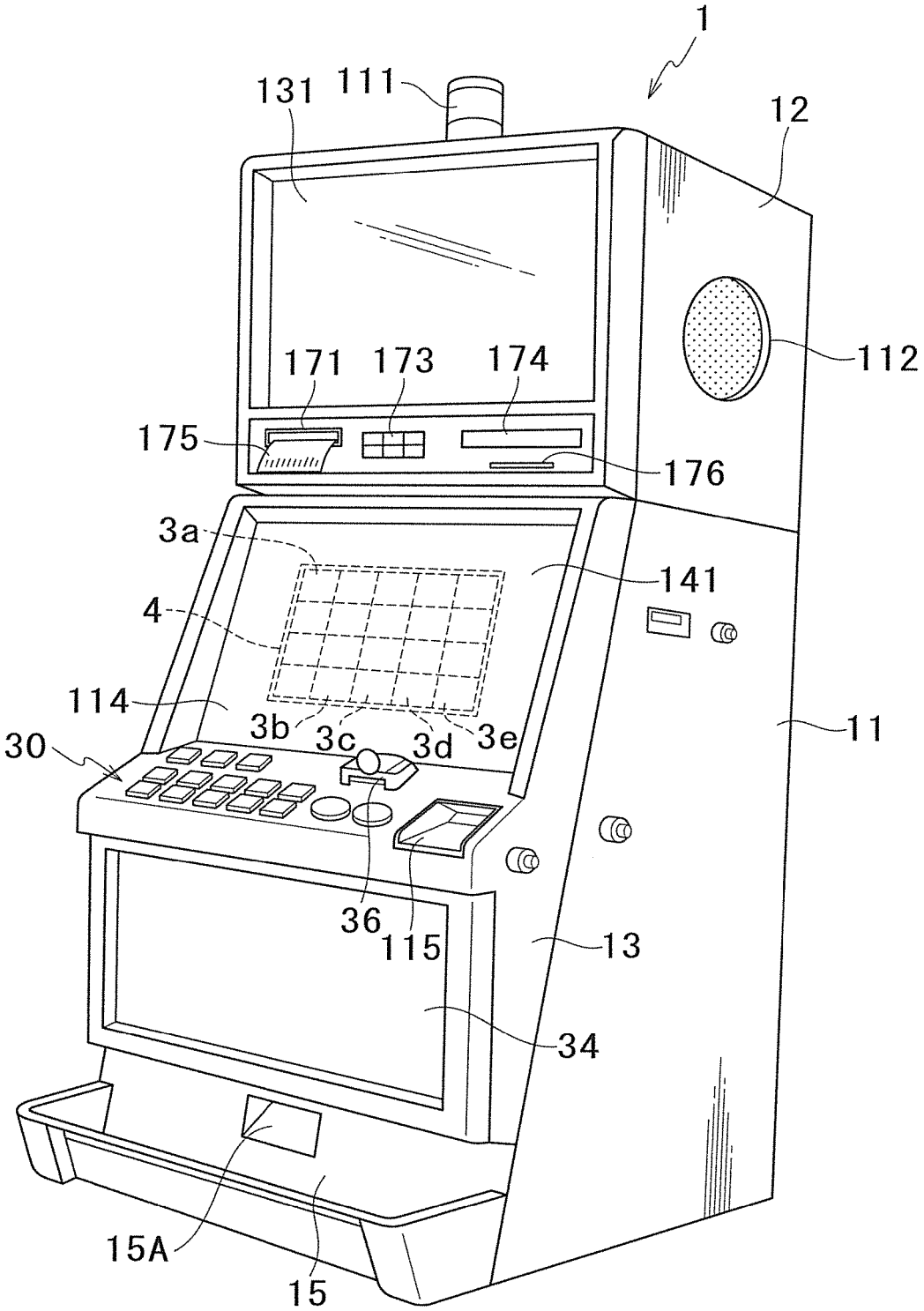
FIG. 4 shows the overall structure of the slot machine of the embodiment of the present invention.

Now, referring to FIG. 4, the overall structure of the slot machine 1 will be described. FIG. 4 shows the overall structure of the slot machine of the embodiment of the present invention.

A coin, a bill, or electrically valuable information corresponding to these is used as a game medium in the slot machine 1. In the embodiment of the present invention, furthermore, a later-described ticket with barcode is also used. It is to be noted that the game medium is not limited to these, and for example a medal, a token, electronic money or the like can be adopted.

The slot machine 1 includes a cabinet 11, a top box 12 installed on the upper side of the cabinet 11, and a main door 13 provided at the front surface of the cabinet 11.

At the center of the main door 13, a lower image display panel 141 (equivalent to a display device) is provided. The lower image display panel 141 is a liquid crystal panel and constitute a display. The lower image display panel 141 has a symbol display region 4. On the symbol display region 4, five video reels 3 (3*a*, 3*b*, 3*c*, 3*d*, and 3*e*) are displayed. In the embodiment of the present invention, the video reels express, by images, the rotation and stop of symbols on mechanical reels depicted on the circumferential surfaces. To each video reel 3, a symbol column each constituted by predetermined symbols is allocated (see, e.g., FIG. 7 which will be described later). The five video reels correspond to plural video reel groups.

In the symbol display region 4, the symbol column allocated to each video reel 3 scrolls and stops after a predetermined time elapses. As a result, parts of the respective symbol columns (three successive symbols in the embodiment of the present invention) are displayed for the player. In the symbol display region 4, for each video reel 3, one symbol is displayed in each of three regions, i.e., the upper stage, the middle stage, and the lower stage. To put it differently, 15 symbols forming a 5 by 3 matrix are displayed in the symbol display region 4.

Figure 5:
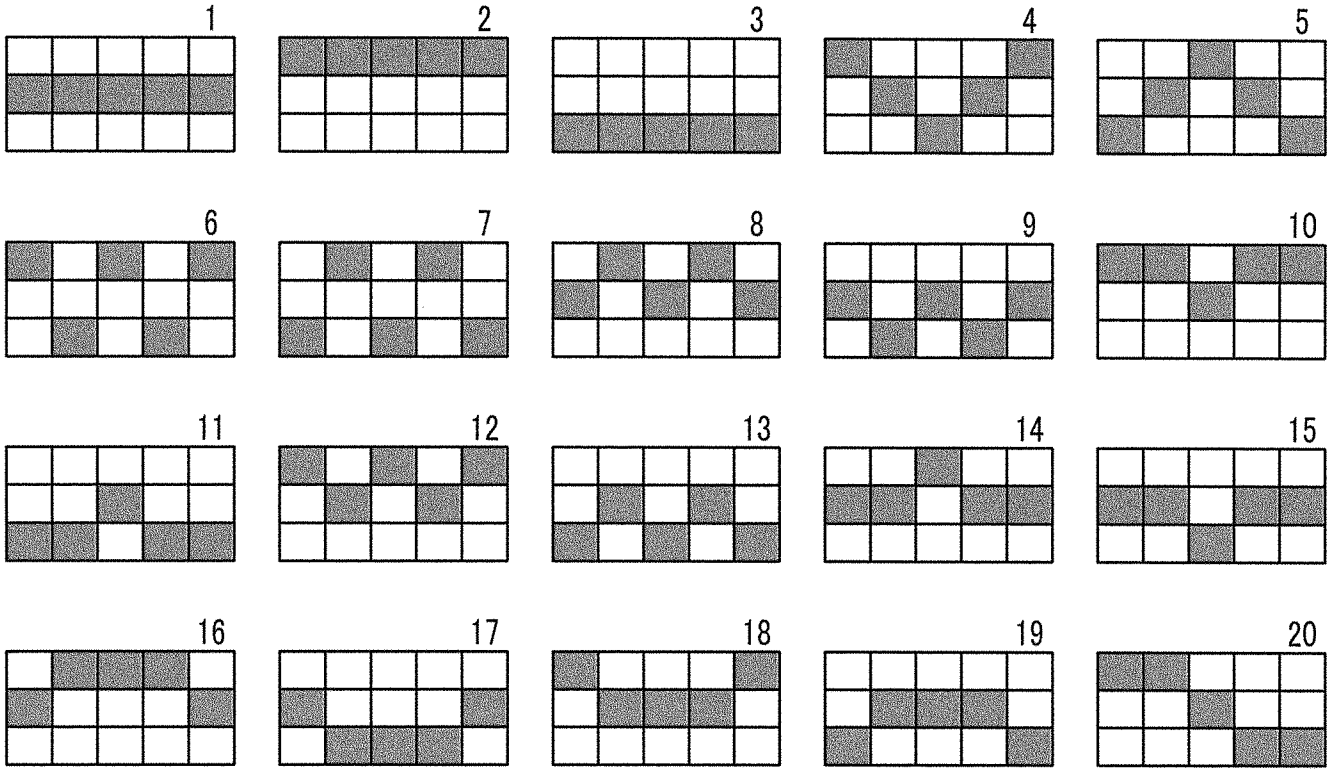
FIG. 5 shows paylines of the slot machine of the embodiment of the present invention.

In the embodiment of the present invention, a line connecting ones of three regions of the symbol columns of video reels with one another is considered as a payline (see FIG. 5). It is noted that any desired shape of the payline can be adopted, and examples of the shape of the payline may include a straight line formed by connecting the respective middle stages of the video reels 3, a V-shaped line, and a bent line. While the number of paylines in the embodiment of the present invention is 20 as shown in FIG. 5, the number may be determined at will, e.g., 30.

The lower image display panel 141 includes a touch panel 114. The player is allowed to input instructions by touching the lower image display panel 141.

Figure 6:
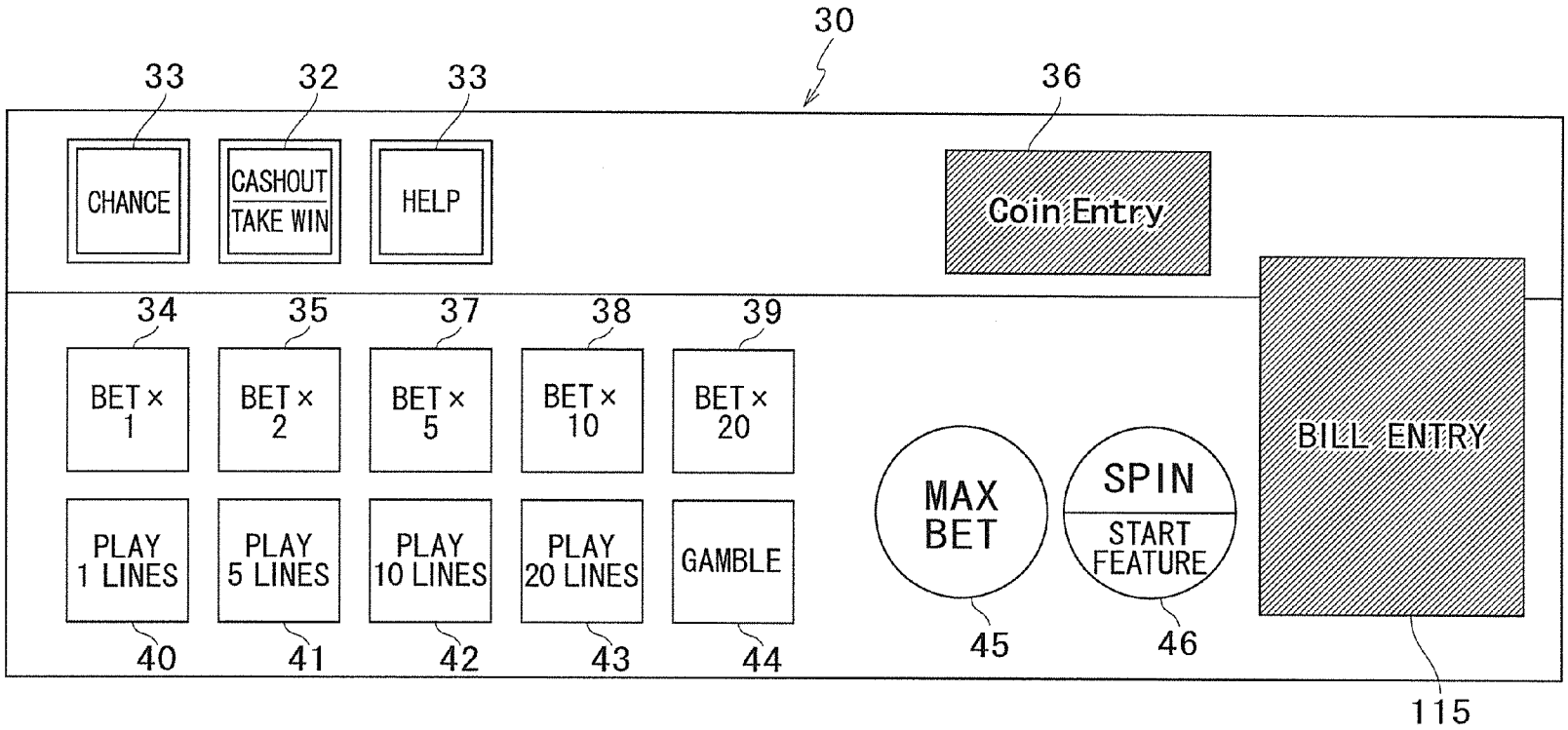
FIG. 6 shows a control panel of the slot machine of the embodiment of the present invention.

As shown in FIG. 4 and FIG. 6, below the lower image display panel 141 are provided various buttons on the control panel 30 (input device), a coin entry 36 which guides coins into the cabinet 11, and a bill entry 115.

The control panel 30 includes: a change button 31, a cashout/take win button 32, and a help button 33 arranged in the left side area of the upper stage; a 1-bet button 34, a 2-bet button 35, a 5-bet button 37, a 10-bet button 38, a 20-bet button 39, a play-1-line button 40, a play-5-lines button 41, a play-10-lines button 42, a play-20-lines button 43, and a gamble button 44 in the left side area of the lower stage. Further, a coin entry 36 and a bill entry 115 for accepting bills or the like are arranged in the right side area of the upper stage, and a max bet button 45 and a spin button 46 are arranged in the right side area of the lower stage.

The change button 31 is an operation button to be used when temporarily leaving the seat, or when requesting a staff person of the gaming facility for an exchange. The cashout/take win button 32 is an operation button to be used for cashing out coins (credits) stored in the slot machine 10. The help button 33 is pressed when the operating method of a game is unclear. When the help button 33 is pressed, various types of help information are displayed on the upper image display panel 131 and the lower image display panel 141.

The 1-bet button 34 is arranged so that, each time the button is pressed, one gaming medium is bet on each active payline from the current credit owned by the player. The 2-bet button 35 is arranged so that two credits are bet on each active payline from the current credits owned by the player. The 5-bet button 37 is arranged so that five credits are bet on each active payline from the current credits owned by the player. The 10-bet button 38 is arranged so that 10 credits are bet on each active payline from the current credits owned by the player. The 20-bet button 39 is arranged so that 20 credits are bet on each active payline from the current credits owned by the player. The MAX-BET button 45 is arranged so that 20 credits are bet on each active payline from the current credits owned by the player. Thus, the bet amount on each payline is determined by pressing of the 1-bet button 34, the 2-bet button 35, the 5-bet button 37, the 10-bet button 38, the 20-bet button 39, and the MAX-BET button 45.

The play-1-line button 40 activates paylines when pressed. In this case, the number of paylines to be activated is 1. The play-5-lines button 41 activates paylines when pressed. In this case, the number of paylines to be activated is 5. The play-10-lines button 42 activates paylines when pressed. In this case, the number of paylines to be activated is 10. The play-20-lines button 43 activates paylines when pressed. In this case, the number of paylines to be activated is 20.

The gamble button 44 is an operation button used for, for example, shifting to the gamble game after the end of the feature game or the like. The gamble game here means a game run by using credit the player has won.

The spin button 46 is a button for starting scroll of the video reels 3 (3*a*, 3*b*, 3*c*, 3*d*, and 3*e*).

The coin entry 36 is for accepting coins into the cabinet 11. The bill entry 115 validates a bill, and accepts a genuine bill into the cabinet 11.

An upper image display panel 131 is provided at the front face of the top box 12. The upper image display panel 131 includes a liquid crystal panel, and forms the display. The upper image display panel 131 displays images related to effects and images showing introduction of the game contents and explanation of the game rules. Further, the top box 12 is provided with a speaker 112 and a lamp 111. The slot machine 1 produces effects by displaying images, outputting sounds, and outputting the light.

A ticket printer 171, a card slot 176, a data display 174, and a keypad 173 are provided on the lower side of the upper image display panel 131.

The ticket printer 171 prints on a ticket a barcode representing encoded data of the credit amount, date and time, the identification number of the slot machine 1, and the like, and then outputs the ticket as the ticket 175 with a barcode. The player is able to play games by causing the slot machine to read the ticket 175 with the barcode and to exchange the ticket 175 with the barcode for bills or the like at a predetermined location in the gaming facility (e.g., a counter in the casino).

The card slot 176 is provided to insert a card storing predetermined data thereto. The card stores, for example, data for identifying the player and data regarding the playing history of the player. From and to the card inserted into the card slot 176, data is read and written by a later-described card reader 172. The card may store data equivalent to coins, bills, or credits.

The data display 174 is constituted by a fluorescent display, LEDs and the like, and displays the data read by the card reader 172 and the data inputted by the player via the keypad 173, for example. The keypad 173 is provided to input instructions and data regarding the issuance of a ticket or the like.

Symbol Column of Video Reel: Normal Reel

Next, with reference to FIG. 7, a configuration of the symbol columns on the video reels 3 of the slot machine 1 is described. FIG. 7 shows the layout of symbols depicted on the circumferential surfaces of normal game video reel strips of the slot machine of the embodiment of the present invention.

As shown in FIG. 7, to the first video reel ("Reel 1") 3*a* of the normal game video reel strip, a symbol column constituted by 44 symbols corresponding to the code numbers "0" to "43" is allocated. To the second video reel ("Reel 2") 3*b* of the normal game video reel strip, a symbol column constituted by 52 symbols corresponding to the code numbers "0" to "51" is allocated. To the third video reel ("Reel 3") 3*c* of the normal game video reel strip, a symbol column constituted by 56 symbols corresponding to the code numbers "0" to "55" is allocated. To the fourth video reel ("Reel 4") 3*d* of the normal game video reel strip, a symbol column constituted by 52 symbols corresponding to the code numbers "0" to "51" is allocated. To the fifth video reel ("Reel 5") 3*e* of the normal game video reel strip, a symbol column constituted by 37 symbols corresponding to the code numbers "0" to "36" is allocated.

As shown in FIG. 7, on the normal game video reel strips, special symbols such as "WILD" which is an all-purpose (almighty) symbol and can replace any symbols and normal symbols such as "MELON", "APPLE", "ORANGE", "PLUM", "WATERMELON", and "CHERRY" are provided.

Symbol Column of Video Reel: Coin Reel

Now, referring to FIG. 8, symbol columns of coins 161 each of which is displayed to overlap the video reel 3*e* (Reel 5) of the slot machine 1 will be described. FIG. 8 illustrates the layout of the coin reels in the slot machine of the embodiment of the present invention.

As shown in FIG. 8, there are eight types of coin reels corresponding to the number of game media (BET 1 to BET 20) bet on the normal game. The symbols of the coins 161 laid out on the coin reels are displayed to overlap symbols laid out on the video reel 3*e* (Reel 5). For example, as shown in FIG. 8, when the number of game media bet on the normal game is one, the symbols of the coins 161 are provided to overlap the "CHERRY" symbol with the code number "14" and the "WATERMELON" symbol with the code number "29" on the video reel 3*e* (Reel 5) shown in FIG. 7. When the number of game media bet on the normal game is three as shown in FIG. 8, the symbols of the coins 161 are provided on the "CHERRY" symbol with the code number "4", the "ORANGE" symbol with the code number "9", the "CHERRY" symbol with the code number "14", the "WATERMELON" symbol with the code number "19", the "MELON" symbol with the code number "24", and the "WATERMELON" symbol with the code number "29" on the video reel 3*e* (Reel 5) shown in FIG. 7.

In addition to the above, as shown in FIG. 8, the coin reels are arranged such that, as the number of game media bet on the normal game increases, the number of coins 161 displayed to overlap the symbols laid out on the video reel 3*e* (Reel 5) increases. For example, when the number of game media bet on the normal game is one, the number of coins 161 is two. When the number of game media bet on the normal game is two, the number of coins 161 is four. When the number of game media bet on the normal game is three, the number of coins 161 is six. When the number of game media bet on the normal game is four, the number of coins 161 is eight. When the number of game media bet on the normal game is five, the number of coins 161 is ten. When the number of game media bet on the normal game is ten, the number of coins 161 is twenty. When the number of game media bet on the normal game is fifteen, the number of coins 161 is thirty. When the number of game media bet on the normal game is twenty, the number of coins 161 is thirty.

Structures of Circuits Provided in Slot Machine

Figure 9:
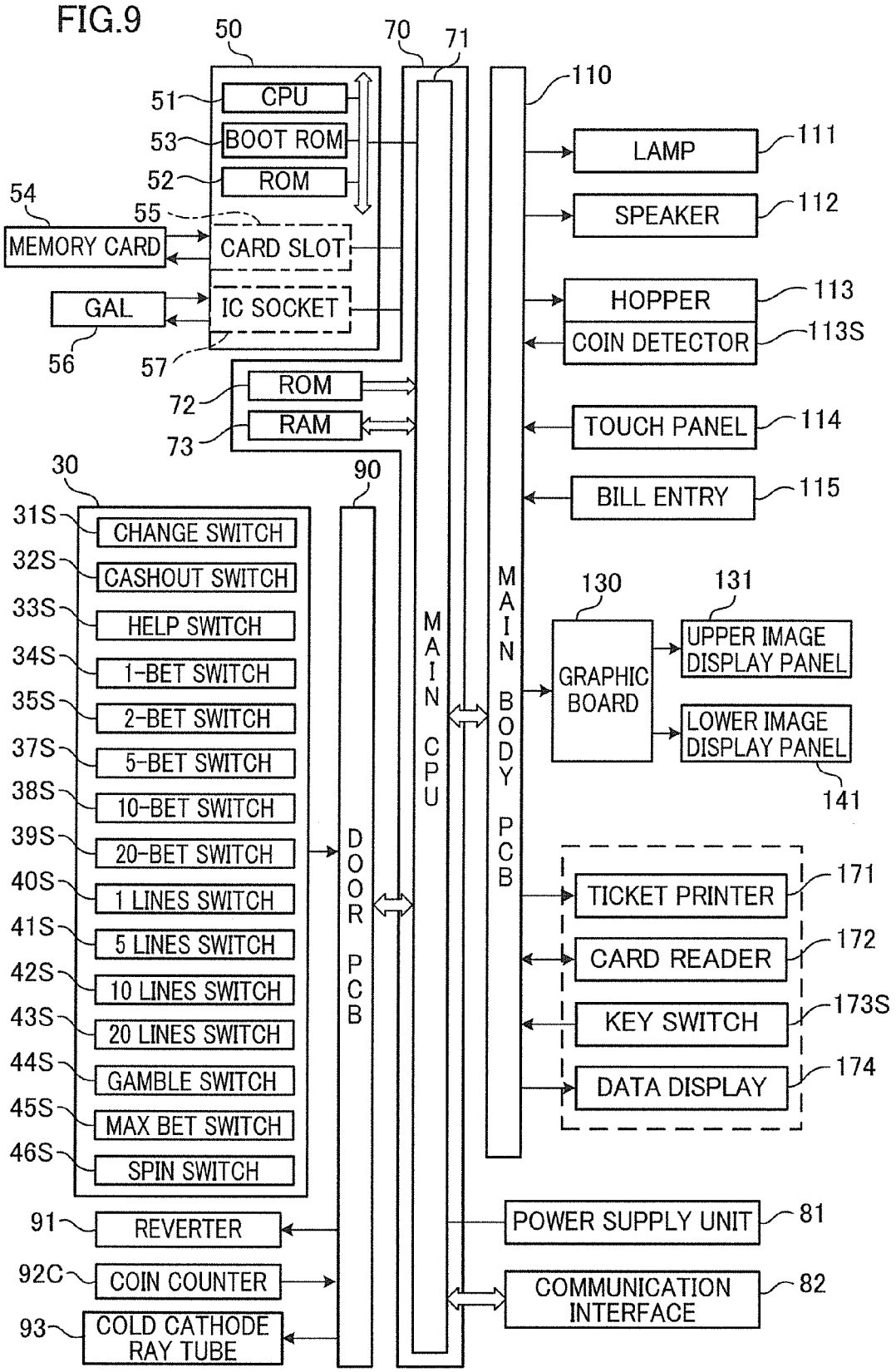
FIG. 9 is a block diagram showing an internal structure of the slot machine of the embodiment of the present invention.

Next, with reference to FIG. 9, a configuration of a circuit included in the slot machine 1 is described. FIG. 9 is a block diagram showing an internal structure of the slot machine of the embodiment of the present invention.

A gaming board 50 is provided with a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a nonvolatile memory, and stores a game program and a game system program. The game program includes a program related to game progression, a random determination program, and a program for producing effects by images and sounds (see e.g., FIGS. 15 to 20 described later). Furthermore, the game program includes data (see FIG. 7) defining the arrangement of the symbol column allocated to each video reel 3 and data (see FIG. 8) defining the arrangement of the coin reels.

The random determination program is a program for randomly determining to-be stopped symbol on the video reels 3. The to-be stopped symbol is data for determining three symbols to be displayed to the symbol display region 4 out of plural symbols forming each symbol column. The slot machine 1 of the embodiment of the present invention determines, as the to-be stopped symbol, the symbols to be displayed in a predetermined area (e.g. the uppermost stage) out of the three areas provided for each of the video reels 3 of the symbol display region 4.

The aforementioned random determination program includes symbol determination data. The symbol determination data is data that specifies random numbers so that each of the symbols forming the symbol column is determined at an equal probability for each of the video reels 3. For example, for the first video reel ("Reel 1") 3*a* of the normal game video reel strip, the data specifies the random numbers such that 44 symbols (with the code numbers "0" to "43") constituting the symbol column are determined at the same probability (i.e., 1/44). However, because the number of the symbols in 44 symbols is different between the types, the probability of the selection is different between the types of the symbols (i.e., the types are differently weighted). For example, in FIG. 7, the symbol column of the first video reel ("Reel 1") 3*a* of the normal game video reel strip includes 12 "APPLE" symbols and 4 "MELON" symbols. Therefore the former is selected at the probability of "12/44" whereas the latter is selected at the probability of "4/44".

While in the embodiment of the present invention the data is arranged to differentiate the number of symbols constituting the symbol column between the video reels 3, the number of symbols constituting the symbol column may be identical between the video reels 3. For example, each of all symbol columns of the video reels 3*a* to 3*e* of the normal game video reel strips may be constituted by 22 symbols. This arrangement increases the degree of freedom in setting the probabilities of the selection of the symbols of different types in each video reel 3.

Further, the card slot 55 is configured so that the memory card 54 can be inserted thereinto and removed therefrom, and is connected to a motherboard 70 by an IDE bus.

The GAL 56 is a type of PLD (programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents and settings of the game to be played on the slot machine 1 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like. The authentication program is a program (falsification check program) for authenticating the game program and the game system program. The pre-authentication program is a program for authenticating the aforementioned authentication program. The authentication program and the pre-authentication program are written along a procedure (authentication procedure) for proving that the program to be the subject has not been falsified.

The motherboard 70 is provided with a main CPU 71, a ROM 72, a RAM 73, and a communication interface 82. The ROM 72 and the RAM 73 are equivalent to storages such as a table storage and a progressive payout storage.

The ROM 72 includes a memory device such as a flash memory, and stores a program such as BIOS to be executed by the main CPU 71, and permanent data. When the BIOS is executed by the main CPU 71, a process for initializing predetermined peripheral devices is executed. Further, through the gaming board 50, a process of loading the game program and the game system program stored in the memory card 54 is started.

The processor of the present invention includes the main CPU 71, the ROM 72, and the RAM 73 above and the memory card 54 storing the game program and the game system program, and controls the slot machine by causing the CPU 71 to execute the game program and the game system program. Needless to say, the processor may alternatively store the game program and the game system program in the ROM 72 instead of the memory card 54.

The RAM 73 stores data and programs which are used in operation of the main CPU 71. For example, when the process of loading the aforementioned game program, game system program or authentication program is executed, the RAM 73 can store the program. The RAM 73 is provided with working areas used for operations in execution of these programs. Examples of the areas include: an area that stores counters for the number of games, the bet amount, the payout amount, the credit amount and the like; and an area that stores symbols (code numbers) randomly determined.

The communication interface 82 is for communicating with the external controller 200 such as a server, through the communication line 301. Further, the motherboard 70 is connected with a later-described door PCB (Printed Circuit Board) 90 and a main body PCB 110 by respective USBs. The motherboard 70 is also connected with a power supply unit 81. When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the main body PCB 110 are connected with input devices such as a switch and a sensor, and peripheral devices the operations of which are controlled by the main CPU 71. The door PCB 90 is connected with a control panel 30, a reverter 91, a coin counter 92C and a cold cathode tube 93.

The control panel 30 includes: a change switch 31S, a cashout switch 32S, a help switch 33S, a 1-bet switch 34S, a 2-bet switch 35S, a 5-bet switch 37S, a 10-bet switch 38S, a 20-bet switch 39S, a play-1-line switch 40S, a play-5-lines switch 41S, a play-10-lines switch 42S, a play-20-lines switch 43S, a gamble switch 44S, a max-bet switch 45S, and a spin switch 46S, which correspond to the above described buttons, respectively. Each of the switches outputs a signal to the main CPU 71 upon detection of the pressing of the button corresponding thereto by the player.

The coin counter 92C checks whether a coin inserted into the coin receiving slot 36 is genuine in terms of the material, shape, or the like. When determining that the coin is genuine, the coin counter 92C outputs a signal to the main CPU 71. Non-genuine coins are ejected through a coin payout exit 15A.

The reverter 91 operates based on a control signal output from the main CPU 71, and distributes valid coins validated by the coin counter 92C into a hopper 113 or a cash box (not illustrated). That is, coins are distributed into the hopper 113 when the hopper 113 is not filled with coins, while coins are distributed into the cash box when the hopper 113 is filled with coins.

The cold cathode tube 93 functions as a backlight installed on the rear face side of the upper image display panel 131 and the lower image display panel 141, and turns on based on a control signal outputted from the main CPU 71.

To the main body PCB 110 are connected the lamp 111, the speaker 112, a hopper 113, a coin detection unit 113S, the touch panel 114, the bill validator 115, a graphic board 130, a ticket printer 171, a card reader 172, a key switch 173S and the data display 174.

The lamp 111 turns on based on a control signal outputted from the main CPU 71. The speaker 112 outputs sounds such as BGM, based on a control signal outputted from the main CPU 71.

The hopper 113 operates based on a control signal outputted from the main CPU 71, and pays out a designated number of coins from the coin payout exit 15A to the coin tray 18. The coin detection unit 113S outputs a signal to the main CPU 71 upon detection of coins paid out by the hopper 113.

The touch panel 114 detects a place on the lower image display panel 141 touched by the player's finger or the like, and outputs to the main CPU 71 a signal corresponding to the detected place. Upon acceptance of a valid bill, the bill validator 115 outputs to the main CPU 71 a signal corresponding to the face amount of the bill.

The graphic board 130 controls image display executed by the respective upper image display panel 131 and lower image display panel 141, based on a control signal outputted from the main CPU 71. The symbol display region 4 of the lower image display panel 141 displays the five video reels 3 by which the scrolling and stop motions of the symbol columns included in the respective video reels 3 are displayed. The graphic board 130 is provided with a VDP generating image data, a video RAM temporarily storing the image data generated by the VDP, and the like.

The graphic board 130 is provided with the VDP (Video Display Processor) generating image data based on a control signal outputted from the main CPU 71, the video RAM temporarily storing the image data generated by the VDP, and the like. It is to be noted that the image data used in generation of image data by the VDP is included in the game program that has been read from the memory card 54 and stored into the RAM 73.

Based on a control signal outputted from the main CPU 71, the ticket printer 171 prints on a ticket a barcode representing encoded data of the credit amount stored in the RAM 73, date and time, the identification number of the slot machine 1, and the like, and then outputs the ticket as the ticket 175 with a barcode.

The card reader 172 reads data stored in a card inserted into the card slot 176 and transmits the data to the main CPU 71, or writes data into the card based on a control signal outputted from the main CPU 71.

The key switch 173S is provided in the keypad 173, and outputs a predetermined signal to the main CPU 71 when the keypad 173 has been operated by the player.

The data display 174 displays data read by the card reader 172 and data inputted by the player through the keypad 173, based on a control signal outputted from the main CPU 71.

Arrangement of Symbol Combination Table

Now, symbol combination tables will be described with reference to FIG. 10. FIG. 10 shows a symbol combination table for the normal game in the slot machine of the embodiment of the present invention.

The symbol combination table for the normal game defines the combinations (number of symbols) of symbols with which winning (WIN) is achieved and payout amounts. In the slot machine 1, a win is achieved when the scroll of the symbol column of each video reel 3 is stopped and a combination of symbols displayed on an activated payline (see FIG. 5) is identical with a combination of symbols defined in the symbol combination table. In accordance with the type of winning, a benefit such as the payout of coins or the start of the free game is awarded to the player. It is noted that a winning is not established (i.e. the game is lost) when the combination of symbols displayed on the payline does not match any of the combinations of symbols specified by the symbol combination table.

Basically, in cases of each of the "MELON", "APPLE", "ORANGE", "PLUM", "WATERMELON", and "CHERRY" symbols, winning is achieved when three, four, or all of five symbols of the same type are displayed on a payline of the video reel 3. The "WILD" symbol is able to substitute for the "MELON", "APPLE", "ORANGE", "PLUM", "WATERMELON", and "CHERRY" symbols.

For example, in the normal game and the free game, when five "APPLE" symbols are displayed on a payline of the symbol display region 4 by all video reels 3, it is determined that the payout amount is "300". Based on the determined payout amount, coins are paid out. The payout of the coins is done by actually ejecting coins through the coin payout exit 15A, making addition to the credit amount, or issuing a ticket with a barcode.

Establishment Conditions of Progressive Jackpot

The slot machine 1 of the present embodiment pays out coins as the progressive jackpot payout, when a combination of symbols achieving a progressive jackpot trigger (establishment condition) is displayed. In the slot machine 1 of the present embodiment, as shown in FIG. 11, four types of the progressive jackpot payouts ("GRAND JACKPOT", "MAJOR JACKPOT", "MINOR JACKPOT", and "MINI JACKPOT") may be established (equivalent to progressive payouts). The progressive jackpot trigger (establishment condition) of the "GRAND JACKPOT" is achieved when five "MELON" symbols are provided on a payline and the coin 161 symbol is provided on the "MELON" symbol on the payline in the video reel 3*e* (Reel 5). the progressive jackpot trigger (establishment condition) of the "MAJOR JACKPOT" is achieved when five "APPLE" symbols are provided on a payline and the coin 161 symbol is provided on the "APPLE" symbol on the payline in the video reel 3*e* (Reel 5). The progressive jackpot trigger (establishment condition) of the "MINOR JACKPOT" is achieved when five "ORANGE" symbols are provided on a payline and the coin 161 symbol is provided on the "ORANGE" symbol on the payline in the video reel 3*e* (Reel 5). The progressive jackpot trigger (establishment condition) of the "MINI JACKPOT" is achieved when five "PLUM" symbols are provided on a payline and the coin 161 symbol is provided on the "PLUM" symbol on the payline in the video reel 3*e* (Reel 5). When five "WATERMELON" symbols are provided on a payline and the coin 161 symbol is provided on the "WATERMELON" symbol on the payline in the video reel 3*e* (Reel 5), a payout of "250" is awarded as BONUS WIN. When five "CHERRY" symbols are provided on a payline and the coin 161 symbol is provided on the "CHERRY" symbol on the payline in the video reel 3*e* (Reel 5), a payout of "250" is awarded as BONUS WIN.

Fixed Jackpot Value—Feature Random Determination Probability Setting Table

The progressive jackpot payout of the present embodiment is prepared by adding up a progressive initial value (which is "1" in the present embodiment), a value which is incremented with a predetermined rate of game media bet on each execution of the normal game (see the rates of increment shown in FIG. 12), and the value of the fixed jackpot.

The progressive initial value is "1" in all of the "GRAND JACKPOT", "MAJOR JACKPOT", "MINOR JACKPOT", and "MINI JACKPOT".

In the "GRAND JACKPOT", as shown in FIG. 12, 0.40% of the game media bet on the normal game by the player is incremented in each execution of the normal game and accumulated.

In the "MAJOR JACKPOT", as shown in FIG. 12, 0.40% of the game media bet on the normal game by the player is incremented in each execution of the normal game and accumulated. In the "MINOR JACKPOT", as shown in FIG. 12, 0.50% of the game media bet on the normal game by the player is incremented in each execution of the normal game and accumulated. In the "MINI JACKPOT", as shown in FIG. 12, 0.50% of the game media bet on the normal game by the player is incremented in each execution of the normal game and accumulated.

With the fixed jackpot, the minimum payout when winning the progressive jackpot payout is guaranteed, as the fixed jackpot value is set in advance. This fixed jackpot value can be arbitrarily set. As detailed below, in the present embodiment, the fixed jackpot value can be arbitrarily selected from the tables 1 to 8 in the fixed jackpot value—feature random determination probability setting table shown in FIG. 13. For example, in the table 1, as shown in FIG. 13, the fixed jackpot value of the "GRAND JACKPOT" is "50000", the fixed jackpot value of the "MAJOR JACKPOT" is "5000", the fixed jackpot value of the "MINOR JACKPOT" is "1500", and the fixed jackpot value of the "MINI JACKPOT" is "500".

When the fixed jackpot value can be arbitrarily set as above, because the payout rate (the rate of payout to the game media having been bet) in the slot machine 1 varies, this payout rate must be kept constant (same). To achieve this, in the present embodiment, as shown in FIG. 13, a feature random determination probability at which the shifting from the normal game to the feature game (big fruits chance) occurs is arranged to decrease as the fixed jackpot value in each of the tables 1 to 8 increases. For example, when the table 1 is selected, as shown in FIG. 13, the probability of shifting from the normal game to the feature game (big fruits chance) is "343/9990". When the table 8 is selected, the probability of shifting from the normal game to the feature game (big fruits chance) is "174/9998". In the present embodiment, the random determination of the shifting from the normal game to the feature game (big fruits chance) is done in the form of mystery bonus. That is to say, irrespective of the combination of the symbols rearranged in the normal game, the feature game (big fruits chance) occurs immediately after that normal game in accordance with the feature random determination probability.

Contents of Program

Now, the program to be executed by the slot machine 1 is described with reference to FIGS. 15 to 20.

Figure 15:
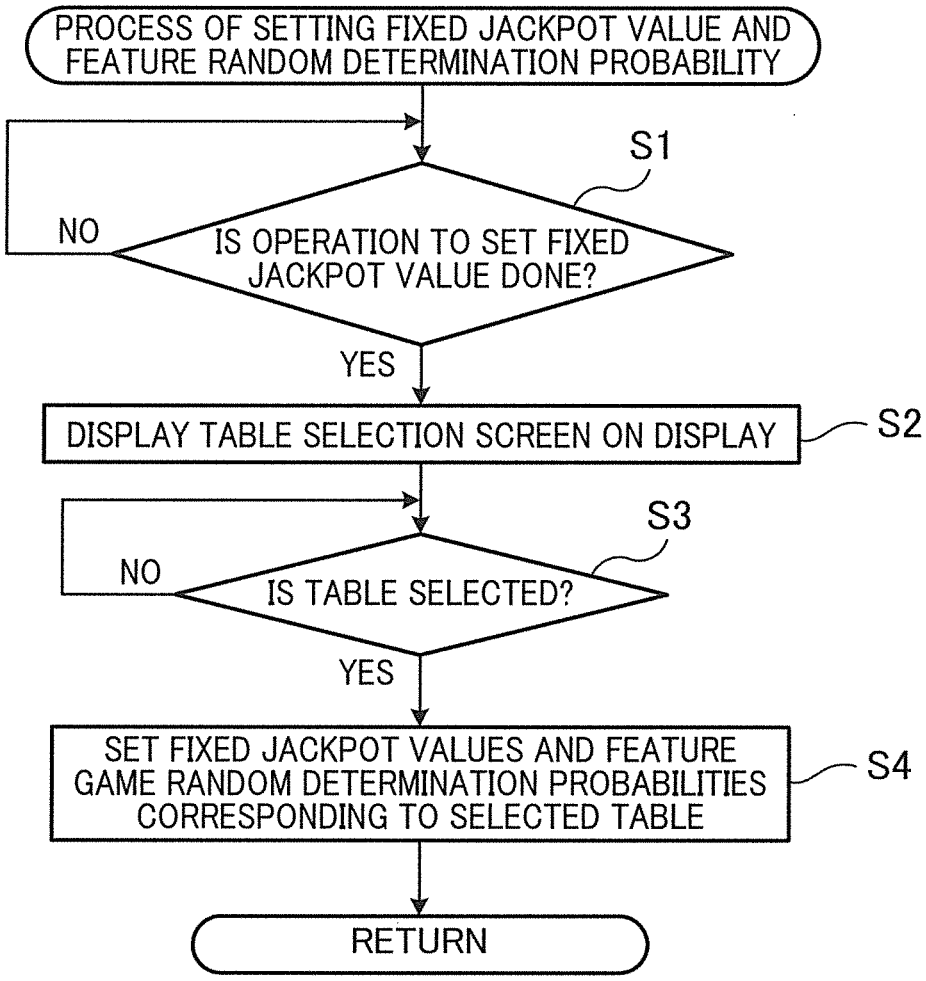
FIG. 15 is a flowchart of a process of setting a fixed jackpot value and a feature random determination probability in the slot machine of the embodiment of the present invention.

(Process of Setting Fixed Jackpot Value And Feature Random Determination Probability) To begin with, with reference to FIG. 15, a process of setting the fixed jackpot value and the feature random determination probability will be described.

The main CPU 71 determines whether the control panel 30 or the touch panel 114 of the lower image display panel 141 is operated and an operation input for setting the fixed jackpot in the progressive jackpot payout is made (S1). When no operation input for setting the fixed jackpot is done (S1: NO), an operation input is waited for.

In the meanwhile, when an operation input for setting the fixed jackpot is done (S1: YES), the table selection screen 190 is displayed on the lower image display panel 141 as shown in FIG. 1 (S2). On the table selection screen 190, the tables 1 to 8 are displayed as options and the selection of a table is received. Furthermore, on the table selection screen 190, the fixed jackpot value—feature random determination probability setting table shown in FIG. 13 is displayed in a lower part to give an explanation for the tables 1 to 8.

Subsequently, the main CPU 71 determines which one of the tables 1 to 8 is selected by an operation of the control panel 30 or the touch panel 114 of the lower image display panel 141 (S3). When no option is selected (S3: NO), the selection is waited for.

In the meanwhile, when one of the tables 1 to 8 is selected (S3: YES), the fixed jackpot values corresponding to the selected table are set as the fixed jackpots of the progressive jackpot payout (stored in the RAM 73) (S4). For example, when the table 1 is selected in S3, as shown in FIG. 13, the fixed jackpot value of the "GRAND JACKPOT" is "50000", the fixed jackpot value of the "MAJOR JACKPOT" is "5000", the fixed jackpot value of the "MINOR JACKPOT" is "1500", and the fixed jackpot value of the "MINI JACKPOT" is "500".

In addition to the above, when one of the tables 1 to 8 is selected (S3: YES), the feature random determination probability corresponding to the selected table is set as the probability of shifting from the normal game to the feature game (big fruits chance) (stored in the RAM 73) (S4). For example, when the table 1 is selected in S3, as shown in FIG. 13, the probability of shifting from the normal game to the feature game (big fruits chance) is "343/9990". The process is then terminated.

According to the arrangement above, when the fixed jackpot value which is the source of the progressive jackpot payout awarded when the progressive jackpot trigger is established is large, the feature random determination probability at which the shifting from the normal game to the feature game occurs is low. In the meanwhile, when the fixed jackpot value is small, the feature random determination probability of shifting from the normal game to the feature game is high. On this account, the overall payout rate is adjustable irrespective of the fixed jackpot value.

Furthermore, according to the arrangement above, even if the fixed jackpot of the progressive jackpot payout is changed, it is easy for the administrator of the slot machine 1 to adjust the overall payout rate to be constant without changing the layout of the symbols on the video reels 3, the number of specific symbols, or the like, by utilizing the feature random determination probability of shifting from the normal game to the feature game, which is associated with the fixed jackpot.

In the present embodiment, the feature random determination probabilities and the fixed jackpot values corresponding to the feature random determination probabilities are, in the fixed jackpot value—feature random determination probability setting table, arranged such that the payout rate to the game media having been bet is always constant.

According to the arrangement above, the fixed jackpot value—feature random determination probability setting table in which amounts of the fixed jackpots are associated with the feature random determination probabilities is arranged such that a large amount of fixed jackpot (first fixed jackpot) is associated with a low feature random determination probability and a small amount of fixed jackpot (second fixed jackpot) (i.e., smaller than the first fixed jackpot) is associated with a high feature random determination probability. In this way, the payout rate is always substantially the same no matter which the fixed jackpot value is set and the game is executed.

Main Control Process

Figure 16:
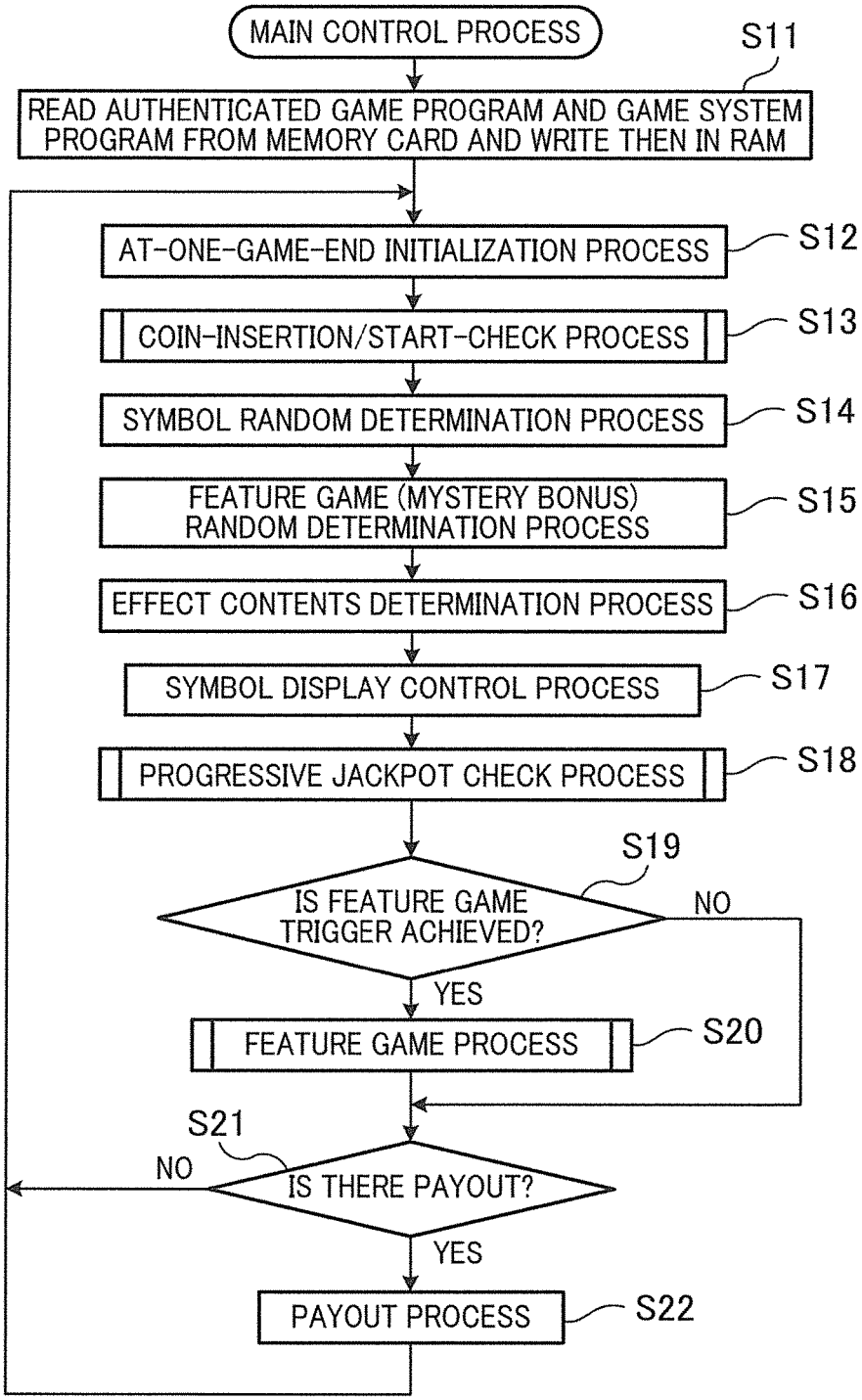
FIG. 16 is a flowchart of a main control process in the slot machine of the embodiment of the present invention.

Now, a main control process will be described with reference to FIG. 16. First, when the slot machine 1 is powered on, the main CPU 71 reads the authenticated game program and game system program from the memory card 54 through the gaming board 50, and writes the programs into the RAM 73 (S11).

Next, the main CPU 71 executes at-one-game-end initialization process (S12). For example, data that becomes unnecessary after each game in the working areas of the RAM 73, such as the bet amount and the symbols randomly determined, is cleared.

The main CPU 71 executes a coin-insertion/start-check process which is described later with reference to FIG. 17 (S13). In this process, an input check or the like is executed for the 1-bet switch 34S, the 2-bet switch 35S, the 5-bet switch 37S, the 10-bet switch 38S, the 20-bet switch 39S, the max-bet switch 45S, the play-1-line switch 40S, the play-5-lines switch 41S, the play-10-lines switch 42S, the play-20-lines switch 43S, the spin switch 46S, or the like.

The main CPU 71 then executes a symbol random determination process (S14). In the process, to-be stopped symbol is determined based on the random numbers for symbol determination.

Specifically, the main CPU 71 first samples random numbers for symbol determination. The main CPU 71 then randomly determines to-be stopped symbol for the video reels 3. The main CPU 71 executes random determination for each of the video reels 3, and determines any one of the symbols as the to-be stopped symbol. The probabilities of the respective symbols being determined are basically equal. The main CPU 71 stores the determined to-be stopped symbol of each video reel 3 in a symbol storing area in the RAM 73.

Subsequently, the main CPU 71 executes a feature game (mystery bonus) random determination process (S15). In this process, random determination is performed to determine whether shifting from the normal game to the feature game (i.e., big fruits chance occurs) is performed. In the present embodiment, the main CPU 71 performs random determination based on the above-described fixed jackpot value and the feature random determination probability set in the feature random determination probability setting process, and determines whether to shift the normal game to the feature game (occurrence of the big fruits chance). For example, when the table 1 is selected in S3, the feature random determination probability is "343/9990". On this account, whether shifting from the normal game to the feature game (occurrence of the big fruits chance) is performed is randomly determined at the probability of "343/9990". When the shifting occurs, the feature game trigger is established.

The main CPU 71 then executes an effect contents determination process (S16). The main CPU 71 samples an effect-use random number, and randomly selects any of the effect contents from the preset plurality of effect contents.

Figure 29:
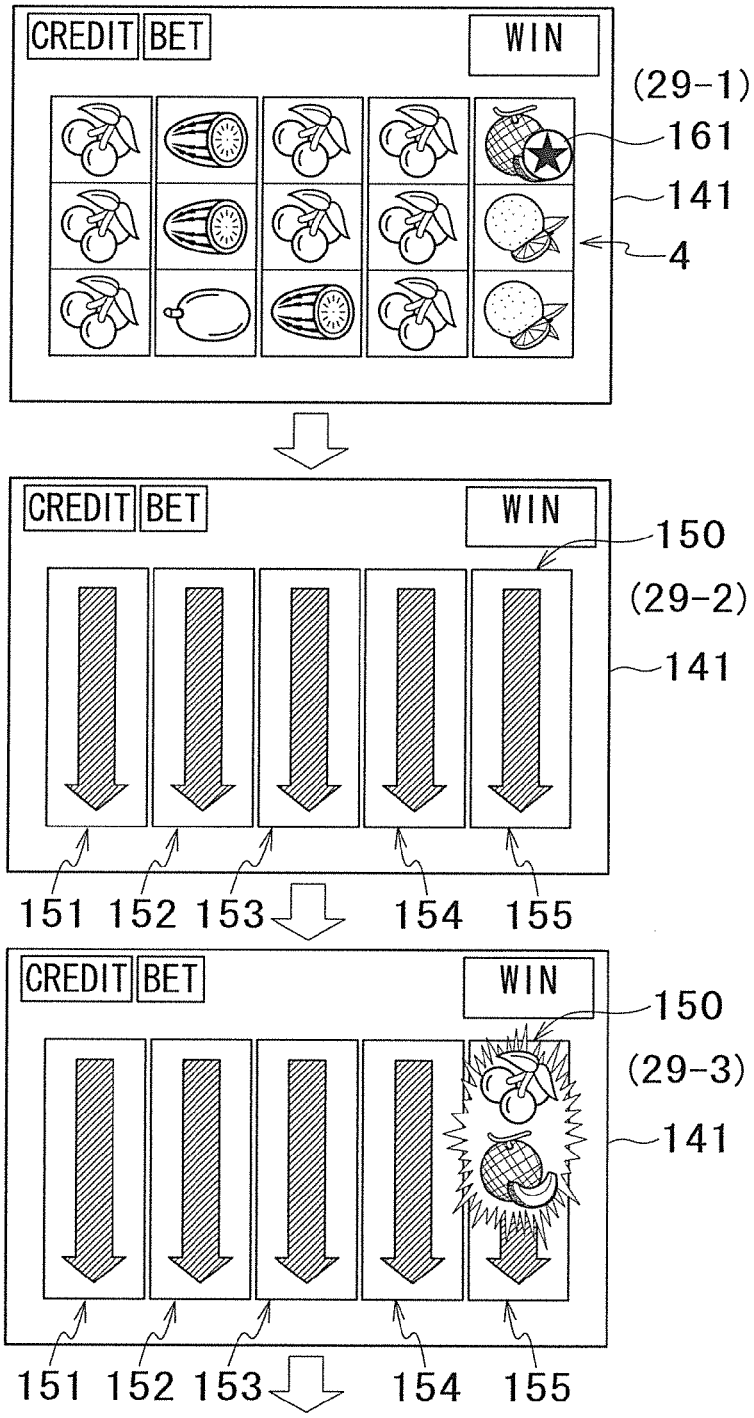
FIG. 29 illustrates a scroll effect of the video reel of the slot machine of the embodiment of the present invention.

Next, the main CPU 71 executes the symbol display control process (S17). In the process, as shown in FIG. 29, the scroll of the symbol column of each video reel 3 is started, and the to-be stopped symbol determined in the symbol random determination process of S14 is stopped at a predetermined position (e.g. the upper area in the symbol display region 4). That is, 15 symbols including the to-be stopped symbol are displayed in the symbol display region 4. For example, when the to-be stopped symbol is the symbol with the code number "10" and this symbol is displayed in the upper stage, the symbols with the code numbers "11" and "12" are displayed in the middle stage and the lower stage of the symbol display region 4, respectively.

In this symbol display control process, as described above, the coin reel is displayed to overlap the symbols laid out on the fifth video reel 3*e* (Reel 5). Subsequently, as shown in (29-3) in FIG. 29, while each video reel 3 is scrolling, an effect of visually changing the symbol on which the coin 161 is provided is performed on the fifth video reel 3*e*.

This effect of visually changing the symbol on which the coin 161 is provided is an effect of providing visual appeal by changing the display state of the symbol. For example, the coin 161 symbol has a shape like a coin. This coin 161 is changed to a display state indicating a meteor while each video reel 3 is scrolling. In this way, an effect providing visual appeal is executed. In this regard, the symbol which is visually changed may include not only the coin 161 but also the symbols neighboring the coin 161 on the fifth video reel 3*e*, and the symbol which is visually changed may be only changed to the extent that the original shape is distinguishable.

The effect of visually changing the symbol may be an effect of changing and controlling the brightness in a flashing manner when the coin 161 is displayed and scrolls in the symbol display region 4, or may be an effect of adding a variety to the transmittance by changing a colored part of the coin 161 so that the player perceives as if the coin 161 shines.

According to the arrangement above, in the game, the effect of visually changing the symbol on which the coin 161 is provided, when the coin reel on which the coins 161 functioning as trigger symbols required to award the progressive jackpot payout, the number of which corresponds to the number of game media having been bet, are laid out is scroll-displayed to overlap the video reel 3. Because the number of the provided coins 161 increases as the number of game media having been bet increases, it is possible to appeal the number of coins 161 (largeness) to the player by the number of times of visual change of the coins 161 is performed during the scroll of the video reel 3 and the coin reel. With this, it is possible to appeal to the player that a special bonus such as the progressive jackpot is more likely to be awarded when the number of the coins 161 provided on the fifth video reel 3*e* increases as the number of game media having been bet increases.

In the symbol display control process, in addition to the above, effect sound may be generated when the coin 161 appears on the lower image display panel 141 while the video reel 3 and the coin reel are scrolling.

According to the arrangement above, because the number of the provided coins 161 increases as the number of game media having been bet increases, it is possible to appeal the number of coins 161 (largeness) to the player by effect sound during the scroll of the video reel 3 and the coin reel.

Figure 20:
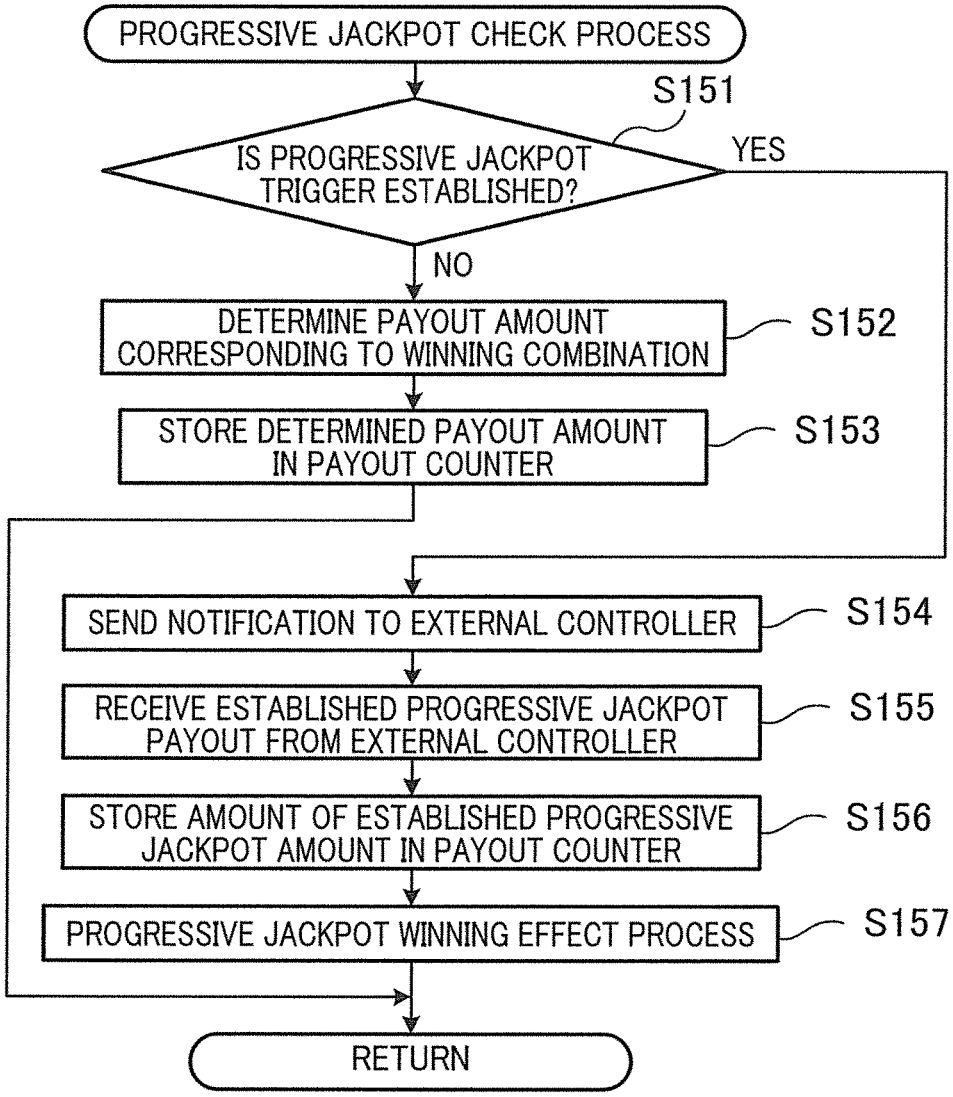
FIG. 20 is a flowchart of a progressive jackpot check process of the slot machine of the embodiment of the present invention.

Subsequently, the main CPU 71 executes a progressive jackpot check process which will be described later with reference to FIG. 20 (S18). In this process, the payout amount is determined in accordance with a combination of the symbols displayed on a payline, and the progressive jackpot payout amount in case of the establishment of the progressive jackpot trigger (establishment condition) is determined and stored in a payout counter provided in the RAM73.

Subsequently, the main CPU 71 determines whether the feature game trigger has been established in S15 (S19). When the feature game trigger has been established (S19: YES), the main CPU 71 executes the later-described feature game process (S20).

Figure 33:
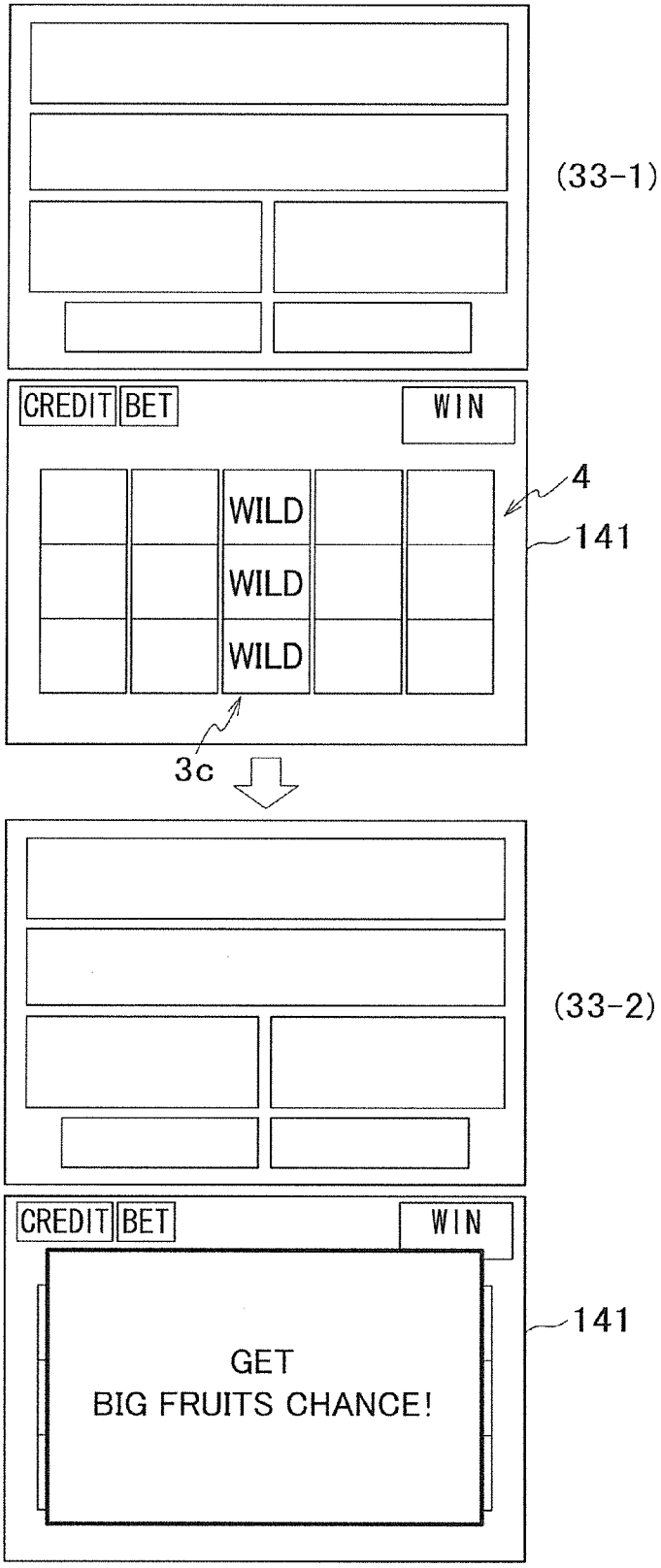
FIG. 33 shows an effect screen of the slot machine of the embodiment of the present invention.

When determining whether the normal game is shifted to the feature game (the occurrence of the big fruits chance), as shown in (33-1) in FIG. 33, an effect of providing the "WILD" symbols in the upper, middle, and lower stages of the third video reel 3*c* in the symbol display region 4 is executed, and in a part thereof, an effect with which the feature game trigger is established is executed (33-2 in FIG. 33). That is to say, after the execution of the effect of providing the "WILD" symbols in the upper, middle, and lower stages, the feature game trigger is established at a part thereof but the feature game trigger is not established at the remaining parts. In this case, an indication effect is performed in such a way that, the effect of providing the "WILD" symbols in the upper, middle, and lower stages is always executed before the feature game trigger is established but the feature game trigger is not always established even if the effect of providing the "WILD" symbols in the upper, middle, and lower stages is executed.

Thereafter, after the step S20 or when it is determined in the step S19 that the feature game trigger is not established (S19: NO), the main CPU 71 determines whether there is a payout (S21). That is to say, whether a payout has been awarded in S18 or S20 is determined. When there is a payout (S21: YES), a payout process is executed (step S22). The main CPU 71 adds, to the value stored in the credit amount storage area in the RAM 73, the value in the payout amount storage area, the value stored in the payout counter, and the value stored in the feature game payout counter. Alternatively, the hopper 113 may be driven based on an input to the collect switch 32S, and coins are discharged to the coin tray 15 according to the value stored in the payout amount storage area.

After this process or when it is determined in S21 that there is no payout (S21: NO), the process proceeds to the step S12.

Coin-Insertion/start-Check Process

Figure 17:
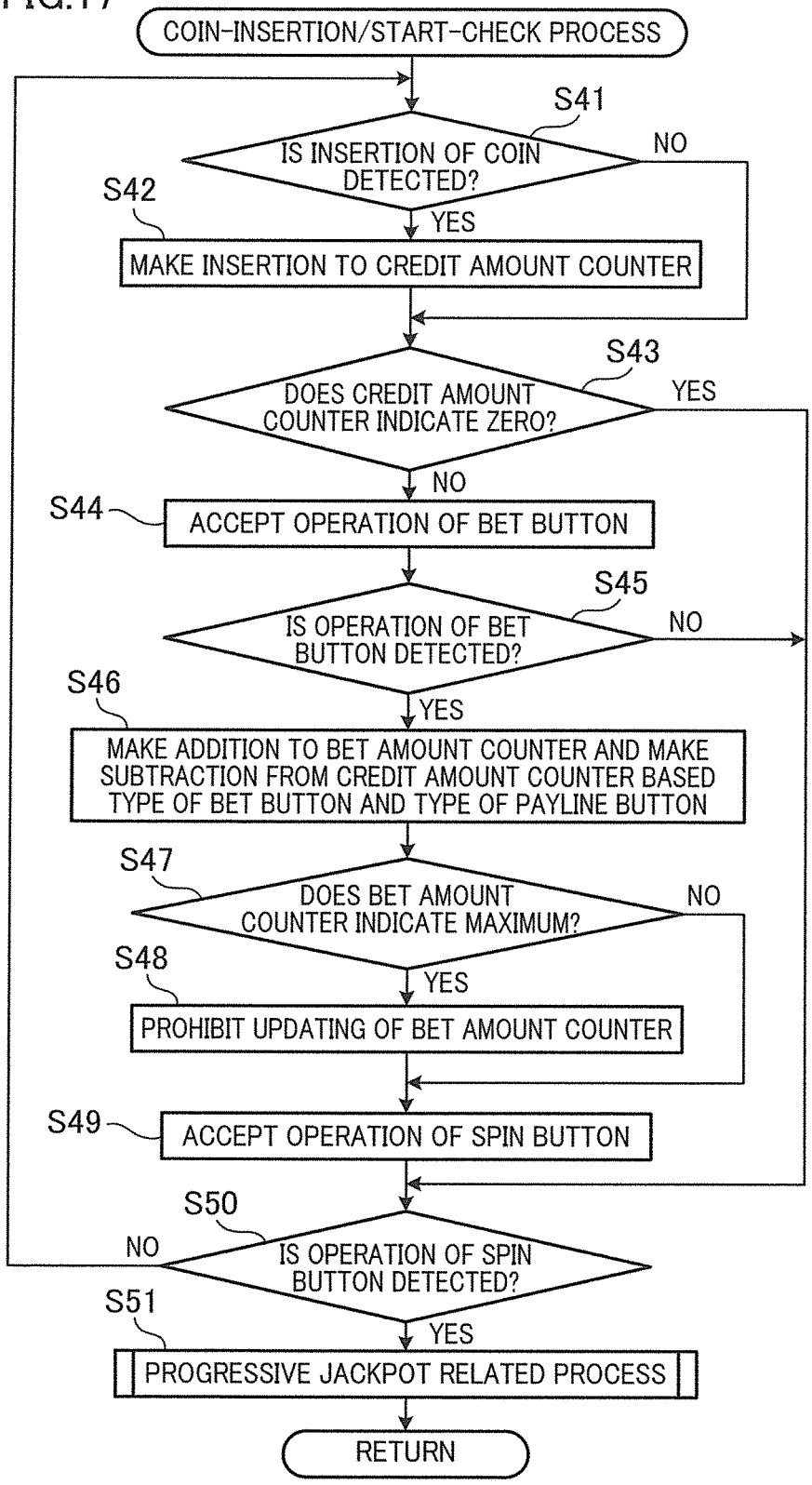
FIG. 17 is a flowchart of a coin-insertion/start-check process of the slot machine of the embodiment of the present invention.

Next, with reference to FIG. 17, the coin-insertion/start-check process is described.

First, the main CPU 71 determines whether or not insertion of a coin has been detected by the coin counter 92C (S41). When determining that the insertion of a coin has been detected, the main CPU 71 makes addition to the value stored in the credit amount storage area (S42). It is to be noted that the main CPU 71 may determine whether or not insertion of a bill has been detected by the bill entry 115, and when determining that the insertion of a bill has been detected, the main CPU 71 may add a value according to the bill to the value stored in the credit amount storage area.

After S42 or when determining in S41 that the insertion of a coin has not been detected, the main CPU 71 determines whether or not the value stored in the credit amount storage area is zero (S43). When the main CPU 71 determines that the value stored in the credit amount storage area is not zero, the main CPU 71 permits operation acceptance of the bet buttons (1-bet button 34, 2-bet button 35, 5-bet button 37, 10-bet button 38, 20-bet button 39, and max bet button 45) (S44). Note that, in S44, an operation of the payline button (play-1-line button 40, play-5-lines button 41, play-10-lines button 42, and play-50-lines button 43) is enabled. Operation of the payline button enables activation of a desirable number of paylines (see FIG. 5).

Next, the main CPU 71 determines whether or not operation of any of the BET buttons has been detected (S45). When the main CPU 71 determines that the bet switch (1-bet switch 34S, 2-bet switch 35S, 5-bet switch 37S, 10-bet switch 38S, 20-bet switch 39S, and max-bet switch 45S) has detected the pressing of the BET button by the player, the main CPU 71 makes addition to a value stored in a bet amount storage area provided in the RAM 73 and makes subtraction from the value stored in the credit amount storage area, based on the type of the bet button and the type of the payline button (S46).

The main CPU 71 then determines whether or not the value stored in the bet amount storage area is at its maximum (S47). The main CPU 71, when determining that the value stored in the bet amount storage area is the maximum value, prohibits updating of the value stored in the bet amount storage area (S48). After S48 or when determining in S47 that the value stored in the bet amount storage area is not at its maximum, the main CPU 71 permits operation acceptance of the spin button 46 (S49).

After S49, when determining in S45 that the operation of any of the BET buttons has not been detected, or when determining in S43 that the value stored in the credit amount storage area is zero, the main CPU 71 determines whether or not operation of the spin button 46 has been detected (S50). The main CPU 71 shifts the process to S41, when determining that no operation of the spin button 46 is detected.

Figure 18:
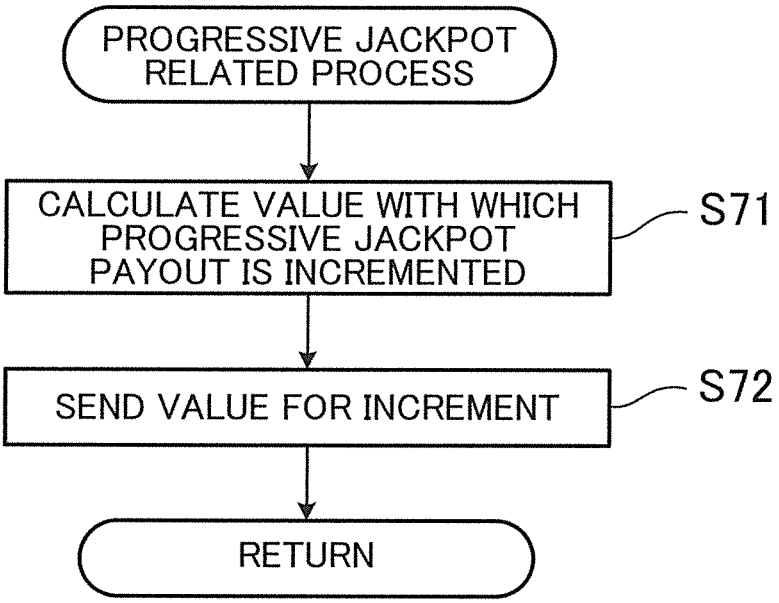
FIG. 18 is a flowchart of a progressive jackpot related process of the slot machine of the embodiment of the present invention.

When it is determined that the operation of the spin button 46 is detected, the main CPU 71 executes the progressive jackpot related process which will be described later with reference to FIG. 18 (step S51). In this process, the progressive jackpot payout is accumulatively incremented with a predetermined rate of the game media bet in the normal game. In the present embodiment, the value with which the progressive jackpot payout is incremented is calculated and sent to the external controller 200. Then the coin-insertion/start-check process is ended.

Jackpot Related Process

Now, a progressive jackpot related process will be described with reference to FIG. 18. To begin with, the main CPU 71 calculates the value with which the progressive jackpot payout is incremented (S71). To be more specific, the main CPU 71 calculates a product of the value of the bet amount counter and the predetermined rate shown in FIG. 12. The calculated value is to be added to the progressive jackpot payout. For example, when the value of the bet amount counter is "10", the value with which the progressive jackpot payout of the "GRAND JACKPOT" is incremented is 10×0.004(0.4%)=0.04, the value with which the progressive jackpot payout of the "MAJOR JACKPOT" is 10×0.004(0.4%)=0.04, the value with which the progressive jackpot payout of the "MINOR JACKPOT" is incremented is 10×0.005(0.5%)=0.05, and the value with which the progressive jackpot payout of the "MINI JACKPOT" is incremented is 10×0.005(0.5%)=0.05, according to FIG. 12.

Subsequently, the main CPU 71 sends the values for increment calculated in S71 to the external controller 200 (S72). Upon receiving the values for increment, the external controller 200 updates the four types of progressive jackpot payout ("GRAND JACKPOT", "MAJOR JACKPOT", "MINOR JACKPOT", and "MINI JACKPOT") stored in the progressive payout storage. After this process, the progressive jackpot related process is terminated.

Feature Game Process

Figure 19:
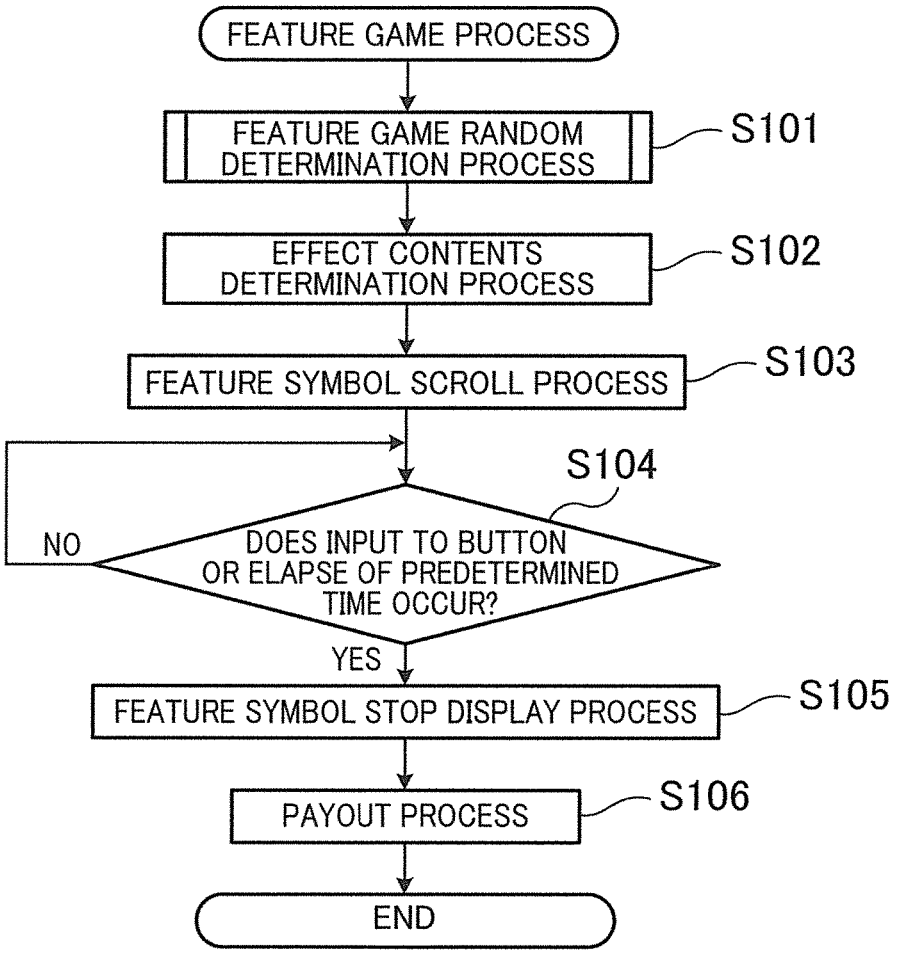
FIG. 19 is a flowchart of a feature game process of the slot machine of the embodiment of the present invention.

Now, referring to FIG. 19, a feature game process will be described. FIG. 19 is a flowchart of a feature game process of the slot machine of the embodiment of the present invention.

To begin with, as the feature game process is executed, the main CPU 71 executes a feature symbol random determination process based on a video reel strip for the feature game shown in FIG. 14 (step S101). In the process, to-be stopped symbol is determined based on the random numbers for feature symbol determination.

Specifically, the main CPU 71 first samples random numbers for feature symbol determination. Subsequently, the main CPU 71 randomly selects a to-be stopped symbol from the video reel strip for the feature game shown in FIG. 14. In this regard, the to-be stopped symbol is selected with equal probabilities from the video reel strip for the feature game shown in FIG. 14. That is to say, one of the "PLUM", "WATERMELON", "ORANGE", "APPLE", "MELON", and "CHERRY" symbols shown in FIG. 14 is selected as the to-be stopped symbol with a probability of "1/6". The main CPU 71 stores the selected to-be stopped symbol of the video reel strip for the feature game in a symbol storage area provided in the RAM 73.

The main CPU 71 then executes the effect contents determination process (S102) in the same manner as in the step S16. Then the main CPU 71 executes a feature symbol scroll process (S103).

Figure 34:
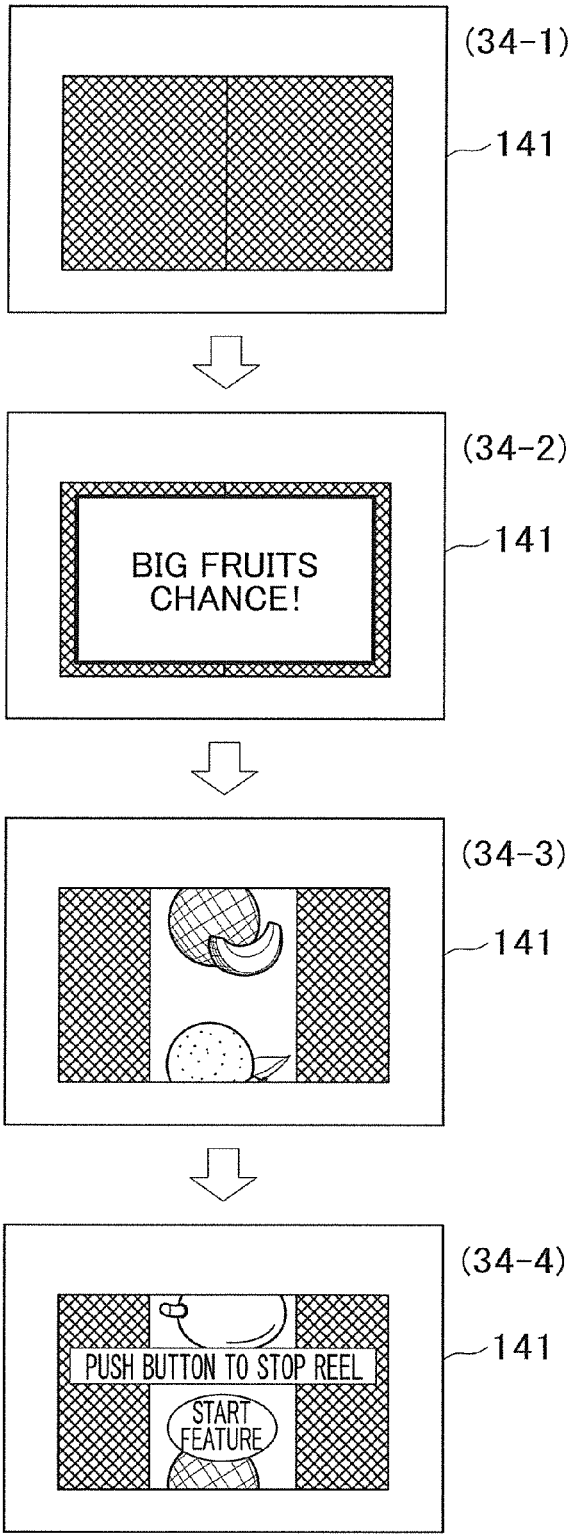
FIG. 34 shows an effect screen of the feature game of the slot machine of the embodiment of the present invention.

In this feature symbol scroll process, to begin with, as shown in (34-1) in FIG. 34, a black curtain is displayed on the lower image display panel 141. Subsequently, as shown in (34-2) in FIG. 34, a message "BIG FRUITS CHANCE!" is displayed on the lower image display panel 141 to notify that the feature game (big fruits chance) will start. Thereafter, as shown in (34-3) in FIG. 34, the video reel strip for the feature game on which the symbols are laid out as shown in FIG. 14 appears on the lower image display panel 141 and is scroll-displayed downward on the screen. Thereafter, as shown in (34-4) in FIG. 34, a message "push the button to stop the reel!" is displayed on the lower image display panel 141.

Subsequently, the main CPU 71 determines whether an input to the button or the elapse of a predetermined time occurs (S104). When neither the input to the button nor the elapse of the predetermined time occurs (S104: NO), the input to the button or the elapse of the predetermined time is waited for.

In the meanwhile, when the input to the button or the elapse of the predetermined time occurs (S104: YES), the main CPU 71 executes a feature symbol stop display process (S105). In this feature symbol stop display process, the to-be stopped symbol determined in the feature symbol random determination process in the step S101 stops at the center of the lower image display panel 141 as shown in (35-1) in FIG. 35. For example, when the to-be stopped symbol is the "MELON" symbol with the code number "5", the "MELON" symbol is displayed at the center of the lower image display panel 141.

Figure 35:
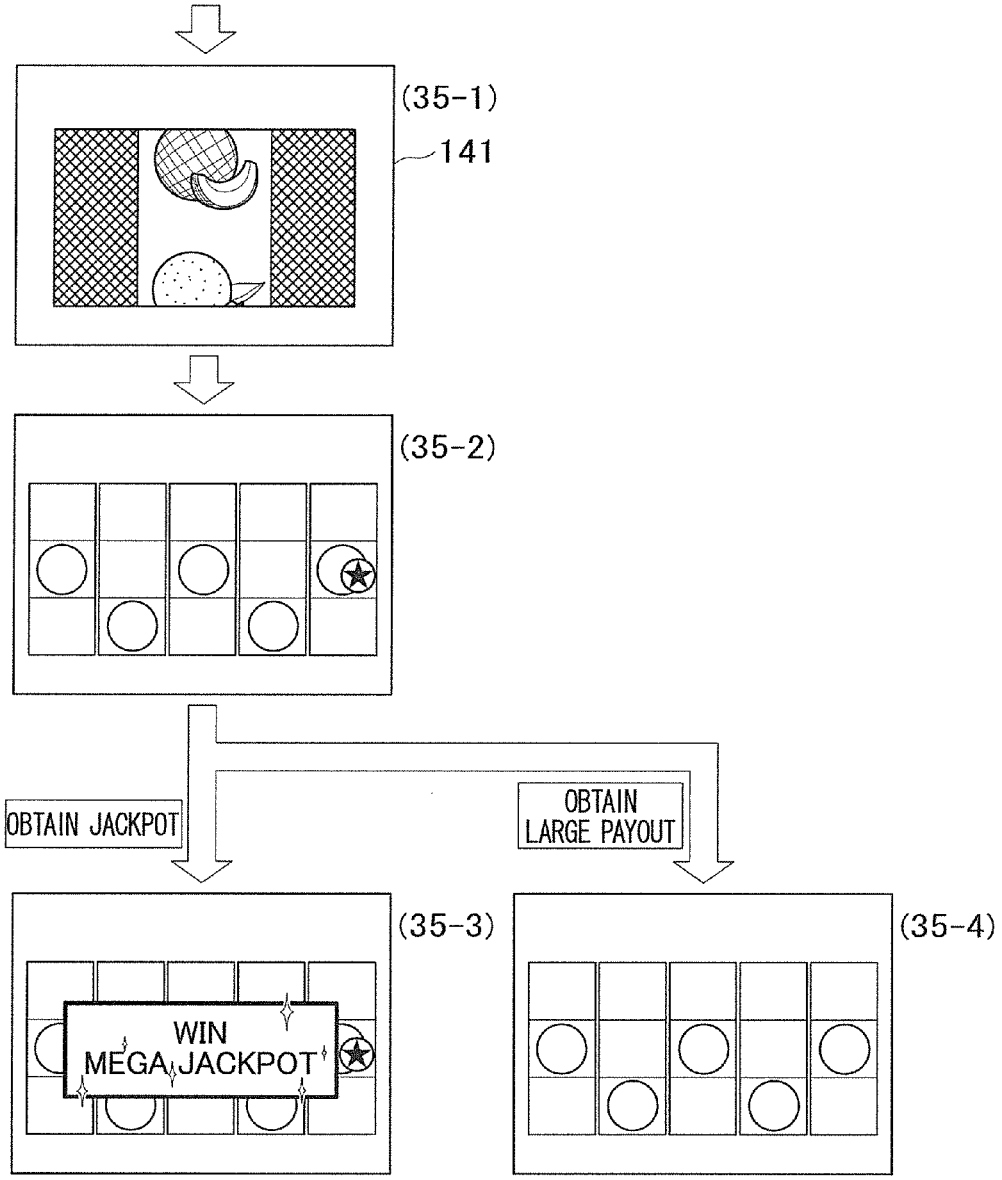
FIG. 35 shows an effect screen of the feature game of the slot machine of the embodiment of the present invention.

Thereafter, as shown in (35-2) in FIG. 35, a combination of the symbols based on the to-be stopped symbol determined in the feature symbol random determination process is displayed on the lower image display panel 141. For example, when the to-be stopped symbol is the "MELON" symbol, five "MELON" symbols are provided on a payline in the symbol display region 4.

Thereafter, when the combination of the symbols on the payline in the symbol display region 4 forms the progressive jackpot trigger, as shown in (35-3) in FIG. 35, a message indicating that the progressive jackpot payout will be awarded is displayed. Furthermore, when the combination of the symbols on the payline in the symbol display region 4 results in the awarding of a payout, as shown in (35-4) in FIG. 35, the combination of the symbols on the payline in the symbol display region 4 is highlighted.

Subsequently, the main CPU 71 executes a payout process (step S106). In this payout process, the main CPU 71 adds, to the value stored in the feature game payout counter, a payout corresponding to the combination of the symbols on a payline shown in (35-2) in FIG. 35 (progressive jackpot payout which is a payout determined with reference to the symbol combination table shown in FIG. 10). The feature game payout counter is an area where the total payout amount awarded during the feature game (big fruits chance) is stored. The feature game process is then terminated. After the feature game process is terminated, the main CPU 71 goes back to the step S21 which has been described with reference to FIG. 16.

Progressive Jackpot Check Process

Now, a progressive jackpot check process will be described with reference to FIG. 20.

To begin with, the main CPU 71 determines whether the progressive jackpot trigger is established (S151). In this process, whether a combination of symbols with which the four types of progressive jackpot payouts ("GRAND JACKPOT", "MAJOR JACKPOT", "MINOR JACKPOT", and "MINI JACKPOT") is established on a payline in the symbol display region 4 as a result of S17 is determined. When no progressive jackpot trigger is established (S151: NO), the main CPU 71 determines a payout amount corresponding to the winning combination, with reference to the symbol combination table shown in FIG. 10 (S152). For example, when the winning combination is three "APPLE" symbols, the payout amount is "20" (see FIG. 10). When lost, the payout amount is "0". Subsequently, the main CPU 71 stores the determined payout amount in the payout counter (S153). After this step, the progressive jackpot check process is terminated.

In the meanwhile, when the progressive jackpot trigger is established (S151: YES), the main CPU 71 notifies the external controller 200 that the progressive jackpot trigger has been established (and the type of the established progressive jackpot payout) (S154). Upon receiving the notification, the external controller 200 sends, to the gaming machine 1, the amount of the progressive jackpot payout corresponding to the type of the established progressive jackpot payout.

Figure 30:
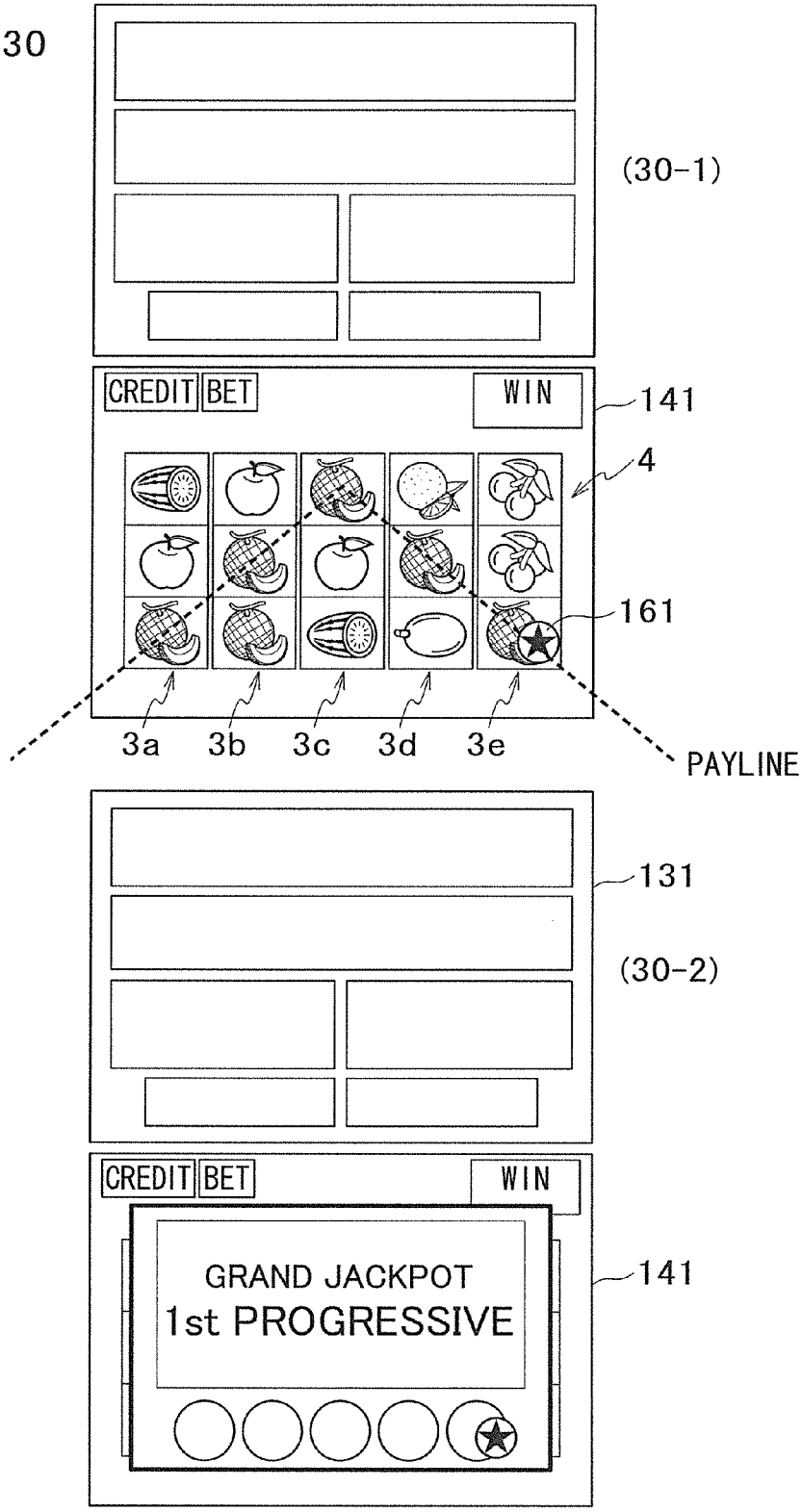
FIG. 30 shows an effect screen of the slot machine of the embodiment of the present invention.

When the progressive jackpot trigger is established, the main CPU 71 displays, on the lower image display panel 141, a message which informs that the progressive jackpot trigger is established. For example, when, as shown in (30-1) in FIG. 30, five "MELON" symbols are provided on a payline and the coin 161 symbol is provided on the "MELON" symbol which is on the payline and on the video reel 3*e* (Reel 5), the progressive jackpot trigger is established and a message notifying the winning of the "GRAND JACKPOT" is displayed (see 30-2 in FIG. 30).

Subsequently, the main CPU 71 receives the amount of the established progressive jackpot payout from the external controller 200 (S155). The main CPU 71 then stores the received progressive jackpot payout amount in the payout counter (S156).

Figure 31:
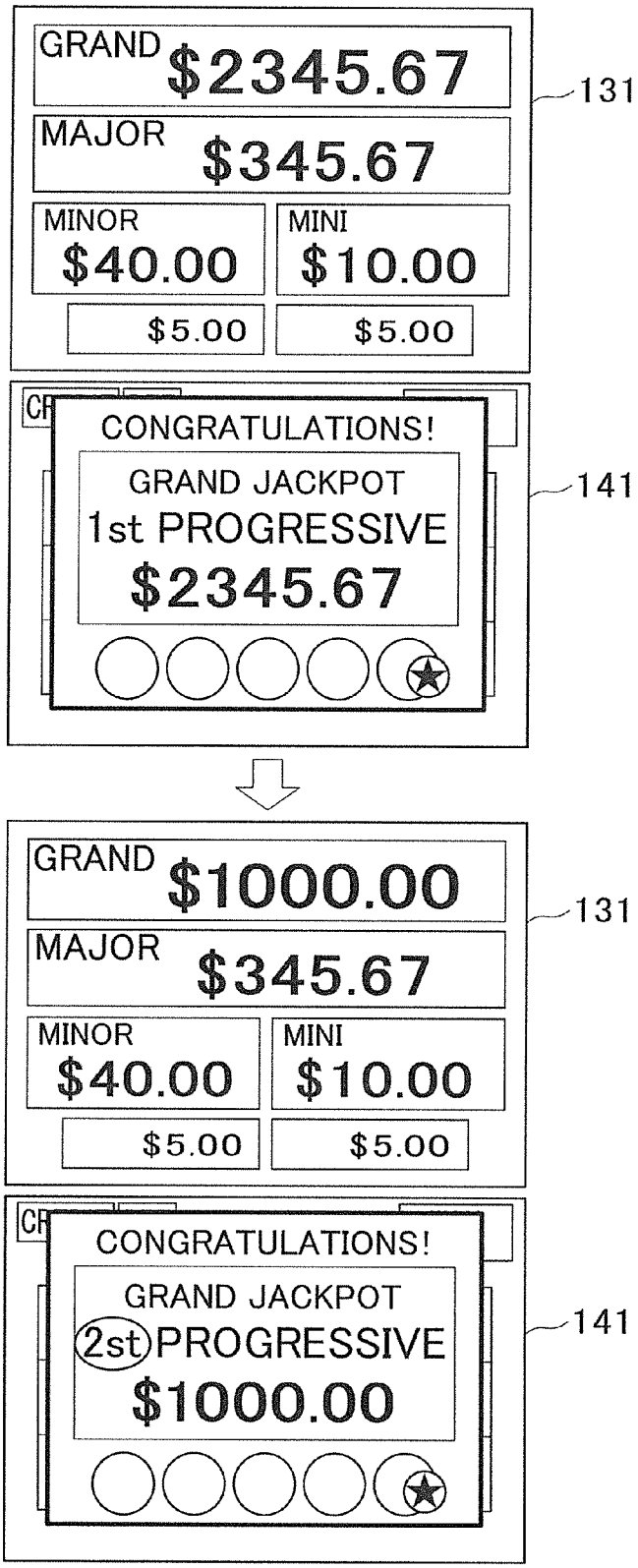
FIG. 31 shows an effect screen of the slot machine of the embodiment of the present invention.
Figure 32:
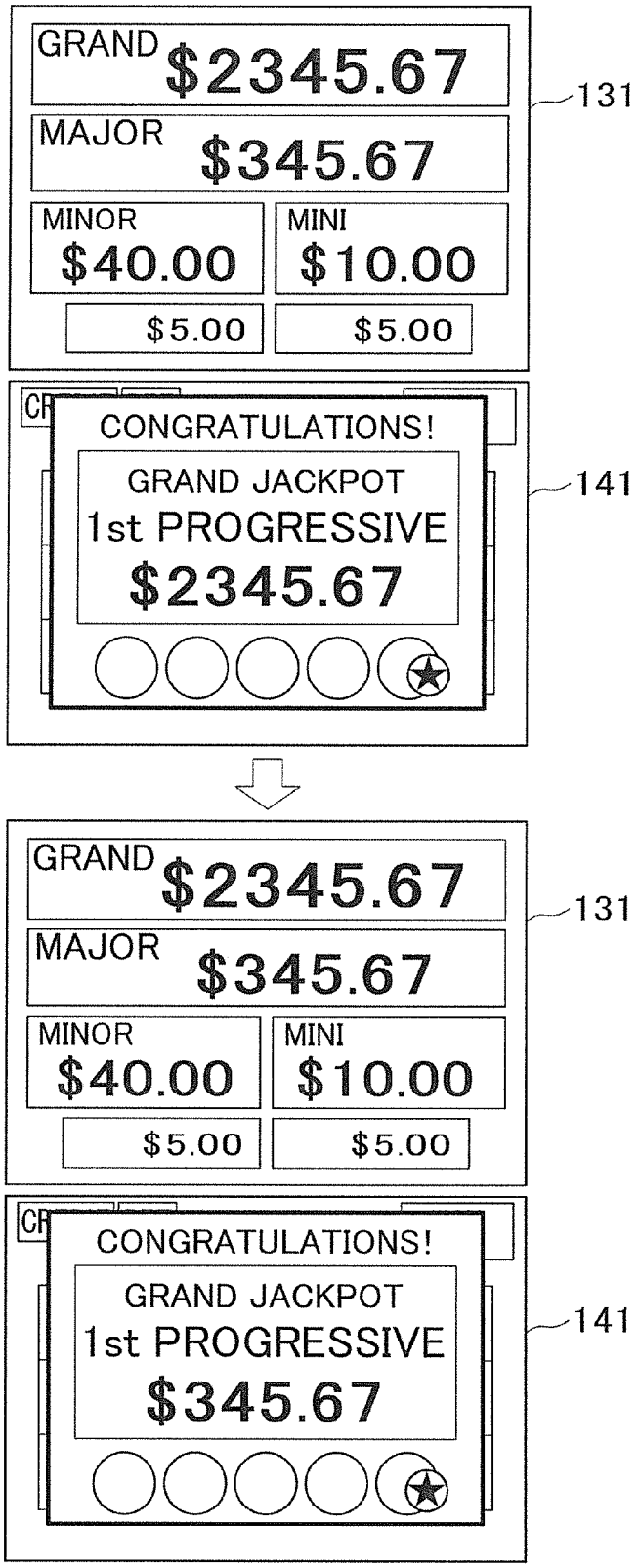
FIG. 32 shows an effect screen of the slot machine of the embodiment of the present invention.

Subsequently, the main CPU 71 executes a progressive jackpot winning effect process (S157). In this process, as shown in FIG. 31 and FIG. 32, a message informing that winning has been achieved in the jackpot payout is displayed on the upper image display panel 131 and the lower image display panel 141 and an amount of the progressive jackpot payout to be awarded is displayed on a signboard. After this process, the progressive jackpot check process is terminated.

The signboard on which the amount of the progressive jackpot payout or the like is displayed will be detailed. Because there is a possibility that plural jackpots may be obtained in single execution of the game, plural signboards are required. When winning plural jackpots of the same type, for example, as shown in FIG. 31, a congratulations message, a progressive amount (amount of the progressive jackpot payout), the type of the jackpot "GRAND JACKPOT", and the number of times of the progressive "1st PROGRESSIVE" are displayed on the signboard. Then the win meter is incremented with the progressive amount. Thereafter, in the second and subsequent progressives of the same type, a default amount having been set is obtained. The default amount is displayed on the signboard, and the win meter is incremented with the progressive amount. In the second and subsequent jackpots, the number of times of the progressive is "2nd", "3rd", and so on.

In the meanwhile, when winning plural jackpots of different types, for example, as shown in FIG. 32, a congratulations message and a progressive amount are displayed on a signboard. The win meter is incremented with the progressive amount. It is noted that, even if winning is achieved on a win line with a smaller number, progressive with a higher rank is displayed first. For example, after the progressive amount, the type of the jackpot "GRAND JACKPOT", and the number of times of the progressive "1st PROGRESSIVE" are displayed on the signboard, the progressive amount, the type of the jackpot "MAJOR JACKPOT", and the number of times of the progressive "1st PROGRESSIVE" are displayed on the signboard.

Image Display

Now, image display by the slot machine 1 will be described with reference to FIG. 21.

<Image Display in Normal State>

To begin with, image display in the normal game will be described with reference to FIG. 21. FIG. 21 shows the image display in the normal game in the slot machine of the embodiment of the present invention.

Figure 21:
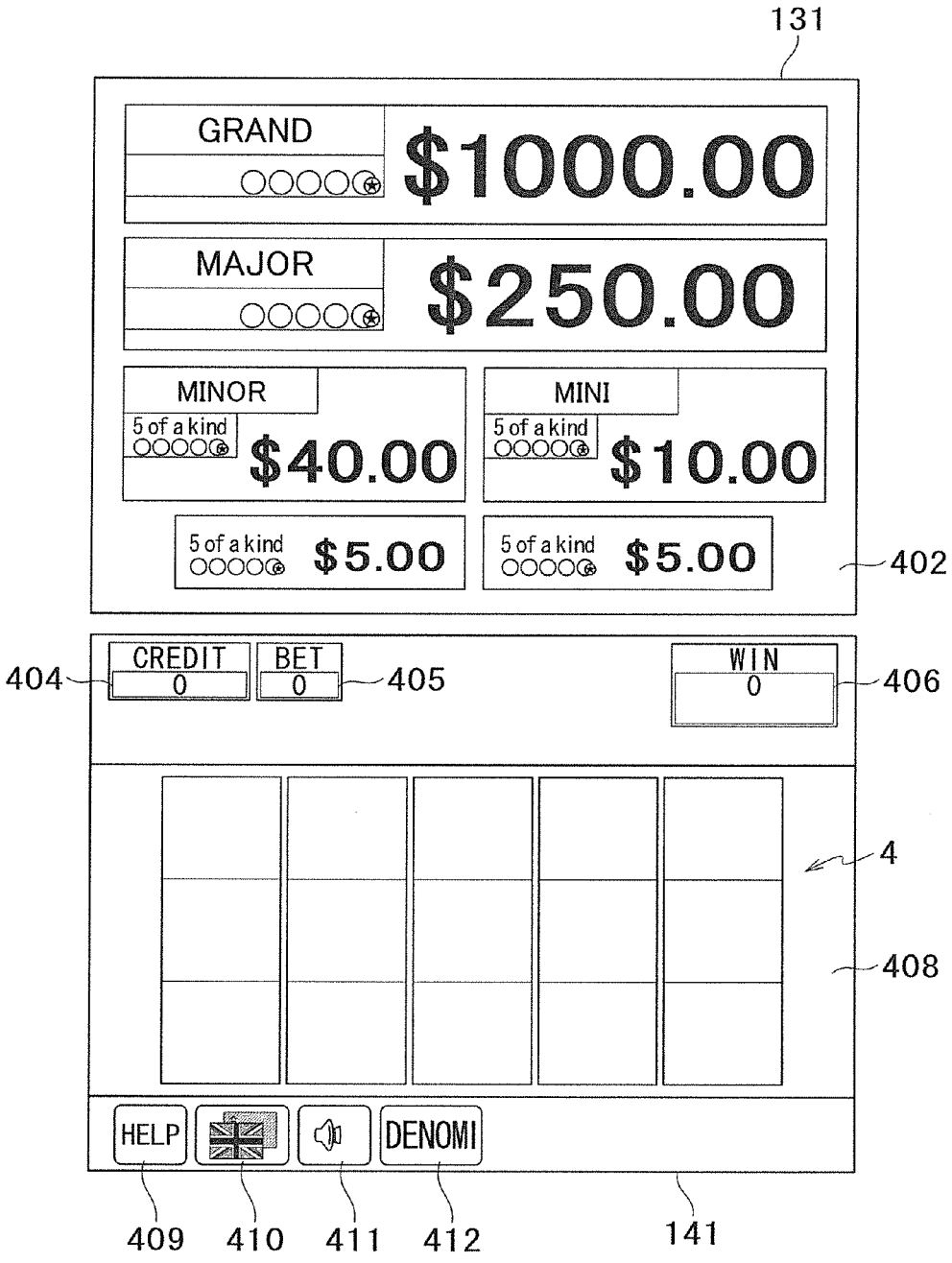
FIG. 21 shows image display in the slot machine of the embodiment of the present invention.

As shown in FIG. 21, the upper image display panel 131 in the normal game is provided with an image area 402 where information regarding games or the like is displayed. In the image area 402, the amount which is updated with each progressive jackpot payout is displayed. Furthermore, in the image area 402 briefly is displayed rules of the game. In this way, the content of the image display changes during the normal game and the feature game.

On the lower image display panel 141 in the normal game, in addition to the above-described symbol display region 4, a credit meter 404, a bet meter 405, a win meter 406, a bet information and game state display region 407, a payline number display region 408, a help touch button 409, a language switching touch button 410, a sound volume switching touch button 411, and a denomination display region 412. In the credit meter 404 is displayed a remaining credit amount. The default value is 0. In other words, a credit amount stored in the RAM 73 is displayed. The bet meter 405 displays the total bet amount of the current game (or the final game). The win meter 406 displays the total credit amount of WIN and the detail of the WIN. The win credit amount displayed in the win meter 406 is always an actual obtained credit amount after the multiplication by the bet per line.

In the bet information and game state display region 407 is displayed bet information of the current game (or the final game). In the first line is displayed an amount of bet per line. The image display is in the singular form or plural form in accordance with the bet amount. For example, when the amount of bet per line is "1", the region displays "1 CREDIT PER LINE" and "CREDIT" is displayed in the singular form. When the amount of bet per line is "2", the region displays "2 CREDITS PER LINE" and "CREDITS" is displayed in the plural form. The plural form "CREDITS" is displayed when the amount of bet per line is "3" or more, too. The bet information and game state display region 407 further displays the current game state. The region is not displayed when the current game state is game in progress. When the current game state is game over, "GAME OVER" is displayed. When the current game state is waiting for GAMBLE, "PLAY ON, GAMBLE or TAKE WIN" is displayed.

In the line number display region 408 are displayed payline number of 20 paylines (see FIG. 5). When the player touches the help touch button 409, the first page of the help screen is displayed on the lower image display panel 141. The help touch button 409 is darkened when it is invalidated, e.g., during the rotation of the video reels 3.

As the language switching touch button 410 is touched by the player, the language is switched to English or Chinese. The language switching touch button 410 is activated only during the advertisement, and is darkened when it is invalidated, e.g., during the rotation of the video reels 3. Furthermore, on the language switching touch button 410, the displayed national flags are changed to "U.K./Chine" or "U.S.A./China" in accordance with the setting of the AUDIT. When the language switching is set at "DISABLE", the language switching touch button 410 is changed to a paytable button with which a payout table is displayed on the help screen.

The sound volume switching touch button 411 is used for switching the game sound volume at three stages. Each time the button is touched by the player, the game sound volume is switched such that, for example, from low to high to small to middle. The denomination display region 412 displays current denomination.

<Help Screen>

Figure 22:
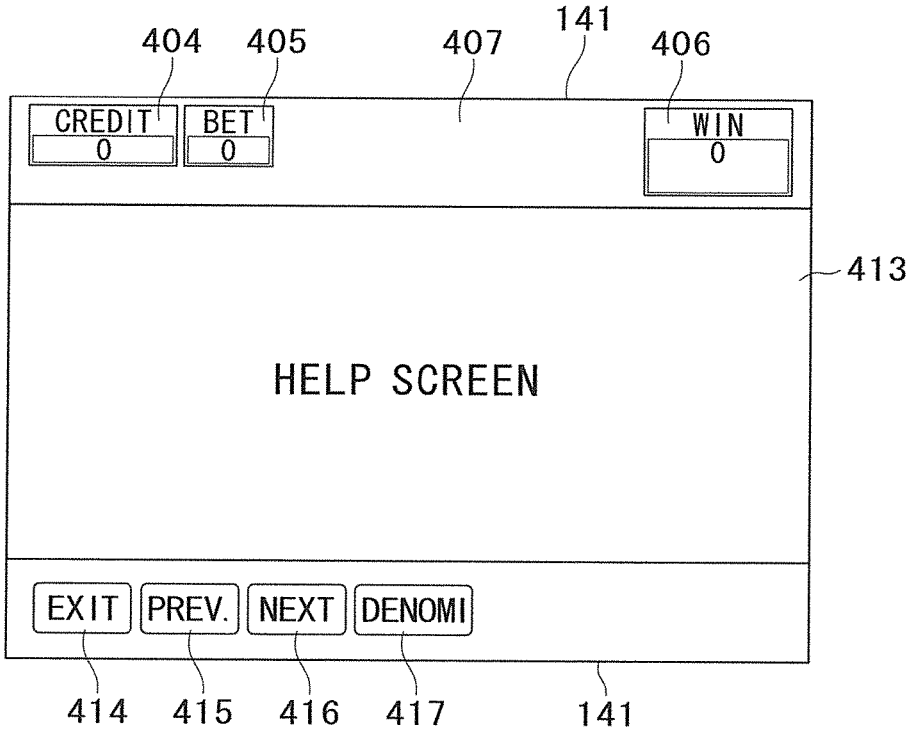
FIG. 22 shows a help screen in the slot machine of the embodiment of the present invention.

Now, image display in the normal state will be described with reference to FIG. 22. FIG. 22 shows a help screen on the slot machine of the embodiment of the present invention in a normal state.

As the lower image display panel 141 shown in FIG. 22 indicates, on the help screen display in the normal state, the credit meter 404, the bet meter 405, the win meter 406, the bet information and game state display region 407, and the denomination display region 412 described above are displayed. Furthermore, on the lower image display panel 141, a help screen 413 is provided, and an EXIT touch button 414, a PREV. touch button 415, and a NEXT touch button 416 are further provided.

Figure 42:
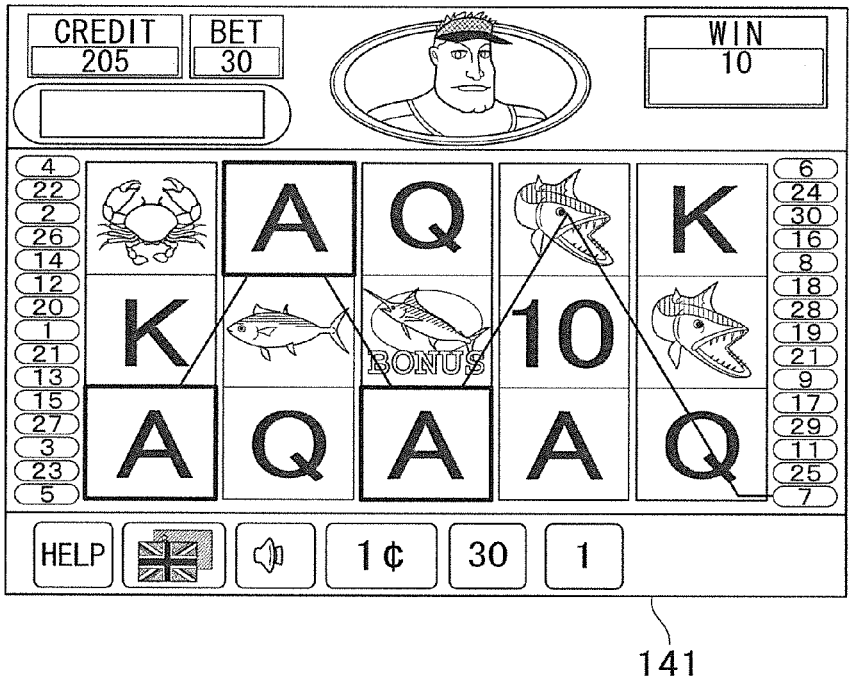
FIG. 42 illustrates GAMBLE in the slot machine of the embodiment of the present invention.

When the player touches the EXIT touch button 414, the help screen 413 disappears from the lower image display panel 141 and a normal game screen (see FIG. 42) comes back. When the player touches the PREV. touch button 415, the directly preceding page is displayed on the help screen 413. When the player touches the NEXT touch button 416, the next page is displayed on the help screen 413.

Win Effect

Now, a win effect in the slot machine 1 will be described with reference to FIG. 23 to FIG. 27.

The win effect is an effect executed when a winning is achieved in the normal game or the feature game. That is to say, this effect is executed when a combination of symbols displayed on an activated payline is identical with a combination of symbols defined in the symbol combination table shown in FIG. 10 and FIG. 11 and when a progressive jackpot payout is awarded.

<Flow of Win Effect>

Now, the flow of the win effect will be described with reference to FIG. 23 to FIG. 27. FIGS. 23 to 27 show the flow of a win effect of the slot machine of the embodiment of the present invention.

Figure 23:
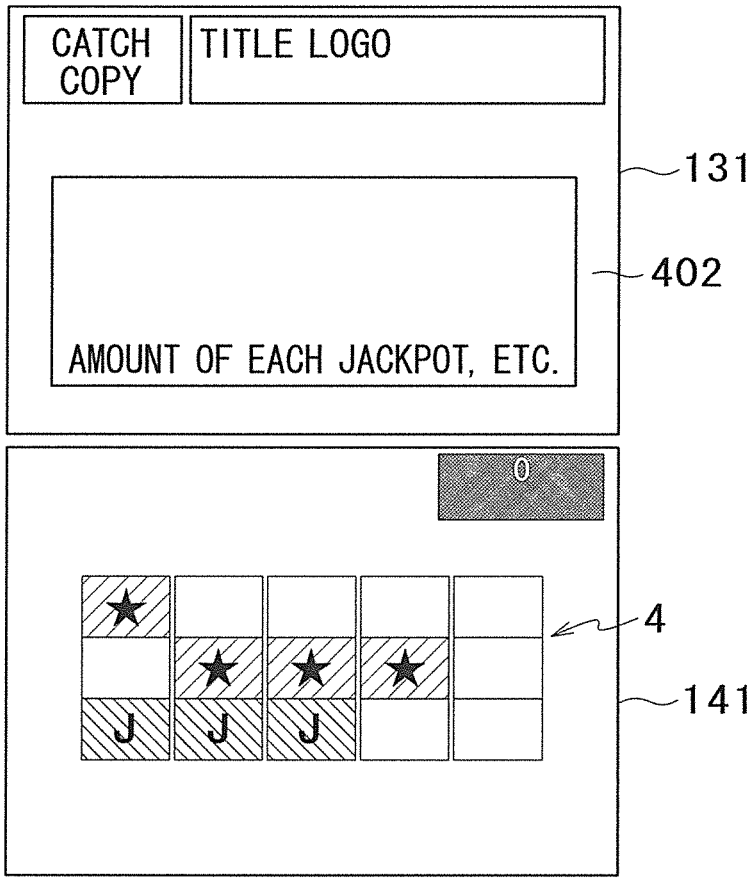
FIG. 23 shows the flow of a win effect of the slot machine of the embodiment of the present invention.
Figure 24:
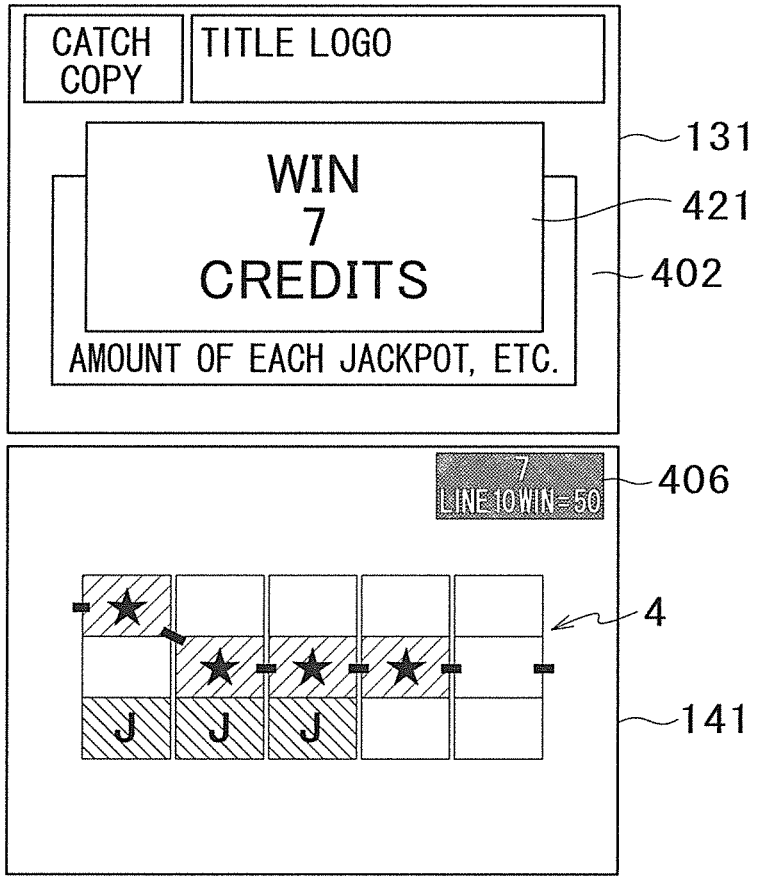
FIG. 24 shows the flow of a win effect of the slot machine of the embodiment of the present invention.
Figure 25:
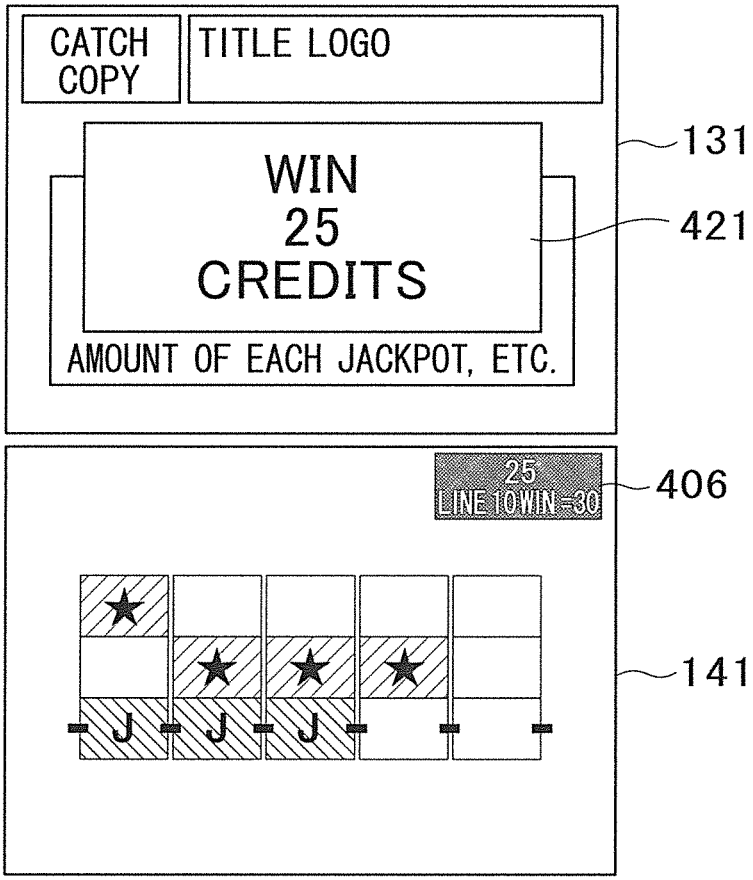
FIG. 25 shows the flow of a win effect of the slot machine of the embodiment of the present invention.

To begin with, as shown in FIG. 23, all reels in the symbol display region 4 on the lower image display panel 141 stop. When all reels stop, as shown in FIG. 24, a win signboard 421 is displayed in the image area 402 of the upper image display panel 131. In the win signboard 421, an obtained credit is displayed in an increment manner. The increment display of the obtained credit on the win signboard 421 is linked to the image display on the win meter 406 of the lower image display panel 141.

On the lower image display panel 141, the win effect is performed for the achieved win. The win effect is performed in an ascending order of payline numbers. In this regard, for symbols for each of which a win animation is prepared, an animation effect is carried out regardless of the payline number. In the meanwhile, each symbol for which no win animation is prepared (i.e., symbols with a blinking win effect) blinks only when a win is achieved by a combination of symbols including that symbol.

On the win meter 406 of the lower image display panel 141, the total win at the start of the increment in the upper stage is displayed. In the lower stage which displays the details, the payout of the win line currently turned on (LINE 10 WIN=30 in FIG. 24) is displayed. The total win is not displayed.

Subsequently, as shown in FIG. 24, on the win signboard 421 displayed on the image area 402 of the upper image display panel 131, the increment display of the obtained credit is continued. On the lower image display panel 141, the display of the win line proceeds to next. In this case, the display of the win line proceeds from the star symbols to the "J" symbols. Because win animations are prepared for both the star symbols and the "J" symbols, animation effects are performed irrespective of the line numbers.

On the win meter 406 of the lower image display panel 141, the increment display of the total win is continued in the upper stage. In the lower stage which displays the details, the payout of the win line currently turned on (LINE 10 WIN=30 in FIG. 25) is displayed. The total win is not displayed.

Subsequently, as shown in FIG. 24, the win signboard 421 is displayed in the image area 402 of the upper image display panel 131. On the win signboard 421, the increment display of the obtained credit is continued. The increment display of the obtained credit on the win signboard 421 is linked to the image display on the win meter 406 of the lower image display panel 141.

Figure 26:
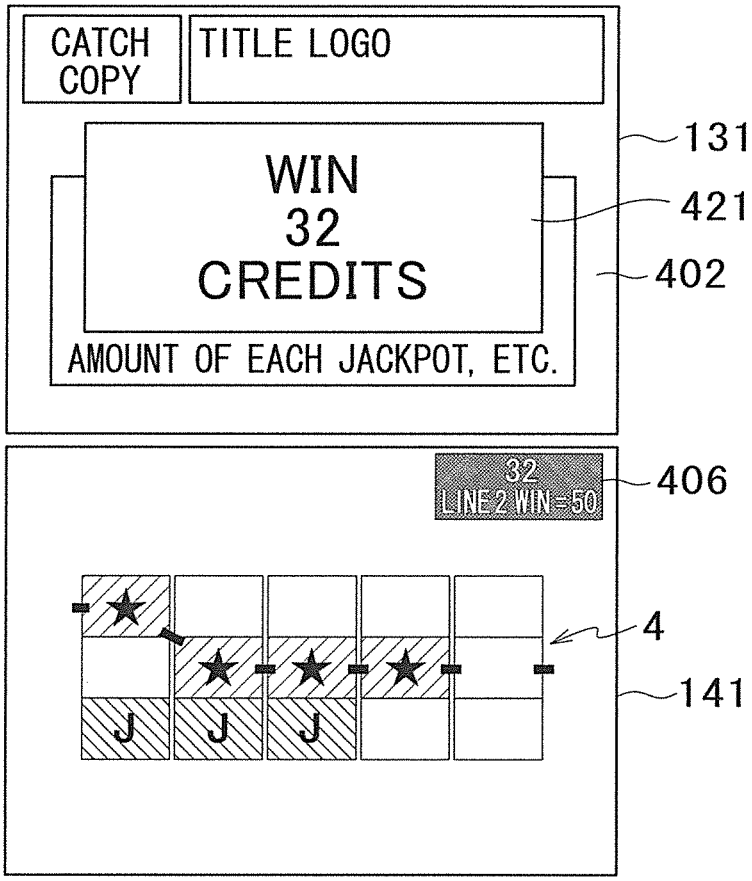
FIG. 26 shows the flow of a win effect of the slot machine of the embodiment of the present invention.

Subsequently, as shown in FIG. 26, the total win is displayed on the win signboard 421 displayed in the image area 402 of the upper image display panel 131. The increment display of the obtained credit is terminated. On the lower image display panel 141, as all of the winning symbols are displayed for once, the symbols are again displayed in a looped manner in an ascending order of payline numbers.

On the win meter 406 of the lower image display panel 141, the increment display of the total win is terminated in the upper stage. The total win is displayed also in the upper stage. In the lower stage displaying details, as all of the winning symbols are displayed for once, the symbols are again displayed in a looped manner in an ascending order of line numbers.

Figure 27:
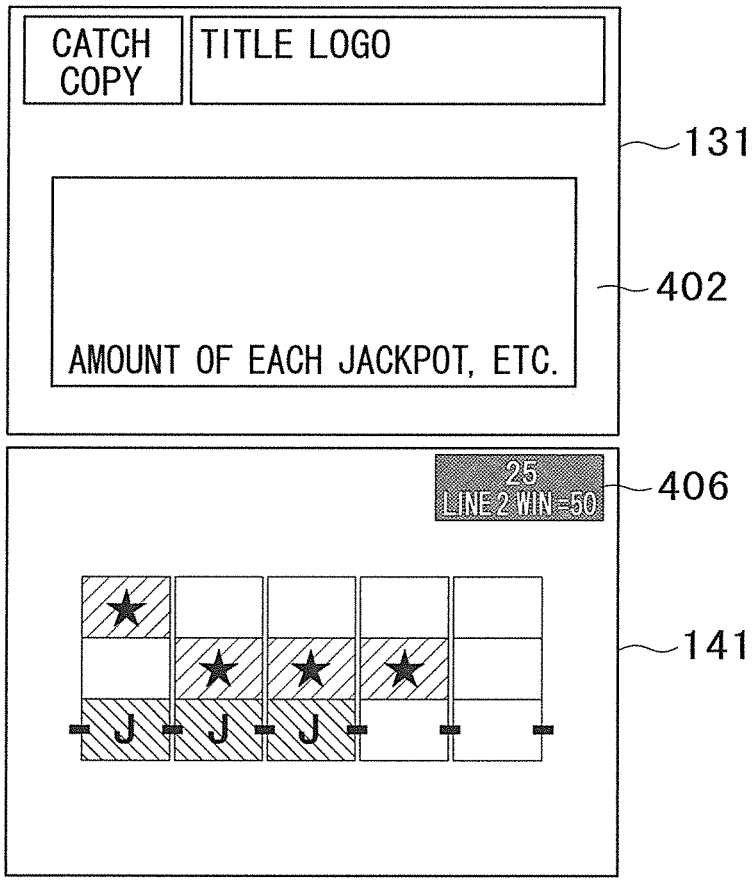
FIG. 27 shows the flow of a win effect of the slot machine of the embodiment of the present invention.

As shown in FIG. 27, from the image area 402 of the upper image display panel 131, the win signboard 421 disappears. On the lower image display panel 141, the looped display is continued in an ascending order of payline numbers. On the win meter 406 of the lower image display panel 141, the display of the total win is continued. In the lower stage displaying details, the looped display is continued in an ascending order of line numbers. In FIG. 27, LINE 2 WIN=50 is displayed again.

<Win Signboard>

Figure 28:
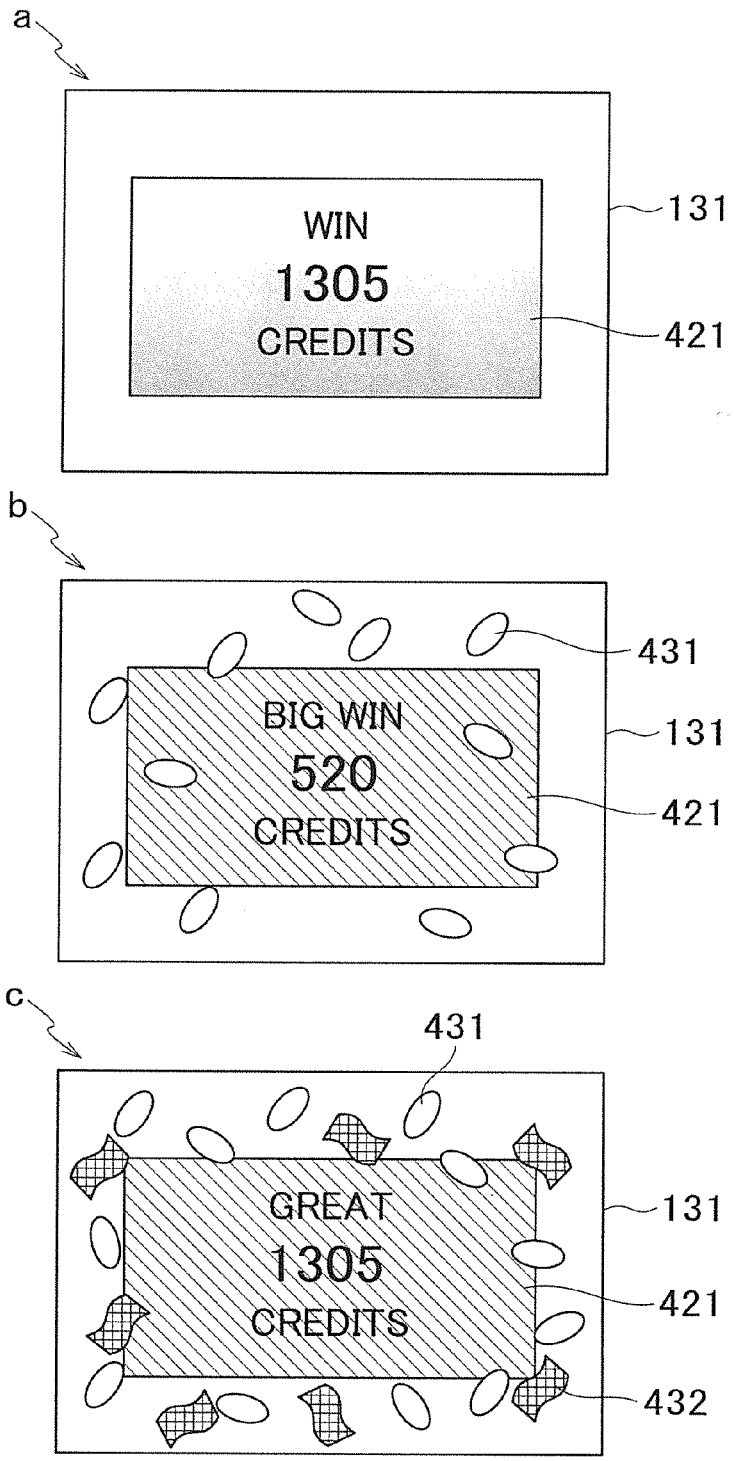
FIG. 28 shows a win signboard of the slot machine of the embodiment of the present invention.

Now, the win signboard will be described with reference to FIG. 28. FIG. 28 shows a win signboard of the slot machine of the embodiment of the present invention.

The total win amount as a result of the current spinning is displayed on a silver signboard 421 shown in A in FIG. 28 on the upper image display panel 131, when the total win is less than 15 times as much as the bet amount.

The total win as a result of the current spinning is displayed on a first gold signboard 421 shown in B in FIG. 28 on the upper image display panel 131, when the total win is equal to or more than 15 times as much as the bet amount and less than 50 times as much as the bet amount. On the first gold signboard 421, an effect of falling coins 431 is performed.

On the other hand, when the increment amount becomes more than 50 times as much as the bet amount, the first gold signboard 421 shown in B in FIG. 28 is changed to a second gold signboard 421 shown in C in FIG. 28, on the upper image display panel 131. On the second gold signboard 421 and effect of falling coins 431 and bills 432 is performed. In other words, on the upper image display panel 131, the effect of falling coins 431 is performed first by the first gold signboard 421. Subsequently, in sync with the increment display on the win meter 406, the obtained credit is incremented with the first gold signboard 421. When the increment amount becomes more than 50 times as much as the bet amount, the first gold signboard 421 shown in FIG. 28B is replaced with the second gold signboard 421 shown in FIG. 28C. On the second gold signboard 421 and effect of falling coins 431 and bills 432 is performed.

Button Prereading

Now, button prereading in the slot machine 1 will be described with reference to FIG. 36. FIG. 36 shows button prereading in the slot machine of the embodiment of the present invention. The button prereading is a function in the normal game to receive an input to a spin/max bet button for the next game even immediately before the end of the rotation of the reels, in order to smoothly start the next game.

Figure 36A:
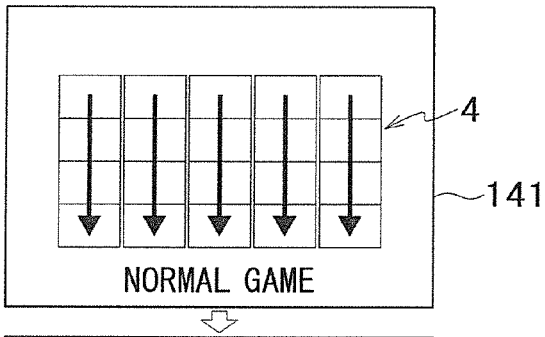
FIG. 36A shows button prereading in the slot machine of the embodiment of the present invention.
Figure 36B:
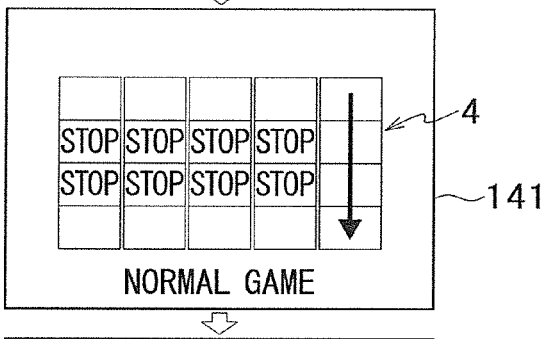
FIG. 36B shows button prereading in the slot machine of the embodiment of the present invention.
Figure 36C:
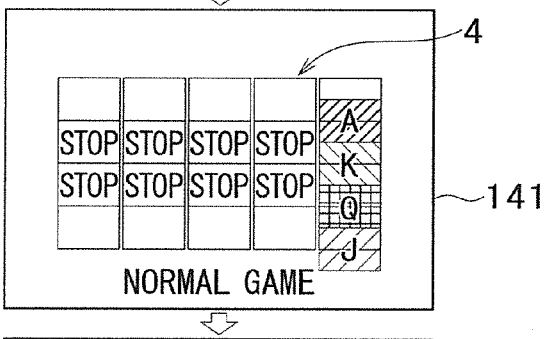
FIG. 36C shows button prereading in the slot machine of the embodiment of the present invention.
Figure 36D:
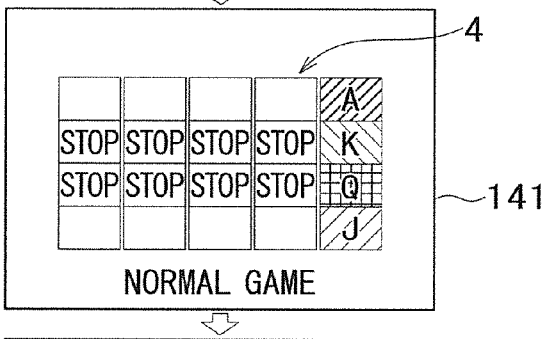
FIG. 36D shows button prereading in the slot machine of the embodiment of the present invention.
Figure 36E:
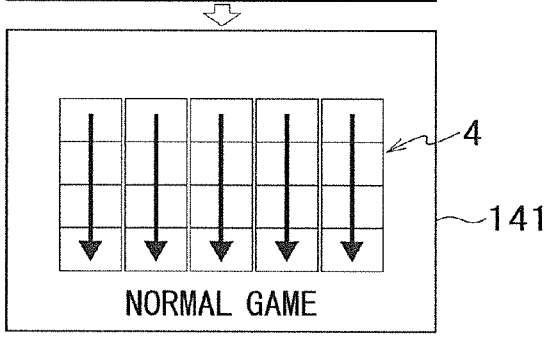
FIG. 36E shows button prereading in the slot machine of the embodiment of the present invention.

In the button prereading function, the symbol display region 4 of the lower image display panel 141 changes as shown in FIGS. 36A to 36E. To begin with, the first to fourth reels of the rotating reels as indicated by the symbol display region 4 of the lower image display panel 141 in FIG. 36A stop as indicated by the symbol display region 4 of the lower image display panel 141 shown in FIG. 36B. Subsequently, as indicated by the symbol display region 4 of the lower image display panel 141 shown in FIG. 36C, the player presses the spin button or the max bet button after the fifth reel completely sinks and before the bounding ends. In this case, when the fifth reel stops in the symbol display region 4 of the lower image display panel 141 as shown in FIG. 36D, the spinning immediately starts in the symbol display region 4 of the lower image display panel 141 as shown in FIG. 36E. In the normal game, the button prereading is active only in the game in which no win (WIN) is achieved. The prereading is activated or disabled by setting the AUDIT.

Win Meter Information Display

Figure 37:
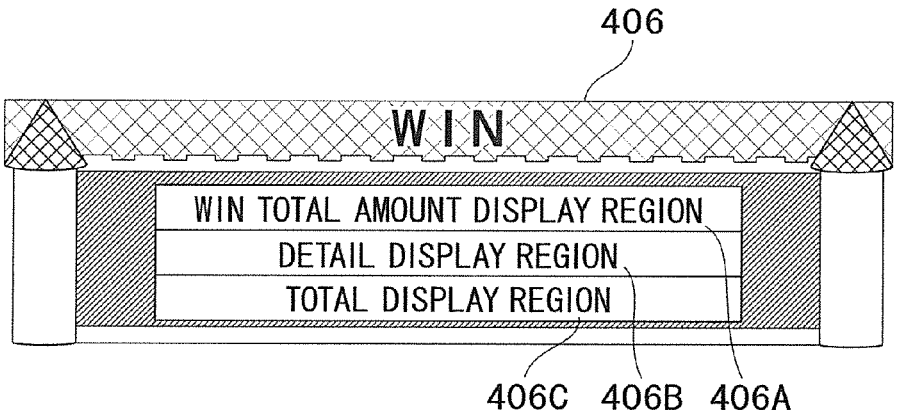
FIG. 37 illustrates win meter information display of the slot machine of the embodiment of the present invention.

Now, win meter information display of the slot machine 1 will be described with reference to FIG. 37. FIG. 37 illustrates win meter information display of the slot machine of the embodiment of the present invention.

As shown in FIG. 37, a win meter 406 is provided with a win total amount display region 406A, a detail display region 406B, and a total display region 406C.

The win total amount display region 406 displays a win credit and a money amount. Increment display is performed based on a win increment speed sheet, when performed. More specifically, the win total amount display region 406A displays a credit amount obtained in the current game cycle (or in the previous game cycle). When a credit is obtained more than once in one game cycle, the credit is added each time it is obtained. For example, when the free game is triggered in the normal game and the player obtains LINE WIN 20 and SCATTER WIN 100, the image display is incremented from "0" to "120". Thereafter, when a payout amount of 200 is obtained by the player in the free game, the increment display is conducted from 120 to 320. 0 is displayed either when the next game cycle starts or when lost in GAMBLE. In the meanwhile, when a win is achieved in GAMBLE, no increment is carried out and the displayed amount is immediately doubled.

The detail display region 406 relates to a win in the normal game and the free game. After the fifth reel stops, the number of the win line and the win credit are displayed. When more than one line payout simultaneously occurs, the line payouts are displayed one by one at intervals of 0.5 second. The payouts are serially displayed from the one having the smallest payline number, and the one having the smallest number is displayed again after the one having the largest payline number is displayed. In other words, the detail display region 406 displays the details of the credit obtained by the spinning in this time. When there are plural elements (e.g., another line or scatter), the elements are switched at intervals of 0.5 second. The order of switching of image display is from scatter payout to normal payout (from the smallest payline number to the largest payline number).

The total display region 406C displays the total credits of the detail display region 406 when the increment in the win total amount display region 406A is completed. The region is not displayed until the increment in the win total amount display region 406A is completed. In other words, the total display region 406C displays the total credits obtained in the spinning in this time. In this regard, the total credits are displayed after the increment in the win total amount display region 406A is finished.

Gamble

Now, the GAMBLE in the slot machine 1 will be described with reference to FIG. 38 to FIG. 44. Each of FIG. 38 to FIG. 44 illustrates GAMBLE in the slot machine of the embodiment of the present invention.

Figure 38:
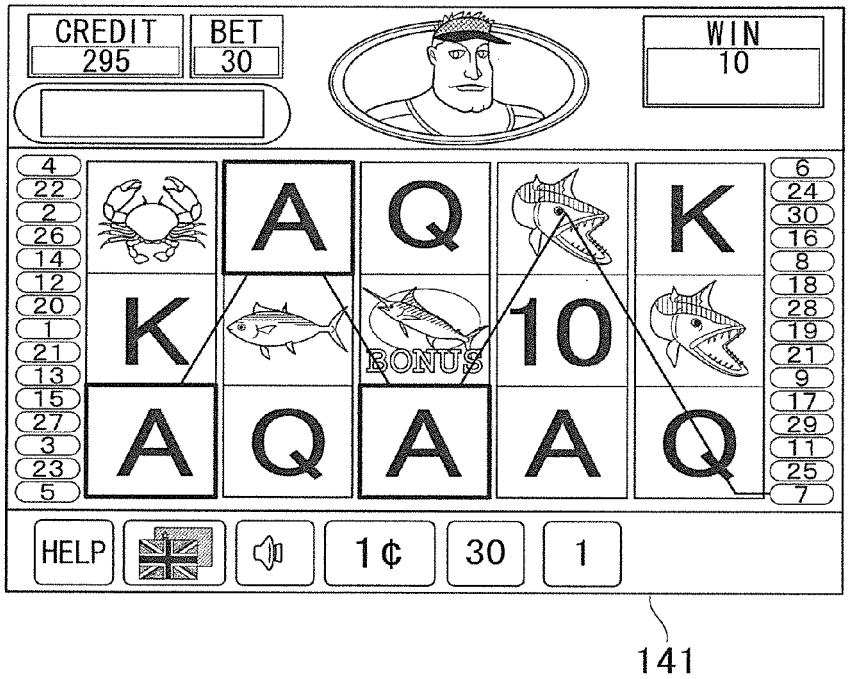
FIG. 38 illustrates GAMBLE in the slot machine of the embodiment of the present invention.
Figure 39:
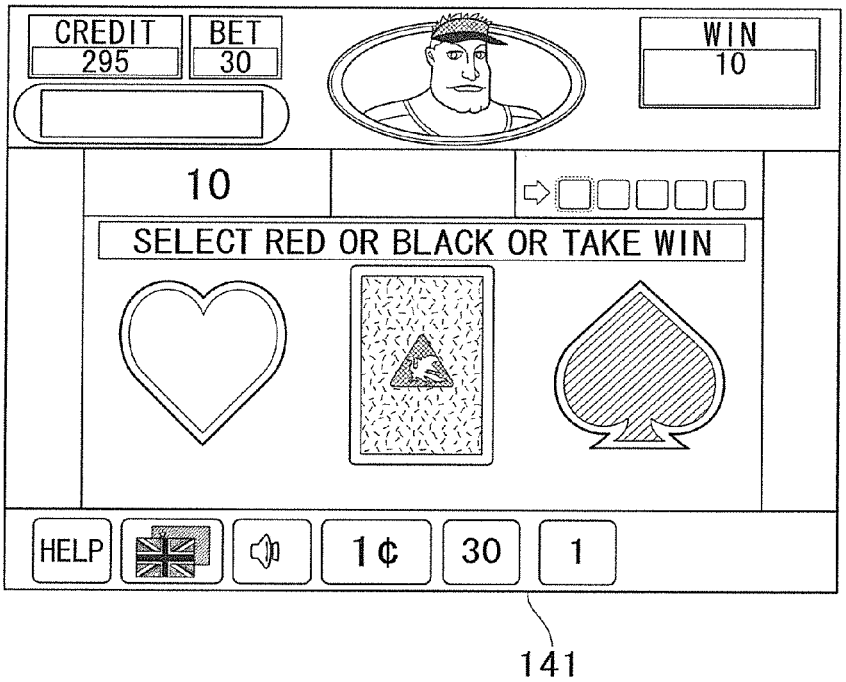
FIG. 39 illustrates GAMBLE in the slot machine of the embodiment of the present invention.

To begin with, when a win (WIN) is achieved, the lower image display panel 141 shown in FIG. 38 is changed to the lower image display panel 141 shown in FIG. 39. In other words, a GAMBLE screen is displayed whereas the message "PLAY ON, GAMBLE or TAKE WIN" is deleted from the lower image display panel 141. In the meanwhile, a message "SELECT RED OR BLACK OR TAKE WIN" is displayed on the lower image display panel 141.

Figure 40:
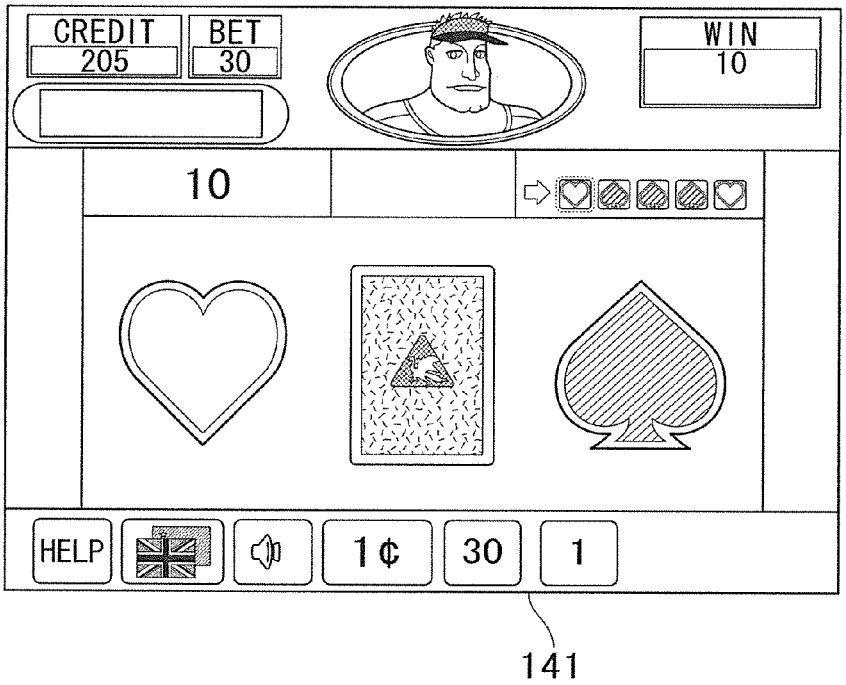
FIG. 40 illustrates GAMBLE in the slot machine of the embodiment of the present invention.

Subsequently, on the lower image display panel 141 shown in FIG. 40, a betted amount is displayed on the lower image display panel 141 as "GAMBLE AMOUNT". The player selects "RED" or "BLACK". When the player succeeds in the selection, the lower image display panel 141 is changed to the later-described lower image display panel 141 shown in FIG. 43. In the meanwhile, when the player fails in the selection, the lower image display panel 141 is changed to the lower image display panel 141 shown in FIG. 41. When the player selects "TAKE WIN", the amount of win is immediately added to the credits on the lower image display panel 141 and the idle state returns.

Figure 41:
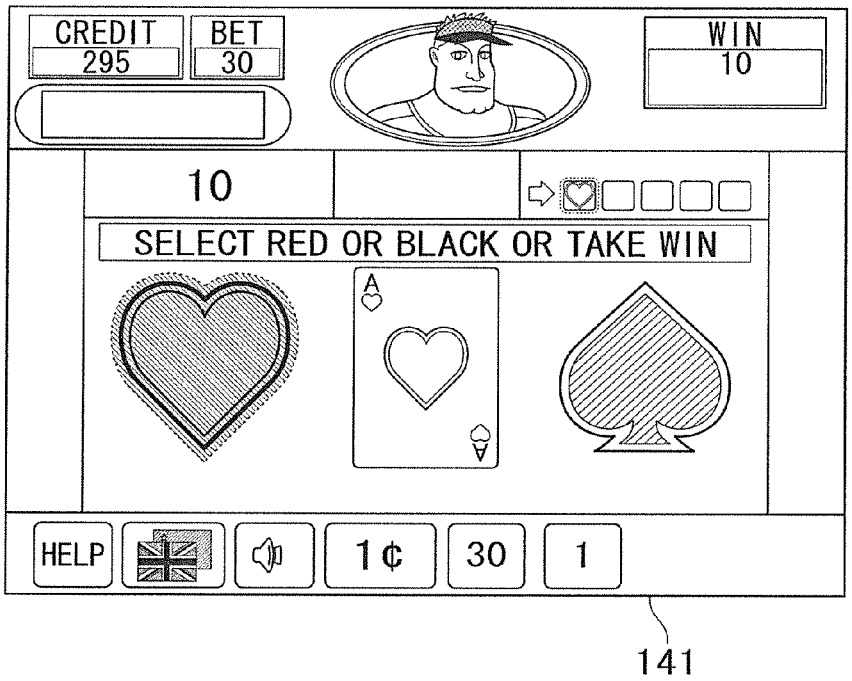
FIG. 41 illustrates GAMBLE in the slot machine of the embodiment of the present invention.

When the player fails in the selection, the option ("RED" or "BLACK") which is not selected is darkened on the lower image display panel 141 shown in FIG. 41. On the lower image display panel 141 shown in FIG. 41, the history of card selection is immediately displayed at the leftmost part of the "GAMBLE HISTORY". When there is previous history of card selection, that previous history is moved to the immediate right. The trace of the movement is not illustrated in animation, and hence the history is rewritten at once. Furthermore, the result of the central card is immediately displayed. At this stage, however, neither the win meter nor the gamble amount meter changes. Then failure sound is reproduced, and after 1.2 seconds elapse after the sound reproduction, the screen is switched to a main game screen as indicated by the lower image display panel 141 shown in FIG. 42. At the same time as the switching to the main game screen, "0" is displayed on the win meter.

Figure 43:
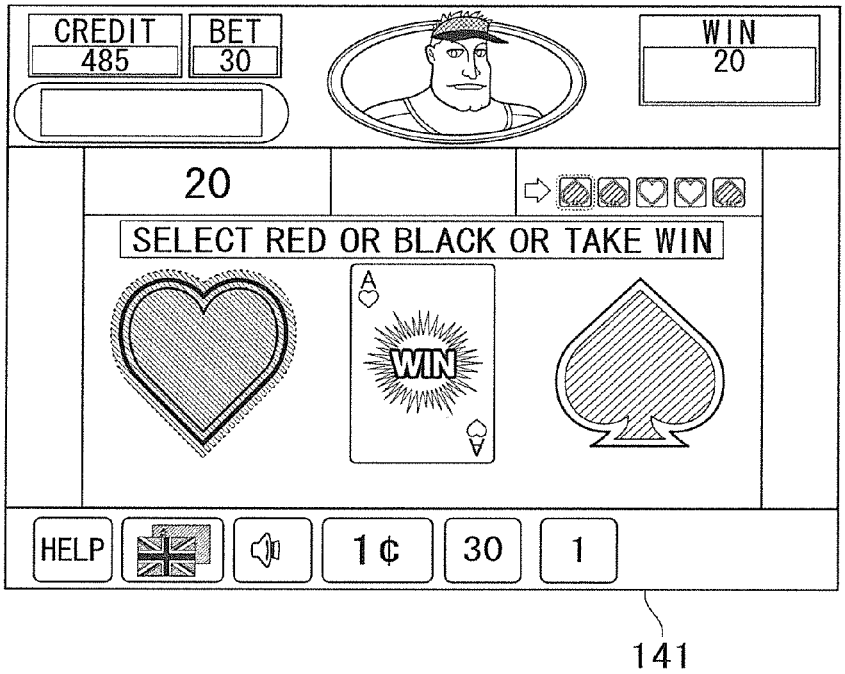
FIG. 43 illustrates GAMBLE in the slot machine of the embodiment of the present invention.
Figure 44:
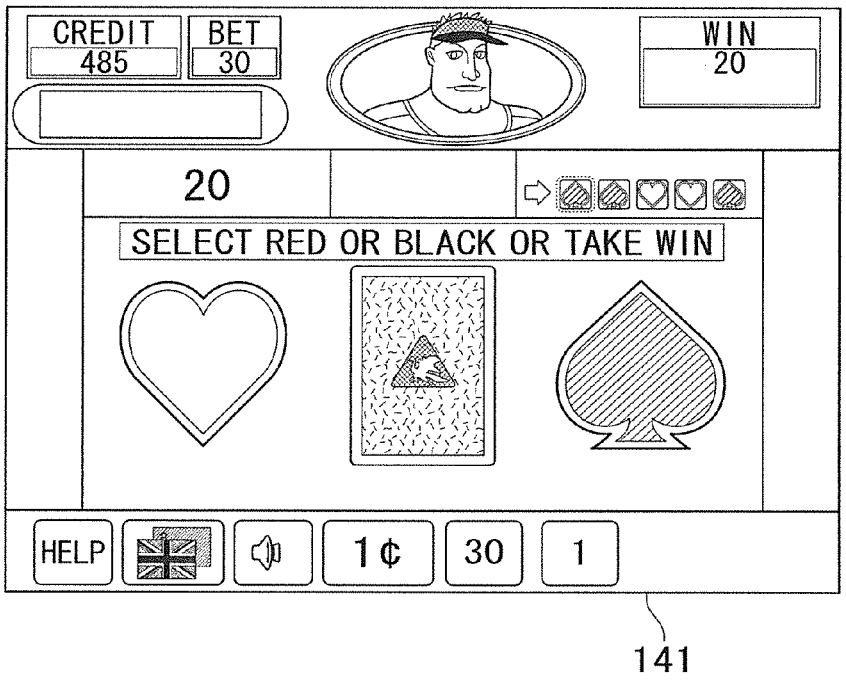
FIG. 44 illustrates GAMBLE in the slot machine of the embodiment of the present invention.

When the player succeeds in the selection, the option ("RED" or "BLACK") which is not selected is darkened on the lower image display panel 141 shown in FIG. 43. On the lower image display panel 141 shown in FIG. 43, the history of card selection is immediately displayed at the leftmost part of the "GAMBLE HISTORY". When there is previous history of card selection, that previous history is moved to the immediate right. The trace of the movement is not illustrated in animation, and hence the history is rewritten at once. Furthermore, as the central card, a normal card and a card with WIN text are alternately displayed for each frame, and success sound is reproduced for 1.2 seconds. To the win meter, the amount increased by the result of GAMBLE is immediately added. At this stage, however, the gamble amount meter does not change.

When GAMBLE is played until reaching the upper limit number of times, the value of win is added to the credit at once and the idle state returns. In the meanwhile, the number of times of playing the GAMBLE has not reached the upper limit, the lower image display panel 141 is changed to the lower image display panel 141 shown in FIG. 44. On the lower image display panel 141 shown in FIG. 44, the central card is overturned. Thereafter, the lower image display panel 141 is changed to the lower image display panel 141 shown in FIG. 40.

Residual Gamble

Figure 45:
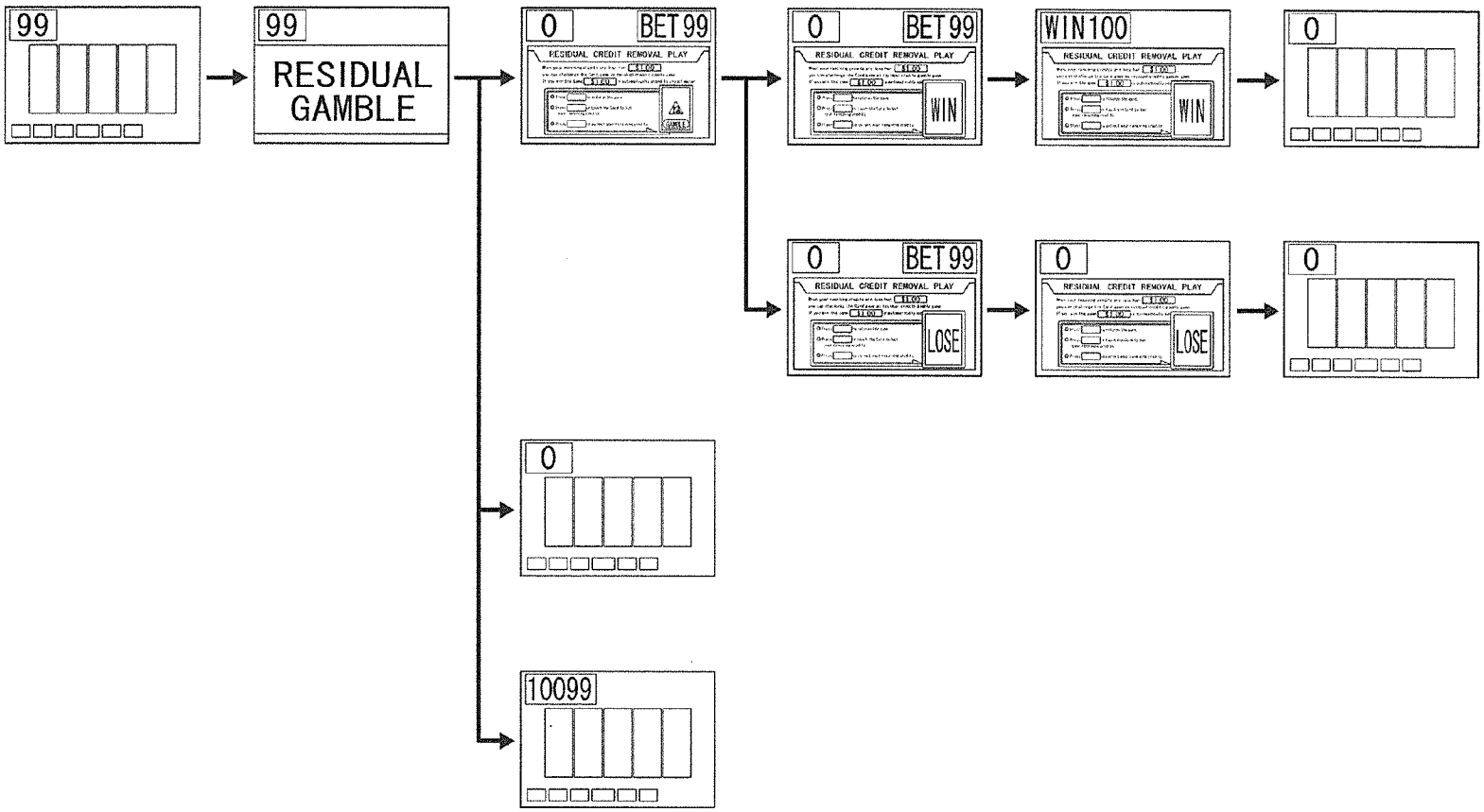
FIG. 45 illustrates RESIDUAL GAMBLE in the slot machine of the embodiment of the present invention.
Figure 47:
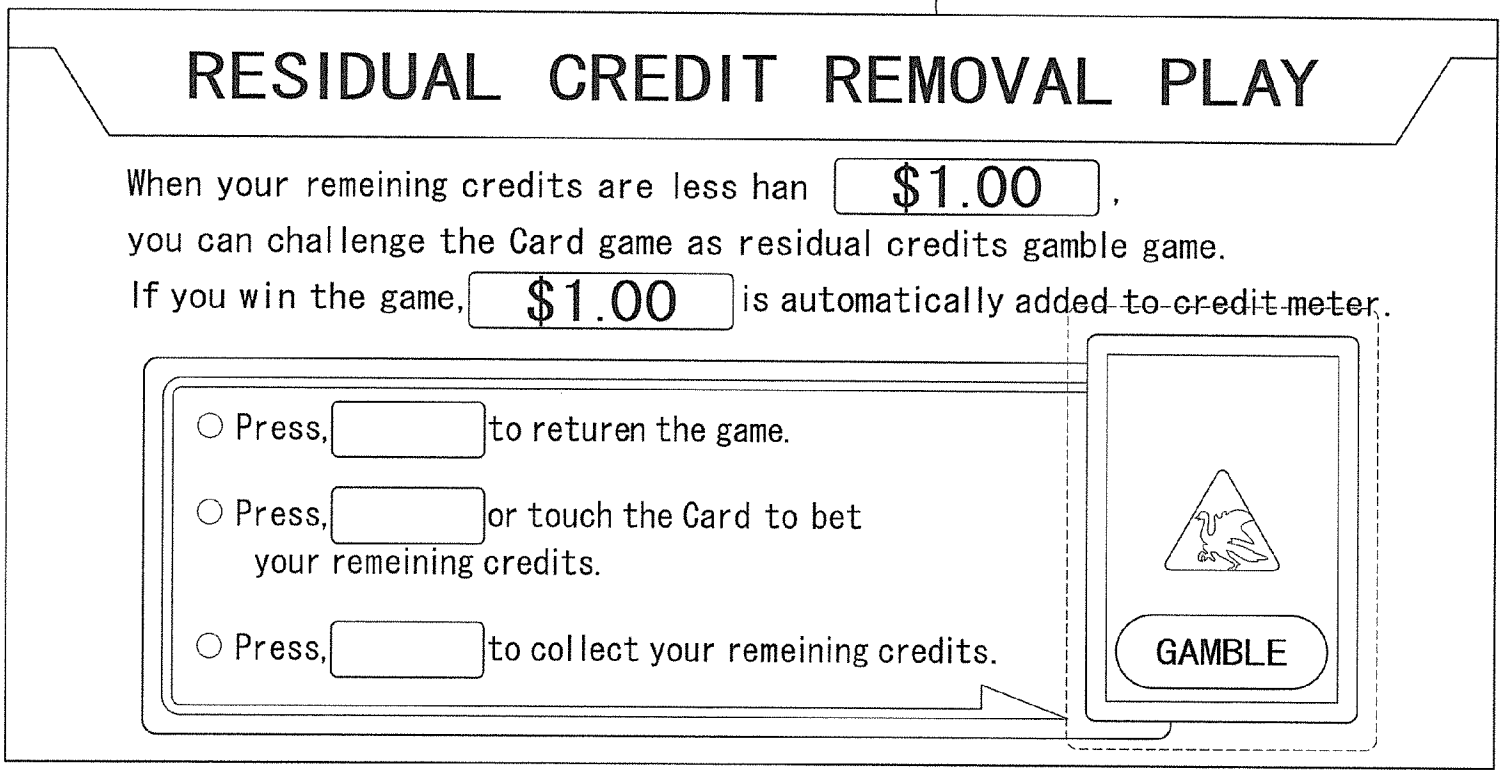
FIG. 47 illustrates RESIDUAL GAMBLE in the slot machine of the embodiment of the present invention.

Now, RESIDUAL GAMBLE of the slot machine 1 will be described with reference to FIG. 45 to FIG. 47. FIGS. 45 to 47 illustrate RESIDUAL GAMBLE in the slot machine of the embodiment of the present invention. RESIDUAL GAMBLE is executed in line with the flow shown in FIG.

45, by using a table shown in FIG. 66. In this connection, in a stage in the RESIDUAL GAMBLE, an image 501 shown in FIG. 47 is displayed on the lower image display panel 141.

System Font Display Region

Figure 48:
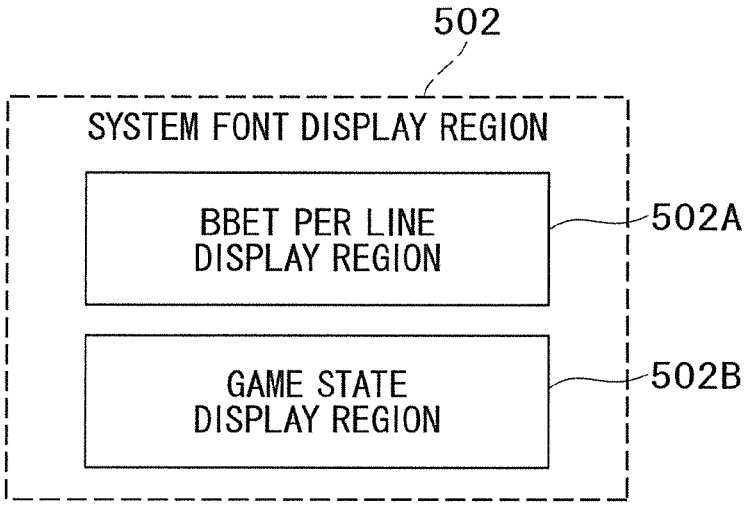
FIG. 48 shows a system font display region of the slot machine of the embodiment of the present invention.

Now, a system font display region of slot machine 1 will be described with reference to FIG. 48. FIG. 48 shows the system font display region of the slot machine of the embodiment of the present invention. The system font display region 502 shown in FIG. 48 is provided with a bet per line display region 502A and a game state display region 502B. The system font display region 502 is provided in the bet information and game state display region 407 on the lower image display panel 141.

Help

Figures 49, 50:
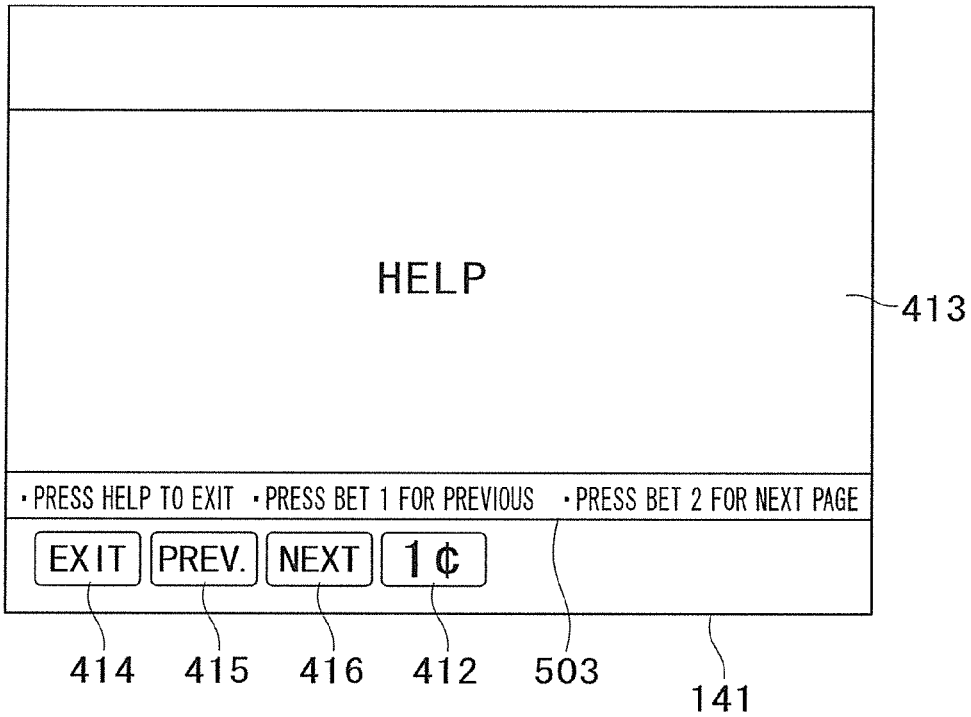
FIG. 49 illustrates HELP in the slot machine of the embodiment of the present invention.
FIG. 50 illustrates HELP in the slot machine of the embodiment of the present invention.

Now, HELP of the slot machine 1 will be described with reference to FIG. 49 and FIG. 50. FIG. 49 and FIG. 50 explain HELP in the slot machine of the embodiment of the present invention. As shown in FIG. 49, on the lower image display panel 141 in HELP, a help screen 413 and a message region 503 are provided, and an EXIT touch button 414, a PREV. touch button 415, a NEXT touch button 416, and a denomination display region 412 are displayed.

The message region 503 is displayed with system fonts. This region is linked with the control panel 30 or the control panel 460. For this reason, when another pattern is used and the number is changed, the image display on the region is changed to the correct one in accordance with the change.

As indicated in the table shown in FIG. 50, when the player touches or presses the EXIT touch button 414 or the help button on the control panel, the lower image display panel 141 in HELP is changed to the normal screen. When the player touches or presses the PREV. touch button 415 or a BET×1 button on the control panel, the lower image display panel 141 in HELP is changed to the preceding HELP page. When the player touches or presses the NEXT touch button 416 or a BET×2 button on the control panel, the lower image display panel 141 in HELP proceeds to the next HELP page.

Layout of Screen Touch Buttons

Now, the following will describe the layout of the screen touch buttons in the slot machine 1, with reference to FIG. 51 to FIG. 53. Each of FIG. 51 to FIG. 53 illustrates the layout of screen touch buttons in the slot machine of the embodiment of the present invention.

Figure 51A:
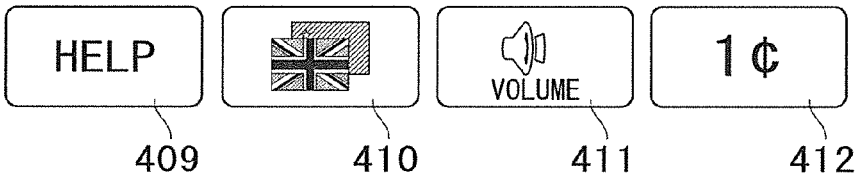
FIG. 51A illustrates the layout of screen touch buttons in the slot machine of the embodiment of the present invention.
Figure 51B:
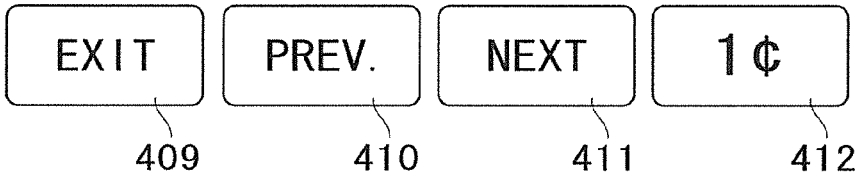
FIG. 51B illustrates the layout of screen touch buttons in the slot machine of the embodiment of the present invention.
Figure 51C:
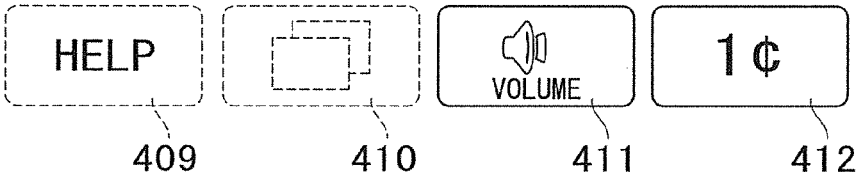
FIG. 51C illustrates the layout of screen touch buttons in the slot machine of the embodiment of the present invention.
Figure 51D:
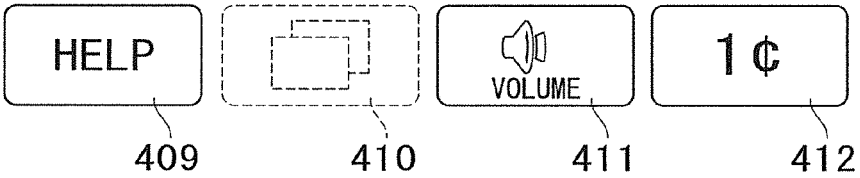
FIG. 51D illustrates the layout of screen touch buttons in the slot machine of the embodiment of the present invention.
Figure 52A:
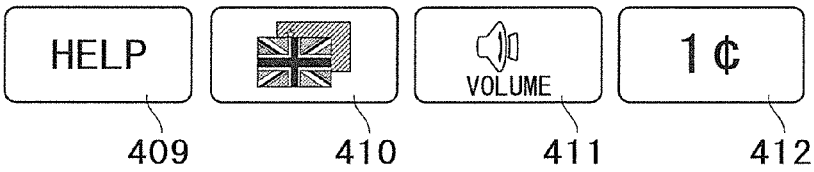
FIG. 52A illustrates the layout of screen touch buttons in the slot machine of the embodiment of the present invention.
Figure 52B:
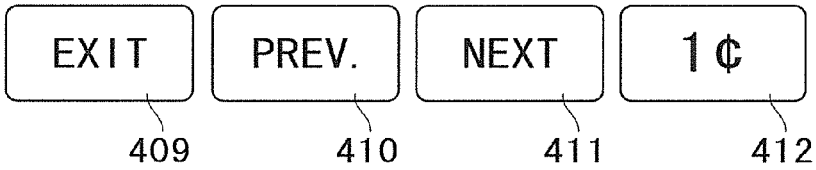
FIG. 52B illustrates the layout of screen touch buttons in the slot machine of the embodiment of the present invention.
Figure 52C:
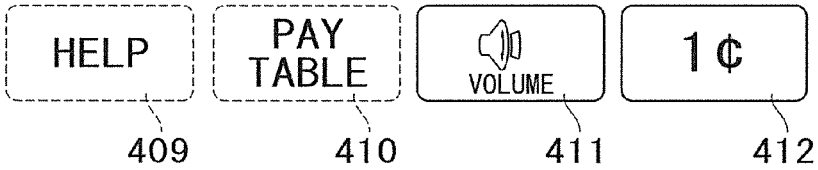
FIG. 52C illustrates the layout of screen touch buttons in the slot machine of the embodiment of the present invention.
Figure 52D:
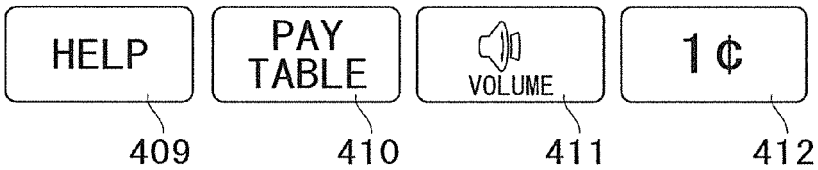
FIG. 52D illustrates the layout of screen touch buttons in the slot machine of the embodiment of the present invention.

FIG. 51A shows the layout of the screen touch buttons during IDLE. FIG. 51B shows the layout of the screen touch buttons in HELP. FIG. 51C shows the layout of the screen touch buttons while the game is in progress. FIG. 51D is the layout of the screen touch buttons in the state of GAMBLE or TAKE WIN. FIG. 52A shows the layout of the screen touch buttons in IDLE (language switching disabled). FIG. 52B shows the layout of the screen touch buttons in HELP (language switching disabled). FIG. 52C shows the layout of the screen touch buttons during the game (language switching disabled). FIG. 52D shows the layout of the screen touch buttons in the state of GAMBLE or TAKE WIN (language switching disabled).

In the layout of the screen touch buttons in the slot machine 1, a help touch button 409, a language switching touch button 410, a sound volume switching touch button 411*a* denomination display region 412, an EXIT touch button 414, a PREV. touch button 415, or NEXT touch button 416 is provided. In particular, when the language switching is disabled and the game is in progress or the state is in GAMBLE or TAKE WIN, as shown in FIGS. 52C and 52D, a paytable touch button 504 is provided. These touch buttons are active when turned on and inactive when turned off as shown in FIG. 53.

Sound Volume Switching Touch Button

Figure 54:
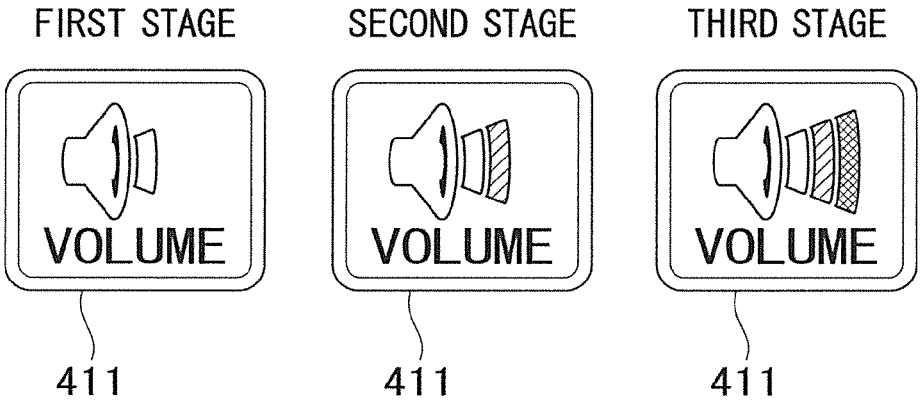
FIG. 54 illustrates a sound volume switching touch button of the slot machine of the embodiment of the present invention.
Figure 55:
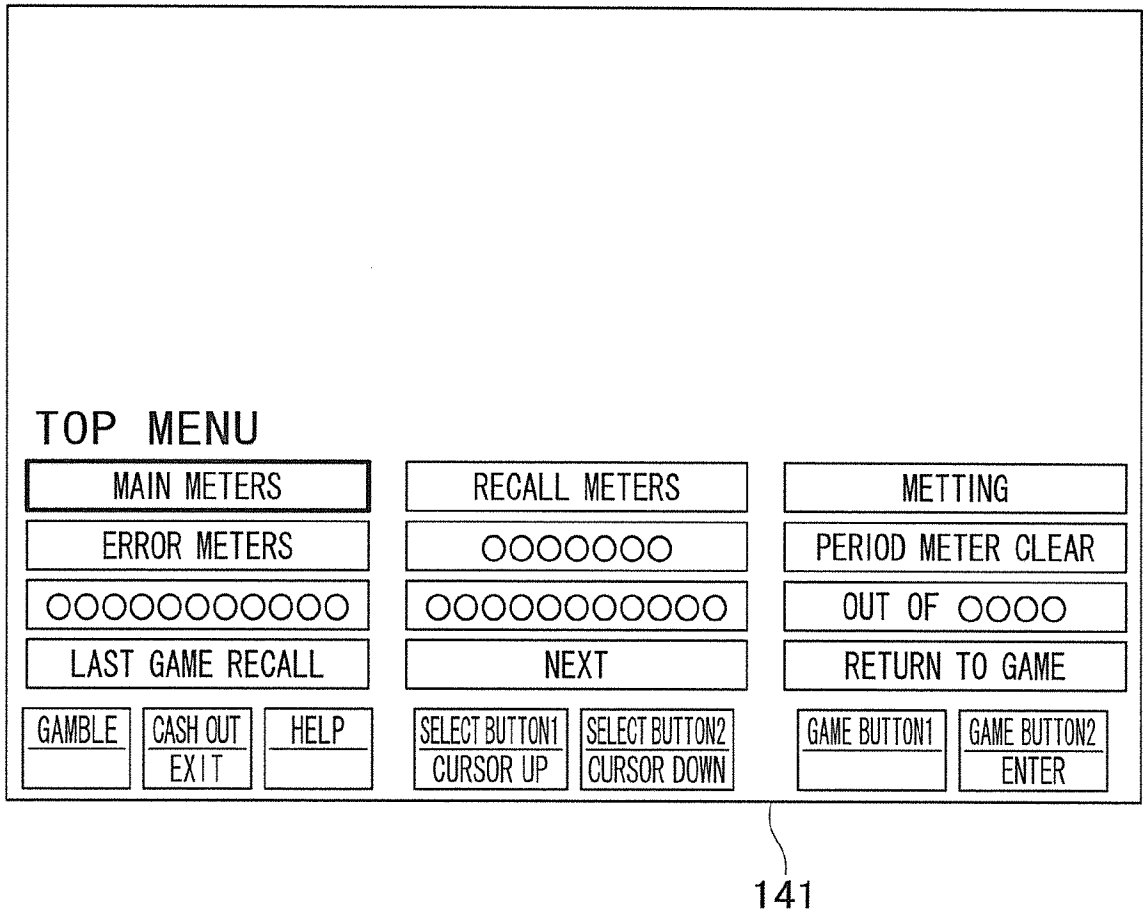
FIG. 55 shows AUDIT national flag switch setting in the slot machine of the embodiment of the present invention.
Figure 56:
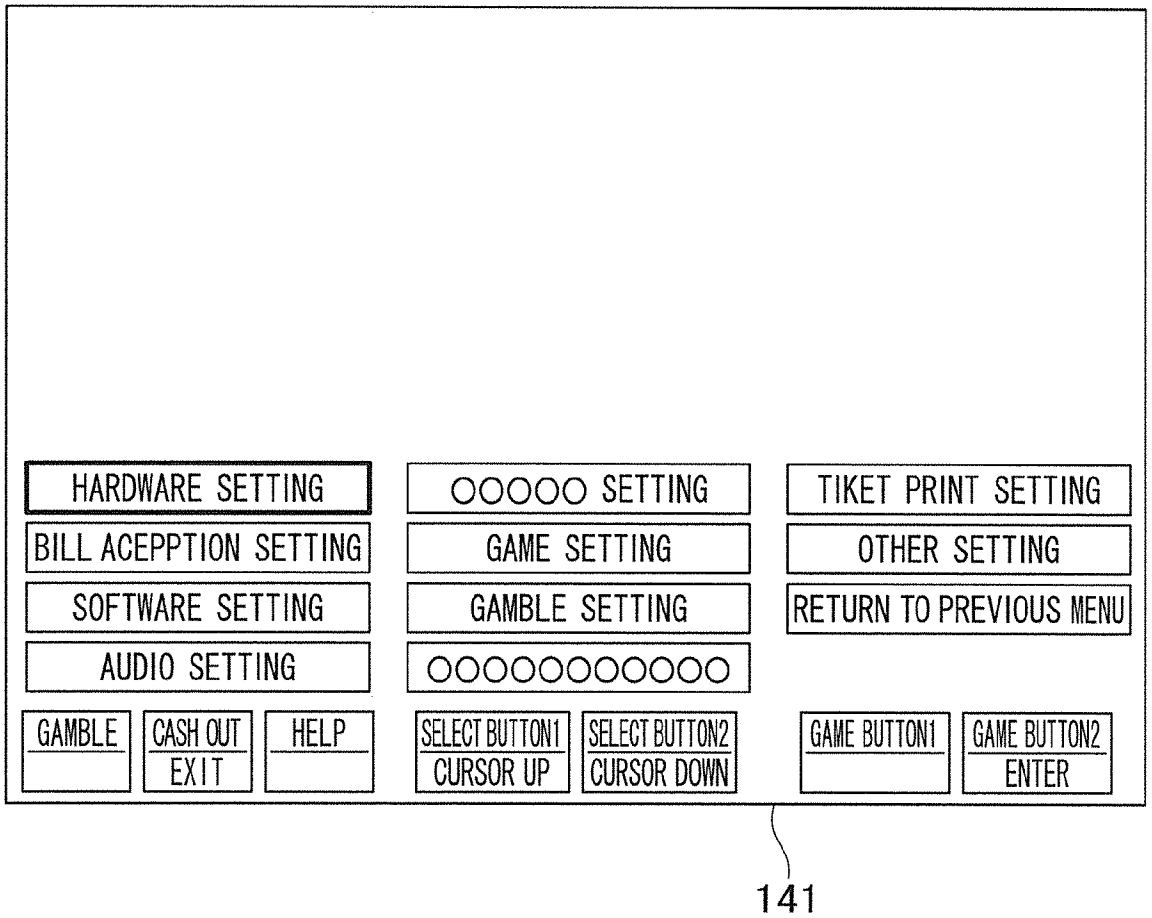
FIG. 56 shows AUDIT national flag switch setting in the slot machine of the embodiment of the present invention.
Figure 57:
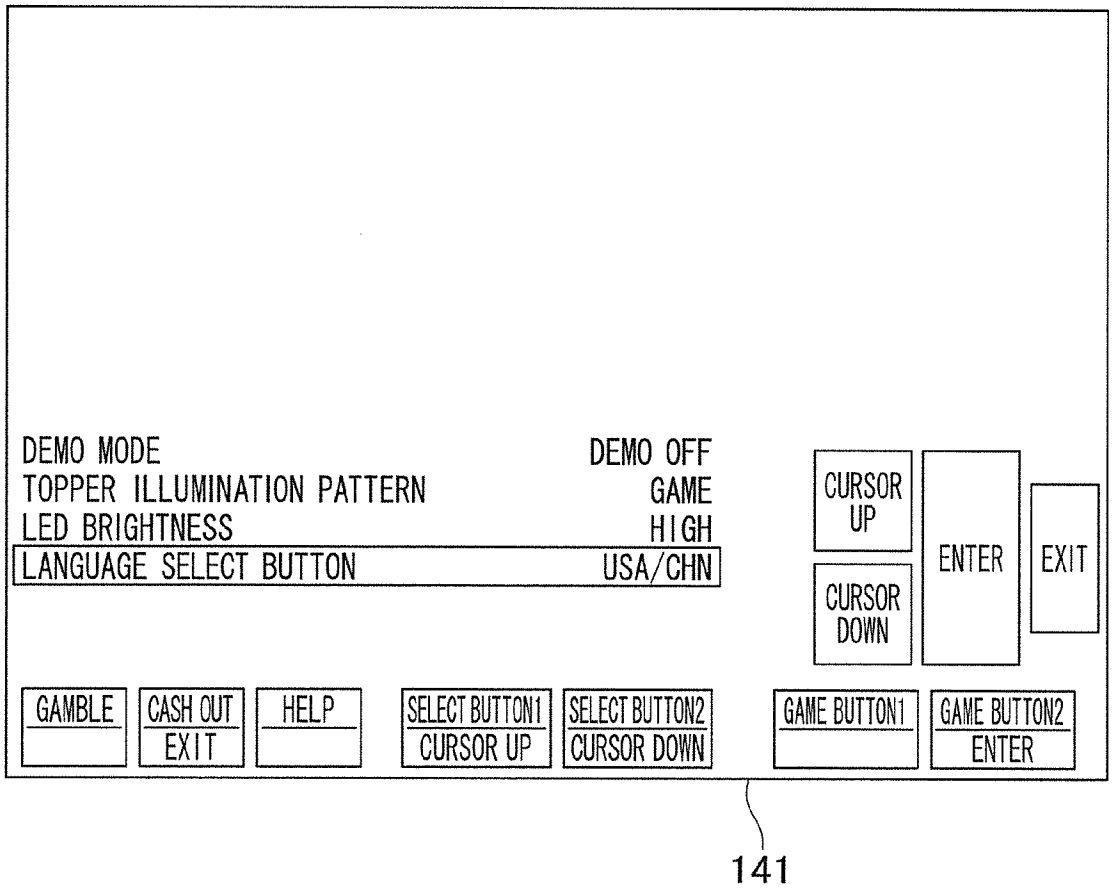
FIG. 57 shows AUDIT national flag switch setting in the slot machine of the embodiment of the present invention.
Figure 58:
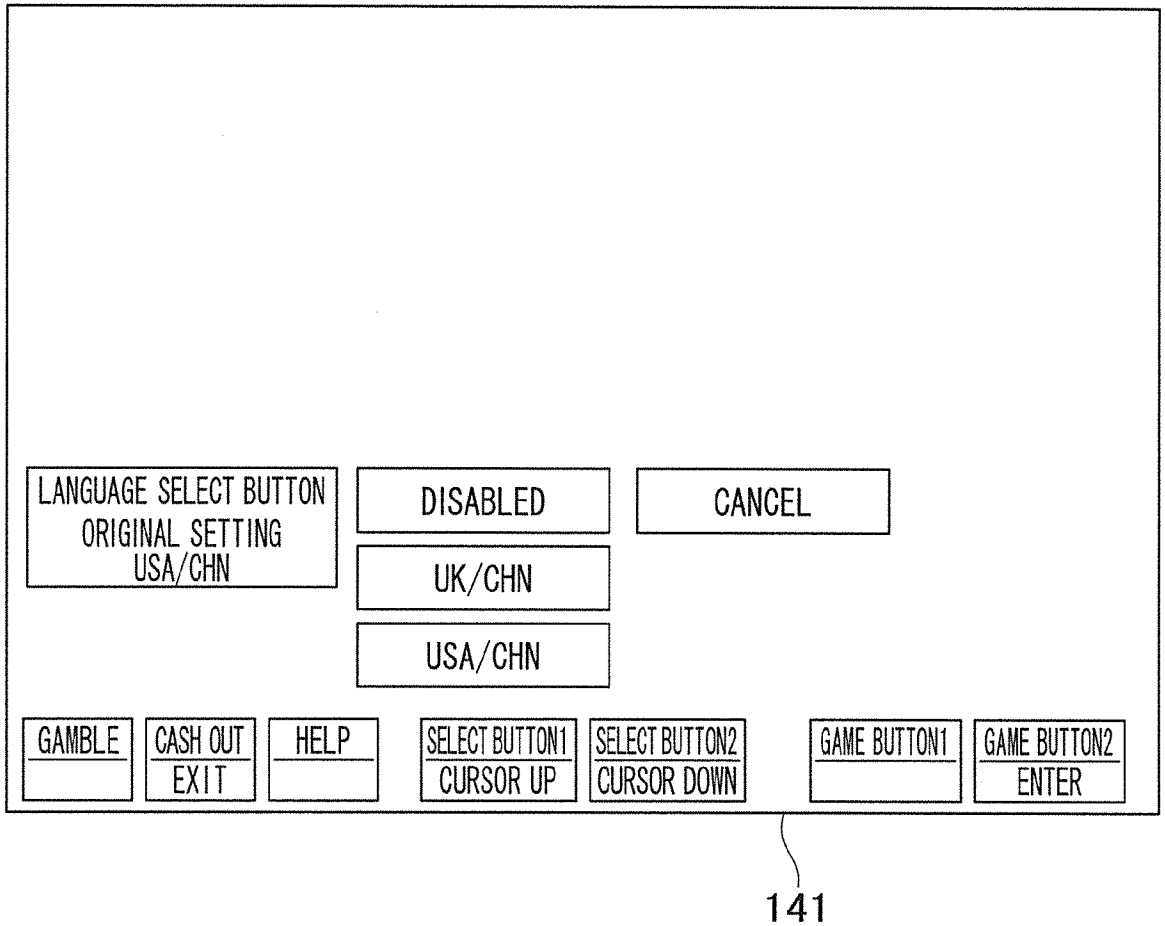
FIG. 58 shows AUDIT national flag switch setting in the slot machine of the embodiment of the present invention.

Now, referring to FIG. 54, the following will describe the sound volume switching touch button 411 of the slot machine 1. FIG. 54 illustrates the sound volume switching touch button of the slot machine of the embodiment of the present invention. As shown in FIG. 54, the sound volume switching touch button 411 is used for selecting one of the first-stage minimum volume, second-stage intermediate volume, and third-stage maximum volume. The sound volume is set at the first-stage minimum volume in the initial setting. Each time the player touches the sound volume switching touch button 411, the sound volume is changed to the second-stage intermediate volume, to the third-stage maximum volume, to the first-stage minimum volume, and to the second-stage intermediate volume, in a looped manner.

Audit National Flag Switch Setting

Now, referring to FIG. 55 to FIG. 58, AUDIT national flag switch setting of the slot machine 1 will be described. Each of FIG. 55 to FIG. 58 shows the AUDIT national flag switch setting in the slot machine of the embodiment of the present invention. On the lower image display panel 141 shown in FIG. 55 to FIG. 58, the AUDIT national flag switch setting of the slot machine of the embodiment of the present invention makes it possible to specify, by the AUDIT MENU, the "national flag" displayed on the language switching touch button 410 when switching the language. The "national flag" displayed on the language switching touch button 410 is one of the national flags, of U.S.A., U.K., and China.

While in the embodiment above the fixed jackpot value is explained as a source of the progressive jackpot payout, the disclosure is not limited to this arrangement. The fixed jackpot value may be differently arranged as long as it is awarded in accordance with a predetermined game result of the normal game. For example, in the symbol combination table shown in FIG. 10, a payout amount corresponding to the number of "MELON" symbols may be arbitrarily set as the fixed jackpot value. In such a case, when a table 1 in which the payout amount is "25" when the number of "MELON" symbols is 3, is "100" when the number of "MELON" symbols is 4, and is "500" when the number of "MELON" symbols is 5, a table 2 in which the payout amount is "50" when the number of "MELON" symbols is 3, is "200" when the number of "MELON" symbols is 4, and is "1000" when the number of "MELON" symbols is 5, and a table 3 in which the payout amount is "75" when the number of "MELON" symbols is 3, is "300" when the number of "MELON" symbols is 4, and is "1500" when the number of "MELON" symbols is 5 are selectable, the feature random determination probabilities in the respective tables are arranged as the table 1> the table 2> the table 3.

According to the arrangement above, when in the normal game a fixed jackpot value awarded when a predetermined game result is obtained is arranged to be large, the probability of shifting from the normal game to the feature game is low. In the meanwhile, when the fixed jackpot value is small, the probability of shifting from the normal game to the feature game is high. As such, the overall payout rate is adjustable irrespective of the fixed jackpot value.

Other Notes

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process executed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A gaming machine executing a game capable of awarding a special bonus, comprising:

a display device configured to display a game result by rearranging a video reel group on which symbols are laid out;

a monetary acceptor configured to accept a game medium with a monetary value;

a storage which is configured to store the video reel group on which the symbols are laid out and a trigger symbol reel group displayed to overlap the video reel group, in the trigger symbol reel group the number of trigger symbols required to award the special bonus increases as the number of game media having been bet increases; and a controller, the controller being configured to execute the processes of:

(D0) accepting the game medium via the monetary acceptor;

(D1) receiving an input of betting of the game medium;

(D2) reading, from the storage, the trigger symbol reel group corresponding to the number of game media having been received in the process (D1) and setting the trigger symbol reel group to be rearrangeable on the display device;

(D3) as the game, randomly determining the symbols and the trigger symbol which are to be rearranged on the display device;

(D4) executing an effect of scrolling the video reel group and the trigger symbol reel group and visually changing the trigger symbol during the scroll; and (D5) rearranging the symbols and the trigger symbol determined in the process (D3) on the display device and awarding a benefit or the special bonus based on a combination of the rearranged symbols and trigger symbol.

2. The gaming machine according to claim 1, wherein, in the process (D3), effect sound is generated when the trigger symbol is displayed on the display device during the scroll.

3. A method of controlling a gaming machine executing a game capable of awarding a special bonus, the gaming machine including:

a display device configured to display a game result by rearranging a video reel group on which symbols are laid out;

a monetary acceptor configured to accept a game medium with a monetary value;

a storage which is configured to store the video reel group on which the symbols are laid out and a trigger symbol reel group displayed to overlap the video reel group, in the trigger symbol reel group the number of trigger symbols required to award the special bonus increases as the number of game media having been bet increases; and a controller, the method comprising the steps, performed under the control of the controller, of:

(E0) accepting the game medium via the monetary acceptor;

(E1) receiving an input of betting of the game medium;

(E2) reading, from the storage, the trigger symbol reel group corresponding to the number of game media having been received in the step (E1) and setting the trigger symbol reel group to be rearrangeable on the display device;

(E3) as the game, randomly determining the symbols and the trigger symbol which are to be rearranged on the display device;

(E4) executing an effect of scrolling the video reel group and the trigger symbol reel group and visually changing the trigger symbol during the scroll; and (E5) rearranging the symbols and the trigger symbol determined in the step (E3) on the display device and awarding a benefit or the special bonus based on a combination of the rearranged symbols and trigger symbol.

* * * * *